US011155993B2

(12) United States Patent
Hakuta et al.

(10) Patent No.: US 11,155,993 B2
(45) Date of Patent: Oct. 26, 2021

(54) SOUNDPROOFING STRUCTURE, PARTITION STRUCTURE, WINDOW MEMBER, AND CAGE

(71) Applicant: FUJIFILM Corporation, Tokyo (JP)

(72) Inventors: Shinya Hakuta, Ashigarakami-gun (JP); Shogo Yamazoe, Ashigarakami-gun (JP); Hiroshi Komatsu, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 567 days.

(21) Appl. No.: 16/119,367

(22) Filed: Aug. 31, 2018

(65) Prior Publication Data

US 2019/0017259 A1 Jan. 17, 2019

Related U.S. Application Data

(63) Continuation of application No. PCT/JP2017/012227, filed on Mar. 27, 2017.

(30) Foreign Application Priority Data

Mar. 29, 2016 (JP) ..... JP2016-065862
Apr. 28, 2016 (JP) ..... JP2016-090808

(51) Int. Cl.
*E04B 1/86* (2006.01)
*G10K 11/172* (2006.01)
(Continued)

(52) U.S. Cl.
CPC ..... *E04B 1/86* (2013.01); *E04B 1/8409* (2013.01); *G10K 11/172* (2013.01);
(Continued)

(58) Field of Classification Search
CPC .. E04B 1/86; E04B 1/8409; E04B 2001/8433; G10K 11/172; G10K 11/1781
(Continued)

(56) References Cited

U.S. PATENT DOCUMENTS 6,555,246 B1 * 4/2003 Zwick ..... F01N 13/14 181/290
6,598,701 B1 * 7/2003 Wood ..... G10K 11/162 181/284
(Continued)

FOREIGN PATENT DOCUMENTS

EP 3264412 A1 1/2018
JP 3040527 U 8/1997
(Continued)

OTHER PUBLICATIONS

International Preliminary Report on Patentability and Written Opinion of the International Searching Authority(Forms PCT/IB/326, PCT/IB/373 and PCT/ISA/237), dated Oct. 11, 2018 for International Application No. PCT/JP2017/012227, with an English Translation of the Written Opinion.
(Continued)

*Primary Examiner* — Forrest M Phillips
(74) *Attorney, Agent, or Firm* — Birch, Stewart, Kolasch & Birch, LLP

(57) ABSTRACT

An object is to provide a soundproofing structure, a partition structure, a window member, and a cage which exhibit high soundproofing performance in a broad frequency band, can be miniaturized, can ensure ventilation properties, and have a light transmittance. Provided is a soundproofing structure including: a plate-like member which has a plurality of through-holes passing therethrough in a thickness direction; and a frame member which includes an opening portion, in which membrane vibration of the plate-like member is enabled by fixing the plate-like member to a peripheral edge of the opening portion of the frame member, an average opening diameter of the through-holes is in a range of 0.1 μm to 250 μm, and a first unique vibration frequency of the
(Continued)

membrane vibration of the plate-like member is present in a range of 10 Hz to 100000 Hz.

20 Claims, 26 Drawing Sheets

(51) Int. Cl.
*E04B 1/84* (2006.01)
*G10K 11/178* (2006.01)

(52) U.S. Cl.
CPC ..... *E04B 2001/8433* (2013.01); *E04B 2001/8485* (2013.01); *G10K 11/1781* (2018.01)

(58) Field of Classification Search
USPC ..... 181/293
See application file for complete search history.

(56) References Cited

U.S. PATENT DOCUMENTS

| | | | | |
|---|---|---|---|---|
| 8,469,145 | B2 * | 6/2013 | Nonogi | B32B 27/08 181/291 |
| 10,269,339 | B2 * | 4/2019 | Hakuta | G10K 11/16 |
| 10,373,599 | B2 * | 8/2019 | Hakuta | G10K 11/161 |
| 2005/0098379 | A1 * | 5/2005 | Sato | B60R 13/0815 181/293 |
| 2006/0289229 | A1 * | 12/2006 | Yamaguchi | G10K 11/172 181/290 |
| 2007/0227815 | A1 * | 10/2007 | Nakamura | E04B 1/86 181/290 |
| 2013/0020148 | A1 * | 1/2013 | Nakajima | E04B 1/86 181/292 |

FOREIGN PATENT DOCUMENTS

| | | | |
|---|---|---|---|
| JP | 2003-239226 | A | 8/2003 |
| JP | 2007-163685 | A | 6/2007 |
| JP | 2008-9014 | A | 1/2008 |
| JP | 2009-139556 | A | 6/2009 |
| JP | 2011-149200 | A | 8/2011 |
| JP | 2015-152794 | A | 8/2015 |

OTHER PUBLICATIONS

International Search Report (Form PCT/ISA/210), dated Jun. 20, 2017, for International Application No. PCT/JP2017/012227, with an English translation.

Japanese Office Action, dated Oct. 15, 2019, for corresponding Japanese Application No. 2018-509297, with an English translation.

Extended European Search Report dated Apr. 24, 2019, for corresponding European Application No. 17774852.2.

* cited by examiner

SOUNDPROOFING STRUCTURE, PARTITION STRUCTURE, WINDOW MEMBER, AND CAGE

CROSS-REFERENCE TO RELATED APPLICATIONS

This application is a Continuation of PCT International Application No. PCT/JP2017/012227 filed on Mar. 27, 2017, which claims priority under 35 U.S.C. § 119(a) to Japanese Patent Application No. 2016-065862 filed on Mar. 29, 2016 and Japanese Patent Application No. 2016-090808 filed on Apr. 28, 2016. Each of the above application(s) is hereby expressly incorporated by reference, in its entirety, into the present application.

BACKGROUND OF THE INVENTION

1. Field of the Invention

The present invention relates to a soundproofing structure and a partition structure, a window member, and a cage using the soundproofing structure.

2. Description of the Related Art

In many cases, typical noise is over frequencies in a broadband, a low frequency sound is felt as a pressure, a sound in a mid-range (approximately 1000 Hz to 4000 Hz) is heard as a loud sound since the structure of an ear is formed to be sensitive to the sound in that range, and a high frequency sound is felt to be harsh on the ears. Accordingly, it is necessary to take countermeasures for broadband noise in a broadband.

For example, as an example of wind noise, there is a noise having a sound pressure from a low frequency range to a high frequency range, such as white noise, and thus it is necessary to take countermeasures for broadband noise. Particularly, in the countermeasures for a noise inside various devices (such as office equipment such as a copying machine, an automobile, and an electric train), since the size of a device is limited, a soundproofing structure capable of soundproofing in a small space has been required. Further, in a movable portion such as a motor or a fan in various devices, noise is frequently generated even from a side of a low frequency of 100 Hz to 1000 Hz, which is problematic.

In the related art, as typical soundproofing materials for a noise of frequencies in a broadband, an urethane sponge, a glass wool, and the like have been used. However, in a case where the urethane sponge, the glass wool, and the like are used as the soundproofing materials, there is a problem in that soundproofing performance cannot be sufficiently obtained in a case where the size of the material in a device is limited because the volume of the material needs to be increased in order to increase the absorbance. Further, there is another problem in that the material is not strong enough to withstand the environment and deteriorates. Particularly, since a low-frequency sound is known to be difficult to absorb, it is difficult to absorb a low-frequency sound unless an extremely large volume of a sound absorbing material is used in a case of a sound absorbing material of the related art or a combination of a sound absorbing material and a rear surface wall. In addition, since the material is fibrous, the environment is contaminated by fiber garbage. Accordingly, there are problems in that this material cannot be used in a clean room environment, an environment with precision equipment, or a manufacturing site where contamination becomes a problem and the material affects a duct fan and the like. Further, the holes of the urethane sponge and the glass wool are three-dimensional pores, and thus the light transmittance is low, which is problematic.

As a soundproofing structure that absorbs a sound in a specific frequency band, a soundproofing structure utilizing membrane vibration and a soundproofing structure utilizing Helmholtz resonance may be exemplified.

Since sound absorption occurs at the resonance frequency of membrane vibration in the soundproofing structure utilizing membrane vibration, sound absorption is increased at the resonance frequency, but sound absorption is decreased at other frequencies. Therefore, it is difficult to widen the frequency band where the sound is absorbed.

As described in JP2008-9014A, a soundproofing structure utilizing Helmholtz resonance has a configuration of a closed space which is acoustically closed by disposing a shielding plate on a rear surface of a plate-like member in which a plurality of through-holes have been formed.

Such a soundproofing structure utilizing Helmholtz resonance is a structure formed by connecting a part controlled by a motion equation in which, when an external sound enters through-holes, the air in the through-holes is moved by the sound with a part controlled by a spring equation in which the air in the closed space repeatedly expands and contracts due to the sound. According to the respective equations, the movement of the air in the through-holes shows a coil-like behavior in which the pressure phase is advanced by 90 degrees further than the local velocity phase and the movement of the air in the closed space shows a capacitor-like behavior in which the pressure phase is delayed by 90 degrees further than the local velocity phase. Therefore, the Helmholtz resonance is a so-called LC series circuit as an equivalent circuit of a sound as a whole and has resonance to be determined by the area and the length of the through-holes and the volume of the closed space. At the time of this resonance, multiple sounds reciprocate through the through-holes and strong sound absorption occurs at a specific frequency due to the friction between the sounds and the through-holes during the reciprocation.

Further, JP2015-152794A describes, as a soundproofing structure having through-holes without a closed space, a soundproofing sheet which includes a sheet having a plurality of through-holes, and a sound collecting portion which has through-holes arranged such that the centers thereof substantially coincide with the through-holes of the sheet, has a shape in which the diameter increases along with an increase in distance from the sheet, and is provided outside the sheet.

JP2009-139556A discloses a sound absorbing body which is partitioned by a partition wall serving as a frame and closed by a rear wall (rigid wall) formed of a plate-like member and in which the front portion is covered by a film material (film-like sound absorbing material) that covers an opening portion of a cavity forming the opening portion, a pressure plate is placed thereon, and resonance holes for Helmholtz resonance are formed in a region (corner portion) within a range of 20% of the dimension of the surface of the film-like sound absorbing material from a fixed end of a peripheral edge of the opening portion which is a region where displacement due to sound waves of the film material is the least likely to occur. In this sound absorbing body, the cavity is blocked except for resonance holes. This sound absorbing body exhibits both a sound absorbing action using membrane vibration and a sound absorbing action using Helmholtz resonance.

SUMMARY OF THE INVENTION

In the configuration which is obtained by providing a closed space on the rear surface of a plate-like member in which a plurality of through-holes have been formed and in which a sound is absorbed using the Helmholtz resonance, as described in JP2008-9014A, a shielding plate that does not allow a sound to pass through the rear surface of the plate-like member becomes indispensable in order to prepare a closed space. Further, as a principle, a frequency band which is capable of sound absorption since the resonance is used is narrow, and the band is difficult to widen.

In order to solve such a problem, it has been attempted to provide a plurality of holes in a thickness direction or a horizontal direction or provide a plurality of spaces on the rear surface, but there are problems of an increase in size of the soundproofing structure because a plurality of cells need to be provided, complication of the structures or components because these need to be formed separately, and an increase in number of components.

Further, since a closed space is required to be provided on the rear side, there are problems in that the size of the volume of the closed space is increased and the ventilation properties or waste heat cannot be ensured.

Particularly, there is a problem in that the size of an air layer of a closed space needs to be increased because the volume thereof needs to be increased in order to absorb a low-frequency sound.

Further, the soundproofing sheet described in JP2015-152794A is a sheet which shields a sound by reflecting the sound according to the mass law using the weight of the sheet itself. The through-hole portions do not contribute to soundproofing, and the performance as close to the sound insulation performance of the original sheet as possible is ensured even in a case where the through-holes are opened by devising the structures around the through-holes. Therefore, there are problems in that the soundproofing performance higher than the mass law cannot be obtained and a sound cannot be satisfactorily absorbed because the sound is reflected.

Further, in JP2009-139556A, the rear wall of the partition wall serving as a frame is blocked by the plate-like member since the sound absorbing action using membrane vibration needs to be carried out according to the sound absorbing action using the Helmholtz resonance. Therefore, similar to JP2008-9014A, since the partition wall does not have the ability to pass air and heat therethrough, heat tends to be accumulated. Accordingly, this partition wall is not suitable for insulating sound from a device, an automobile, and the like.

An object of the present invention is to solve the above-described problems of the techniques of the related art and to provide a soundproofing structure which exhibits high soundproofing performance in a broad frequency band from a low-frequency side to a high-frequency side, can be miniaturized, can ensure ventilation properties, and has a light transmittance.

As the result of intensive examination conducted by the present inventors in order to achieve the above-described object, it was found that the above-described problems can be solved by providing a soundproofing structure including: a soundproofing structure comprising: a plate-like member which has a plurality of through-holes passing therethrough in a thickness direction; and a frame member which includes an opening portion, in which membrane vibration of the plate-like member is caused by fixing the plate-like member to a peripheral edge of the opening portion of the frame member, an average opening diameter of the through-holes is in a range of 0.1 μm to 250 μm, and a first unique vibration frequency of the membrane vibration of the plate-like member is present in a range of 10 Hz to 100000 Hz, thereby completing the present invention.

In other words, it was found that the above-described object can be achieved with the following configurations.

[1] A soundproofing structure comprising: a plate-like member which has a plurality of through-holes passing therethrough in a thickness direction; and a frame member which includes an opening portion, in which membrane vibration of the plate-like member is enabled by fixing the plate-like member to a peripheral edge of the opening portion of the frame member, an average opening diameter of the through-holes is in a range of 0.1 μm to 250 μm, and a first unique vibration frequency of the membrane vibration of the plate-like member is present in a range of 10 Hz to 100000 Hz.

[2] The soundproofing structure according to [1], in which the average opening diameter of the through-holes is 0.1 μm or greater and less than 100 μm, and in a case where the average opening diameter is set as phi (μm) and a thickness of the plate-like member is set as t (μm), an average opening ratio rho of the through-holes falls in a range where a center is $rho_center=(2+0.25\times t)\times phi^{-1.6}$, a lower limit is $rho_center-(0.085\times(phi/20)^{-2})$, and an upper limit is $rho_center+(0.35\times(phi/20)^{-2})$.

[3] The soundproofing structure according to [1], in which the average opening diameter of the through-holes is in a range of 100 μm to 250 μm, and an average opening ratio of the through-holes is in a range of 0.5% to 1.0%.

[4] The soundproofing structure according to any one of [1] to [3], in which an absorbance at a frequency of the first unique vibration frequency ±100 Hz is minimized in the membrane vibration of the plate-like member.

[5] The soundproofing structure according to any one of [1] to [4], in which a size of the opening portion of the frame member is smaller than a wavelength of a sound which has the maximum wavelength among sounds to be soundproofed.

[6] The soundproofing structure according to any one of [1] to [5], in which a plurality of the plate-like members are arranged in the thickness direction.

[7] The soundproofing structure according to any one of [1] to [6], in which a surface roughness Ra of an inner wall surface of the through-hole is in a range of 0.1 μm to 10.0 μm.

[8] The soundproofing structure according to any one of [1] to [6], in which an inner wall surface of the through-hole is formed in a shape of a plurality of particles, and an average particle diameter of projections formed on the inner wall surface is in a range of 0.1 μm to 10.0 μm.

[9] The soundproofing structure according to any one of [1] to [8], in which a material forming the plate-like member is a metal.

[10] The soundproofing structure according to any one of [1] to [9], in which a material forming the plate-like member is aluminum.

[11] The soundproofing structure according to any one of [1] to [10], in which the plurality of through-holes are randomly arranged.

[12] The soundproofing structure according to any one of [1] to [11], in which the plurality of through-holes are formed of through-holes with two or more different opening diameters.

[13] A soundproofing structure comprising: a plurality of unit soundproofing structures, in which the soundproofing structure according to any one of [1] to [12] is used as the unit soundproofing structure.

[14] The soundproofing structure according to any one of [1] to [13], in which the average opening diameter of the through-holes is in a range of 0.1 μm to 50 μm.

[15] The soundproofing structure according to any one of [1] to [14], in which at least some of the through-holes have a shape having a maximum diameter inside the through-holes.

[16] A partition structure comprising: the soundproofing structure according to any one of [1] to [15].

[17] A window member comprising: the soundproofing structure according to any one of [1] to [15].

[18] A cage comprising: the soundproofing structure according to any one of [1] to [15].

According to the present invention, it is possible to provide a soundproofing structure which exhibits high soundproofing performance in a broad frequency band, can be miniaturized, can ensure ventilation properties, and has a light transmittance.

DESCRIPTION OF THE PREFERRED EMBODIMENTS

Hereinafter, the present invention will be described in detail.

The description of constituent elements below will be made based on representative embodiments of the present invention, but the present invention is not limited to such embodiments.

In the present specification, the numerical ranges shown using "to" indicate ranges including the numerical values described before and after "to" as the lower limits and the upper limits.

[Soundproofing Structure]

A soundproofing structure of the present invention includes a plate-like member which has a plurality of through-holes passing therethrough in a thickness direction; and a frame member which includes an opening portion, in which membrane vibration of the plate-like member is enabled by fixing the plate-like member to a peripheral edge of the opening portion of the frame member, an average opening diameter of the through-holes is in a range of 0.1 μm to 250 μm, and a first unique vibration frequency of the membrane vibration of the plate-like member is present in a range of 10 Hz to 100000 Hz.

The configuration of the soundproofing structure of the present invention will be described with reference to FIGS. 1 to 3.

Figure 1:
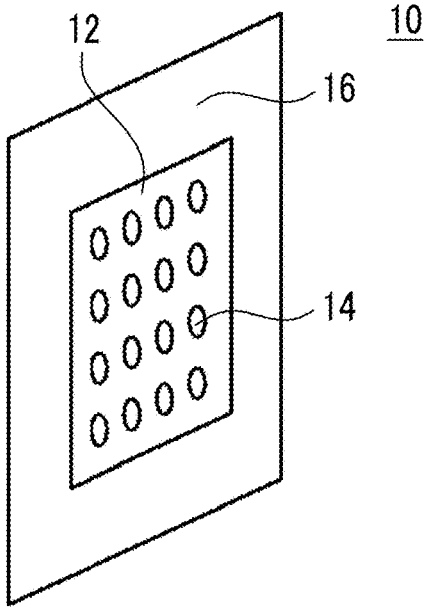
FIG. 1 is a perspective view schematically illustrating an example of a soundproofing structure of the present invention.
Figure 2:
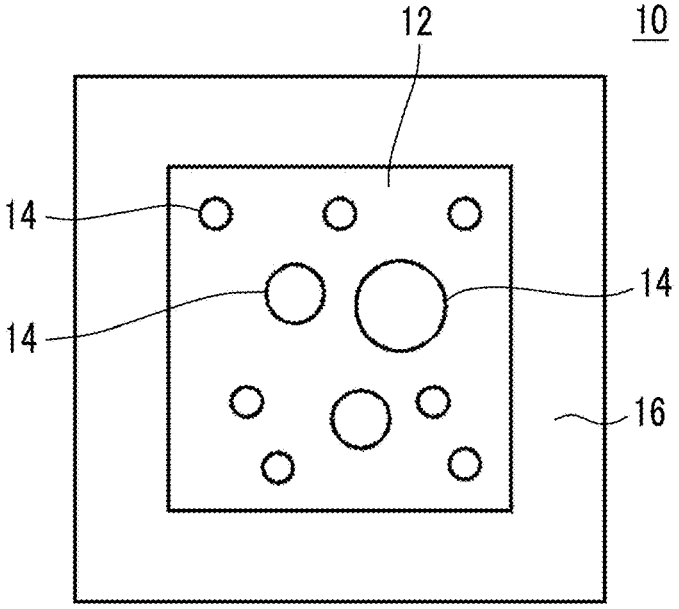
FIG. 2 is a schematic front view illustrating the soundproofing structure of FIG. 1.
Figure 3:
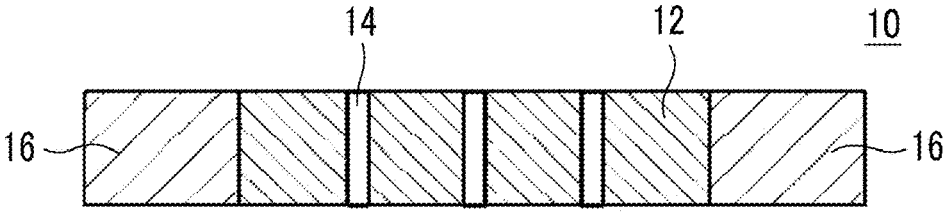
FIG. 3 is a schematic cross-sectional view illustrating the soundproofing structure of FIG. 1.

FIG. 1 is a perspective view schematically illustrating an example of a preferred embodiment of a soundproofing structure of the present invention, FIG. 2 is a schematic front view illustrating the soundproofing structure of FIG. 1, and FIG. 3 is a schematic cross-sectional view illustrating the soundproofing structure.

A soundproofing structure 10 illustrated in FIGS. 1 to 3 is configured to include a plate-like member 12 which has a substantially square shape provided with a plurality of through-holes 14 passing therethrough in the thickness direction; and a frame member 16 which has an opening portion having approximately the same size and the same shape as those of the plate-like member 12 and is configured such that the plate-like member 12 is fitted into the opening portion of the frame member 16 so that the peripheral edge of the plate-like member 12 is fixed to and supported by the frame member 16.

Such a soundproofing structure 10 is used for a copying machine, a blower, an air conditioning machine, a ventilator, pumps, a generator, a duct, industrial equipment, for example, various kinds of manufacturing devices emitting a sound such as a coater, a rotating machine, and a carrier machine, transportation equipment such as an automobile, an electric train, and an aircraft, and general household equipment such as a refrigerator, a washing machine, a dryer, a television, a copier, a microwave, a game machine, an air conditioner, a fan, a personal computer, a vacuum cleaner, an air cleaner, and a ventilator. Further, the soundproofing structure 10 is appropriately disposed at a position through which a sound generated from a noise source passes in various devices.

Figure 4:
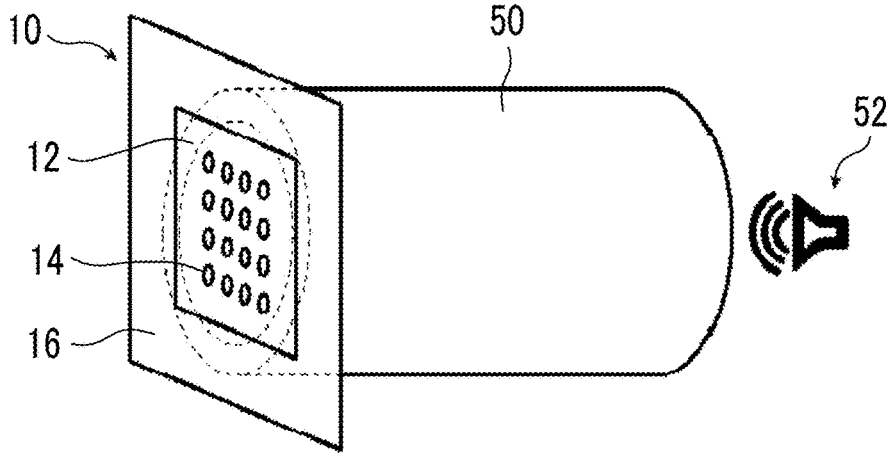
FIG. 4 is a perspective view schematically illustrating an example of a form of utilizing a soundproofing structure of the present invention.

For example, as illustrated in FIG. 4, the soundproofing structure 10 is disposed at an open end of a pipe 50 communicating with a noise source 52 and absorbs a sound generated from the noise source 52.

Figure 5:
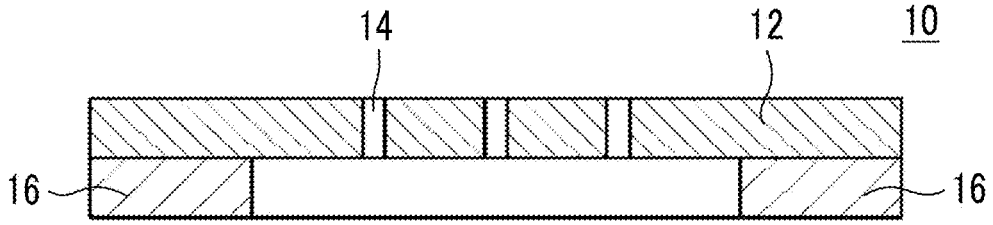
FIG. 5 is a schematic cross-sectional view illustrating another example of a soundproofing structure.

Here, in the examples illustrated in FIGS. 1 to 3, the configuration in which the plate-like member 12 is fitted into the opening portion of the frame member 16 so as to be fixed by the opening portion is employed, but the configuration in which the plate-like member 12 having a larger size than that of the opening portion is fixed to one end surface of the frame member 16 so as to cover the opening portion may be employed as illustrated in FIG. 5.

The frame member 16 is a member used for being formed to surround the opening portion passing therethrough and fixing the plate-like member 12 so as to cover the opening portion and supporting the plate-like member 12 and serves as a node for membrane vibration of the plate-like member 12 fixed to this frame member 16. Therefore, the frame member 16 has higher rigidity than that of the plate-like member 12. Specifically, it is preferable that both of the mass and the rigidity of the frame member 16 per unit area are high.

Further, it is preferable that the frame member 16 has a continuous closed shape which is capable of fixing the plate-like member 12 such that the entire circumference of the plate-like member 12 can be suppressed. However, the present invention is not limited thereto, the frame member 16 may have a shape which is partially disconnected and discontinued as long as the frame member 16 serves as a node for membrane vibration of the plate-like member 12 fixed to the frame member 16. In other words, since the frame member 16 plays a role of fixing and supporting the plate-like member 12 so that the membrane vibration is controlled, the effects are exhibited even in a case where there is a small cut in the frame member 16 or a site which is not slightly bonded may be present.

Further, the cross-sectional shape perpendicular to the penetration direction of the opening portion of the frame member 16 is a square in the example illustrated in FIG. 1. However, the present invention is not particularly limited, and examples thereof include a rectangle, a diamond, and other rectangles such as a parallelogram; a triangle such as an equilateral triangle, an isosceles triangle, or a right triangle; a polygon including a regular polygon such as a regular pentagon or a regular hexagon; an ellipse, and an amorphous shape. In addition, the opening portion of the frame 16 passes through the frame 16 in the thickness direction.

In the description below, the size of the frame member 16 is the size of the opening portion thereof in a plan view. The size of the opening portion in a plan view is defined as the diameter of the opening portion in a cross section perpendicular to the penetration direction of the opening portion, in other words, the opening diameter of the opening portion. Further, in a case where the shape of the cross section perpendicular to the penetration direction of the opening portion is a shape other than a circle, such as a polygon, an ellipse, or an amorphous shape, the size of the opening portion is defined by a circle equivalent diameter. In the present invention, the circle equivalent diameter is a diameter in a case where the shape is converted into a circle having the same area as that of the shape.

The size of the opening portion of such a frame member 16 is not particularly limited, and may be set according to the object to be soundproofed to which the soundproofing structure 10 of the present invention is applied, for example, a copying machine, a blower, an air conditioning machine, a ventilator, pumps, a generator, a duct, industrial equipment, for example, various kinds of manufacturing devices emitting a sound such as a coater, a rotating machine, and a carrier machine, transportation equipment such as an automobile, an electric train, and an aircraft, and general household equipment such as a refrigerator, a washing machine, a dryer, a television, a copier, a microwave, a game machine, an air conditioner, a fan, a personal computer, a vacuum cleaner, and an air cleaner.

As described below, a soundproofing structure including a plurality of unit soundproofing cells, using the soundproofing structure 10 used for fixing the plate-like member 12 to the frame member 16 as the unit soundproofing cell, can be employed. In this manner, the size of the opening portion does not need to be adjusted according to the size of a duct or the like, and a plurality of unit soundproofing cells are collectively arranged on the duct end so as to be used for soundproofing (see FIGS. 10A and 10B).

Further, this soundproofing structure 10 can be used as a partition to block sounds from a plurality of noise sources. Even in this case, the size of the frame member 16 can be selected from the frequencies of the target noise.

Further, in order to obtain the unique vibration mode of the structure formed of the frame member 16 and the plate-like member 12 at a desired frequency, the size of the frame member 16 may be set as appropriate.

In a case where the size of the opening portion is greater than the wavelength, a diffraction phenomenon of the sound due to the size of the opening portion occurs. Meanwhile, in a case where the size of the opening portion is smaller than the wavelength, there is no increase or decrease in sound in a specific direction due to diffraction. Therefore, it is preferable that the size of the frame member 16 (the size of the opening portion) is smaller than a wavelength of a sound which has the maximum wavelength among sounds to be soundproofed.

For example, the size of the frame member 16 (the size of the opening portion) is preferably in a range of 0.5 mm to 300 mm, more preferably in a range of 1 mm to 100 mm, and most preferably in a range of 5 mm to 50 mm.

Further, the frame thickness of the frame member 16 and the thickness (hereinafter, also referred to as the height of the frame member 16) of the opening portion in the penetration direction are not particularly limited as long as the plate-like member 12 can be reliably fixed and supported, but can be set according to the size of the frame member 16.

Figure 40:
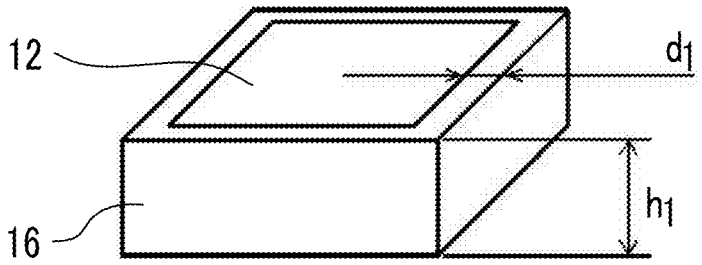
FIG. 40 is a schematic perspective view for describing the shape of a frame.

Here, as illustrated in FIG. 40, the frame thickness of the frame member 16 is a thickness $d_1$ of the thinnest portion in the opening surface of the frame member 16. In addition, the height of the frame member 16 is a height $h_1$ of the opening portion in the penetration direction.

For example, in a case where the size of the frame member 16 is in a range of 0.5 mm to 50 mm, the frame thickness of the frame member 16 is preferably in a range of 0.5 mm to 20 mm, more preferably in a range of 0.7 mm to 10 mm, and most preferably in a range of 1 mm to 5 mm.

In a case where the ratio of the frame thickness of the frame member 16 to the size of the frame member 16 is extremely large, there is a concern that the area ratio of the frame member 16 in the entire area is increased so that the device becomes heavy. On the contrary, in a case where the ratio thereof is extremely small, the plate-like member is unlikely to be strongly fixed by the frame member 16 using an adhesive or the like.

Further, in a case where the size of the frame member 16 is greater than 50 mm and 300 mm or less, the frame thickness of the frame member 16 is preferably in a range of 1 mm to 100 mm, more preferably in a range of 3 mm to 50 mm, and most preferably in a range of 5 mm to 20 mm.

In addition, the height of the frame member 16, that is, the thickness of the opening portion in the penetration direction is preferably in a range of 0.5 mm to 200 mm, more preferably in a range of 0.7 mm to 100 mm, and most preferably in a range of 1 mm to 50 mm.

The material forming the frame member 16 is not particularly limited as long as the frame member 16 is capable of supporting the plate-like member 12, has a suitable strength when applied to the object to be soundproofed, and has resistance to the soundproofing environment of the object to be soundproofed, and the material can be selected according to the object to be soundproofed and the soundproofing environment. Examples of the material of the frame member 16 include various metals such as aluminum, titanium, magnesium, tungsten, iron, steel, chromium, chromium molybdenum, nichrome molybdenum, and alloys of these; resin materials such as an acrylic resin, polymethyl methacrylate, polycarbonate, polyamideimide, polyarylate, polyetherimide, polyacetal, polyether ether ketone, polyphenylene sulfide, polysulfone, polyethylene terephthalate, polybutylene terephthalate, polyimide, triacetyl cellulose, and ABS resins (acrylonitrile, butadiene, and a styrene copolymerized synthetic resin); carbon fiber reinforced plastics (CFRP), carbon fiber, glass fiber reinforced plastics (GFRP).

Further, a plurality of these materials of the frame member 16 may be used in combination.

Figure 41:
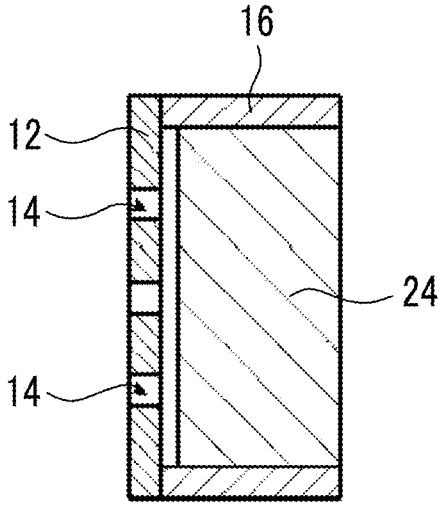
FIG. 41 is a cross-sectional view schematically illustrating another example of a soundproofing structure.

Further, a sound absorbing material 24 may be disposed in the opening portion of the frame member 16 as illustrated in FIG. 41.

By disposing a sound absorbing material, the sound insulation characteristics can be further improved due to the sound absorbing effect from the sound absorbing material.

The sound absorbing material is not particularly limited, and a known sound absorbing material of the related art can be appropriately used. Various known sound absorbing materials, for example, foam materials such as urethane foam, glass wool, and non-woven fabric such as microfibers (THINSULATE, manufactured by 3M Company) can be used.

At this time, in order not to disturb the mechanism for a sound passing through the through-holes and generating the friction, it is desirable that the sound absorbing material is disposed by being separated from the surface of the plate-like member by a distance of 1 mm or greater. Meanwhile, the vibration of the plate-like member can be appropriately suppressed by disposing the sound absorbing material such that a part or the entirety thereof is brought into contact with the plate-like member. In a configuration in which the plate-like member in a case where the average opening ratio is small, the size of the opening portion is small, or the like easily vibrates, the effect of sound absorption caused by the sound passing through the through-holes cannot be sufficiently exhibited due to the extreme vibration of the plate-like member in some cases. On the contrary, both of the effect of sound absorption caused by the sound passing through the through-holes and the effect of the plate vibration can be sufficiently exhibited in a case where the sound absorbing material is disposed by being brought into contact with the plate-like member for the purpose of appropriately suppressing the vibration of the plate-like member.

Since the plate-like member 12 has a plurality of through-holes and is fixed so as to cover the opening portion of the frame member 16 and to be pressed by the frame member 16, the energy of sound waves is absorbed or reflected for soundproofing by the sound passing through the through-holes and allowing the membrane vibration to occur in correspondence with the sound waves from the outside.

Further, the plate-like member 12 has a plurality of through-holes 14 passing therethrough in the thickness direction. The average opening diameter of the plurality of through-holes 14 to be formed in the plate-like member 12 is in a range of 0.1 μm to 250 μm.

A method of fixing the plate-like member 12 to the frame member 16 is not particularly limited as long as the plate-like member 12 can be fixed to the frame member 16, and examples thereof include a method of fixing the member using an adhesive and a method of fixing the member using a physical fixture.

According to the method of fixing the member using an adhesive, the surface (end surface) surrounding the opening of the frame member 16 is coated with an adhesive, the plate-like member 12 is placed thereon, and the plate-like member 12 is fixed to the frame member 16 using the adhesive. Examples of the adhesive include an epoxy-based adhesive (ARALDITE (registered trademark) (manufactured by NICHIBAN CO., LTD.), a cyanoacrylate-based adhesive (Aron Alpha (registered trademark) (manufactured by TOAGOSEI CO., LTD.), and an acrylic adhesive.

As the method of fixing the member using a physical fixture, a method of interposing the plate-like member 12 disposed so as to cover the opening of the frame member 16 between the frame member 16 and a fixing member such as a rod and fixing the fixing member to the frame member 16 using a fixture such as a thread or a screw can be exemplified.

Further, double-sided tape (for example, tape manufactured by Nitto Denko Corporation or tape manufactured by 3M Company) is cut according to the size of the opening portion of the frame member, and then the plate-like member can be fixed thereonto.

Here, as illustrated in FIG. 1 and the like, the soundproofing structure 10 does not have a closed space on one surface side (hereinafter, also referred to as a rear surface) of the plate-like member. In other words, the soundproofing structure 10 does not use the principle in which the connection between an air layer inside a through-hole and an air layer inside a closed space is allowed to function as a mass spring to cause resonance for sound absorption.

As described above, in the configuration which is obtained by providing a closed space on one surface side (the rear surface) of the plate-like member in which a plurality of through-holes have been formed and in which a sound is absorbed using the Helmholtz resonance, a shielding plate that does not allow a sound to pass through the rear surface of the plate-like member becomes indispensable in order to prepare a closed space. Further, as a principle, a frequency band which is capable of sound absorption since the resonance is used is narrow, and the band is difficult to widen.

In order to solve such a problem, it has been attempt to provide a plurality of holes in the thickness direction or the horizontal direction or provide a plurality of holes in the closed space on the rear surface, but there are problems of an increase in size of the holes because a plurality of cells need to be provided, complication of the structures or components because these need to be formed separately, and an increase in number of components.

Further, since a closed space is required to be provided on the rear surface, there is a problem in that the size of the volume of the closed space is increased. Particularly, the size of the volume needs to be increased because there is a necessity to increase the volume of the air layer of the closed space in order to absorb a low-frequency sound.

Further, since a closed space is required to be provided on the rear surface, there is a problem in that the ventilation properties or waste heat cannot be ensured.

In a soundproofing structure having through-holes without a closed space, a structure with the performance as close to the sound insulation performance of the original sheet as possible is ensured even in a case where the through-holes are opened by devising the structures around the through-holes has been suggested, but there are problems in that higher soundproofing performance cannot be obtained and a sound cannot be satisfactorily absorbed because the sound is reflected.

Under the above-described circumstances, the present inventors found that the sound absorbing effect can be obtained without a closed space on the rear side by providing a soundproofing structure including a plate-like member which has a plurality of through-holes passing therethrough in a thickness direction; and a frame member which includes an opening portion, in which membrane vibration of the plate-like member is enabled by fixing the plate-like member to a peripheral edge of the opening portion of the frame member, the average opening diameter of the through-holes is in a range of 0.1 μm to 250 μm, and the first unique vibration frequency of the membrane vibration of the plate-like member is present in a range of 10 Hz to 100000 Hz.

According to the examination conducted by the present inventors, it is considered that, since a plate-like member and through-holes are present in the configuration of the present invention, a sound is transmitted by passing through any of these two kinds of paths. The path (route) passing through the plate-like member is a path where solid vibration which has been once converted into membrane vibration of the plate-like member is re-radiated as a sound wave, and the path passing through a through-hole is a path directly passing through the through-hole as a gas propagation sound. In addition, the path passing through the through-hole is considered to be dominant as the absorption mechanism at this time.

It was speculated that the mechanism for the sound absorption in the path passing through the through-hole is a change from the sound energy to the thermal energy due to the friction between the air and the inner wall surface of each through-hole at the time of the sound passing through the fine through-holes. Since this mechanism is operated in a case where the size of the through-hole is small, this mechanism is different from the mechanism of sound absorption using the resonance. A path of each through-hole through which the sound in the air directly passes has an extremely small impedance compared to a path that is radiated as a sound again after being converted into membrane vibration. Therefore, the sound easily passes through the path of the through-holes finer than the membrane vibration. At the time of passing through these through-holes, the sound passes therethrough after being concentrated on a narrow area of the through-holes from a wide area on the entire plate-like member. Since the sound is collected in the through-holes, the local speed becomes extremely high. The friction inside the fine through-holes is increased and converted into heat in order to correlate with the speed.

In a case where the average opening diameter of the through-holes is small, it is considered that the friction occurring on the inner wall surface or an edge portion of each through-hole can be increased because the ratio of the length of the edge of the opening portion to the opening area is increased. By increasing the friction at the time of the sound passing through the through-holes, the sound energy is converted into the thermal energy so that the sound can be more efficiently absorbed.

Further, since sound absorption occurs due to the friction at the time of the sound passing through the through-holes, the sound can be absorbed in a broadband regardless of the frequency band of the sound.

Here, there is a region where the sound insulation amount is determined by the rigidity of the plate on a lower frequency side than the first unique vibration frequency of the membrane vibration, and this is referred to as a rigidity law.

At this time, the present inventors found that the sound absorption effect can be greatly obtained by the effect of the through-holes regardless of the fact that the sound insulation amount is determined by the rigidity of the plate on a lower frequency side than the first unique vibration frequency of the membrane vibration in this rigidity law.

In the rigidity law, a motion controlled by a spring equation in which a film moved by being attached to a frame member is pulled from an end portion is greater than a motion controlled by a motion equation in which a film (plate-like member) pushed by a sound wave. In this rigidity law, an effect of increasing the tension by the film being pulled from the frame member is exhibited. Accordingly, there is an effect that the apparent hardness of the film is markedly increased compared to the Young's modulus of the actual film.

Typically, a force for shaking the film is increased in a low-frequency region so that the membrane vibration is increased. In the configuration of the present invention, a rigidity law region is prepared on a lower frequency side than the first unique vibration frequency by setting the first unique vibration frequency of the membrane vibration of the plate-like member to be in a range of 10 Hz to 100000 Hz so that the apparent hardness of the film is increased and the membrane vibration is not increased even in a low-frequency region. At this time, since the film is not vibrated much even in a low-frequency region, sound waves frequently pass through fine through-holes. Due to this effect of fine through-holes, frictional heat is generated, and thus a wide range of sounds on a low-frequency side can be absorbed.

Since the membrane vibration is not so large from the beginning in a high-frequency region and sound waves pass through through-holes, sound absorption due to friction between the sound waves and fine through-holes becomes dominant even in the high-frequency region.

As described above, in the present invention, in addition to the absorption characteristics of the high-frequency region which is the original function of fine through-holes, the rigidity law region is prepared by attaching a frame to obtain a structure in which the sound absorption effect due to the friction between the sound waves and fine through-holes is exhibited even in a low-frequency region while the sound absorption effect due to the friction in fine through-holes in a high-frequency region remains.

The first unique vibration frequency in the structure formed of the frame member 16 and the plate-like member 12, that is, the first unique vibration frequency of the plate-like member 12 fixed so as to be suppressed by the frame member 16 is a frequency in a unique vibration mode, at which sound waves cause membrane vibration to the highest degree using the resonance phenomenon and the sound waves are largely transmitted at that frequency. In the present invention, the present inventors found that the first unique vibration frequency has the substantially the same value regardless of the presence or absence of the through-holes 14 to be perforated to the plate-like member 12 because the first unique vibration frequency is determined by the structure formed of the frame member 16 and the plate-like member 12.

Further, since the membrane vibration is increased at frequencies in the vicinity of the first unique vibration frequency, the sound absorption effect due to the friction between sound waves and fine through-holes is reduced. Therefore, in the soundproofing structure of the present invention, the absorbance is minimized at a frequency of the first unique vibration frequency±100 Hz.

Further, from the viewpoints of the sound absorption performance in a low-frequency region and the sensitivity of the sensitivity of human ears, the first unique vibration frequency of the membrane vibration of the plate-like member is preferably in a range of 20 Hz to 20000 Hz and more preferably in a range of 50 Hz to 15000 Hz.

Here, as a reference example, in the configuration in which an aluminum film having a thickness of 20 μm is fixed to a frame member having an opening portion in a square shape, the first resonance frequency of membrane vibration of each configuration in a case where the size of the opening portion is changed into various values is listed in Table 1.

TABLE 1

| Length of one side of opening portion (m) | First resonance frequency (Hz) |
|---|---|
| 0.0015 | 90749 |
| 0.002 | 51046 |
| 0.003 | 22687 |
| 0.005 | 8167 |
| 0.01 | 2042 |
| 0.015 | 907 |

TABLE 1-continued

| Length of one side of opening portion (m) | First resonance frequency (Hz) |
|---|---|
| 0.02 | 510 |
| 0.025 | 327 |
| 0.05 | 82 |

As listed in Table 1, it was found that the first resonance frequency of membrane vibration can be adjusted by changing the length of one side of the opening portion, that is, the size of the opening portion. Further, it was found that the first resonance frequency of membrane vibration can be increased by reducing the size of the frame member. It was found that the size of the opening portion is preferably small from the viewpoint of increasing the sound absorption effect using through-holes by preparing a rigidity law region on a lower frequency side than the first unique vibration frequency.

Further, as a frame member with a small size of an opening portion, a so-called mesh structure (such as metal mesh or plastic mesh) or a honeycomb structure (such as an aluminum honeycomb panel or a paper honeycomb core) can be used.

Here, the soundproofing structure of the present invention does not require a closed space on the rear surface of the plate-like member as described above, and thus the size thereof can be reduced.

Further, since a closed space is not provided on the rear surface, the ventilation properties can be ensured.

Further, since the through-holes are present, light can be transmitted while being scattered.

Further, since the soundproofing structure can function by forming fine through-holes, the degree of freedom for selecting the material is high and problems of the contamination of the surrounding environment and the performance of environmental resistance are small.

In addition, even in a case where a liquid such as water adheres to the plate-like member, water avoids the through-hole portions due to the surface tension so that the through-holes are not blocked because the plate-like member has fine through-holes, the sound absorption performance is unlikely to be degraded.

Further, since the plate-like member used in the present invention is thin and a plurality of fine through-holes are formed therein, the plate-like member is likely to be damaged. However, by reducing the size of the opening portion of the frame member, the plate-like member is unlikely to be touched by a finger, and thus damage to the plate-like member can be suppressed.

According to the examination of the present inventors, it was found that an optimum ratio for the average opening ratio of the through-holes is present and the absorbance is increased as the average opening ratio is decreased particularly in a case where the average opening diameter is approximately 50 μm or greater, which is relatively large. While the sound passes through each of the plurality of through-holes in a case where the average opening ratio is large, the amount of the sound passing through one through-hole becomes large since the number of through-holes is reduced in a case where the average opening ratio is small, the local speed of the air at the time of passing through the through-holes is further increased, and thus the friction occurring on the inner wall surface or an edge portion of each through-hole can be increased.

From the viewpoint of the sound absorption performance, the upper limit of the average opening diameter of the through-holes is preferably 100 μm or less, more preferably 80 μm or less, still more preferably 70 μm or less, particularly preferably 50 μm or less, and most preferably 30 μm or less. The reason for this is that the friction is likely to occur because the ratio of the length of the edge of through-holes contributing to the friction among the through-holes to the opening area of the through-holes is increased as the average opening diameter of the through-holes is decreased.

The lower limit of the average opening diameter is preferably 0.5 μm or greater, more preferably 1 μm or greater, and still more preferably 2 μm or greater. In a case where the average opening diameter is extremely small, the viscous resistance is extremely high at the time of the sound passing through the through-holes, and thus the sound cannot sufficiently pass through the through-holes. Therefore, the sound absorbing effect cannot be sufficiently obtained even in a case where the opening ratio is increased.

The average opening ratio of the through-holes may be appropriately set according to the average opening diameter and the like, but is preferably 2% or greater, more preferably 3% or greater, and still more preferably 5% or greater from the viewpoint of the sound absorption performance and the ventilation properties. In a case where the ventilation properties and the waste heat properties are further important, the average opening ratio thereof is preferably 10% or greater.

Based on the examples and the simulation results described below, it is preferable that the average opening ratio of the through-holes is small in a case where the average opening diameter of the through-holes is large. Further, the average opening ratio of the through-holes is preferably 5% or greater in a case where the average opening diameter of the through-holes is 20 μm or less.

The average opening diameter of the through-holes is obtained by imaging one surface of the plate-like member at a magnification of 200 times using a high-resolution scanning electron microscope (SEM) from one surface of the plate-like member, twenty through-holes whose surroundings are connected in a ring shape are extracted from the obtained SEM photo, the opening diameters are read, and an average value of these obtained values is calculated as an average opening diameter. In a case where the number of through-holes is less than 20 in one SEM photo, other surrounding positions are imaged to obtain other SEM photos until the number of through-holes becomes 20.

Further, after the areas of the through-hole portions are respectively measured, the through-holes are replaced with circles having the same areas as those of the through-holes, and the opening diameter is evaluated using the diameter (circle equivalent diameter) of a circle at the time of replacement. In other words, since the shape of the opening portion of a through-hole is not limited to a substantially circular shape, in a case where the shape of the opening portion is a non-circular shape, the opening diameter is evaluated with the diameter of a circle having the same area as the through-hole. Therefore, in a case of through-holes having a shape in which two or more through-holes are integrated, these through-holes are regarded as one through-hole and the circle equivalent diameter of the through-holes is set as the opening diameter.

Through this process, all the circle equivalent diameter, the opening ratio, and the like can be calculated by "Analyze Particles" using, for example, "Image J" (https://imagej.nih-.gov/ij/).

Further, the average opening ratio is obtained by imaging the surface of the plate-like member from directly above at a magnification of 200 times using a high-resolution scanning electron microscope (SEM), binarizing the visual fields (five sites) having a size of 30 mm×30 mm of the obtained SEM photo using image analysis software or the like to observe through-hole portions and non-through-hole portions, calculating the ratio (opening area/geometric area) from the total opening area of the through-holes and the area (geometric area) of the visual fields, and setting the average value in each visual field (5 sites) as an average opening ratio.

Here, in the soundproofing structure of the present invention, a plurality of through-holes may be regularly arranged or randomly arranged. From the viewpoints of the productivity of fine through-holes, robustness of sound absorption characteristics, and suppression of sound diffraction, it is preferable that the through-holes are randomly arranged. Further, the robustness of the sound absorption characteristics indicates that the sound absorption characteristics are unlikely to be changed in a case where unevenness occurs in the arrangement, the opening diameter, or the like at the time of preparation or production. Particularly, it is preferable that the arrangement is set to be random from the beginning from the viewpoint that the sound absorption characteristics are not affected by the unevenness in arrangement.

In regard to sound diffraction, a sound diffraction phenomenon occurs according to the cycle of through-holes in a case where the through-holes are periodically arranged, and there is a concern that the sound is bent due to the diffraction and the direction in which the noise advances is divided into a plurality of directions. The random arrangement indicates arrangement which does not have periodicity such as perfect alignment and in which the sound absorbing effect from each through-hole is exhibited and the diffraction phenomenon due to a minimum distance between through-holes does not occur.

Further, samples are also prepared by performing an etching treatment during a continuous treatment in a roll shape in the examples of the present invention. However, since mass production can be more easily made by performing a surface treatment or the like to form a random pattern at once rather than the process of preparing a periodic arrangement, it is preferable that the through-holes are randomly arranged from the viewpoint of the productivity.

In the present invention, random arrangement of through-holes is defined as follows.

Strongly diffracted light appears in a case of a perfectly periodic structure. Further, even in a case where only a small part of the periodic structure has a different position, diffracted light appears due to the remaining structure. Since diffracted light is a wave formed by superimposing scattered light from basic cells of the periodic structure, the mechanism for diffracted light is that the diffracted light is generated by interference of the remaining structure even in a case where only some basic cells are disturbed.

Therefore, as the number of basic cells disturbed from the periodic structure is increased, the intensity of the scattered light that interferes such that the diffracted light intensifies each other is decreased, and thus the intensity of diffracted light is decreased.

In the present invention, the term "random" indicates a state in which at least 10% of through-holes from among all through-holes are deviated from the periodic structure. Based on the description above, since it is desirable that the number of basic cells deviated from the periodic structure is increased in order to suppress diffracted light, a structure in which 50% of through-holes from among all through-holes are deviated is preferable, a structure in which 80% of through-holes from among all through-holes are deviated is more preferable, and a structure in which 90% of through-holes from among all through-holes are deviated is still more preferable.

As a verification of the deviation, it is possible to perform analysis on an image having 5 or more through-holes. As the number of through-holes is increased, the analysis can be performed with higher precision. An image in which the positions of a plurality of through-holes can be recognized using an optical microscope, an SEM, or the like can be used.

In a captured image, by focusing on one through-hole, the distances of the through-hole and other through-holes around the through-hole are measured. The nearest distance is set as a1, the second nearest distance is set as a2, the third nearest distance is set as a3, and the fourth nearest distance is set as a4. At this time, in a case where two or more distances from among a1 to a4 match to one another (for example, the matched distance is set as b1), the through-holes can be determined as holes having a periodic structure with respect to the distance b1. Meanwhile, in a case where any distances from among a1 to a4 do not match to each other, the through-holes can be determined as through-holes deviated from the periodic structure. This operation is performed on all through-holes on an image for determination.

Here, in a case where the hole diameter of the focused through-hole is set as Φ, up to the deviation by Φ is set to be included in the range of the above-described "match". In other words, in a relationship of "$a2-\Phi<a1<a2+\Phi$", a2 and a1 are set to match to each other. This is because scattering is considered to occur in a range of the hole diameter Φ because scattered light from each through-hole is considered as diffracted light.

Next, for example, the number of "through-holes having a periodic structure with respect to the distance b1" is counted and the ratio of the number of the through-holes to the number of all through-holes on an image is acquired. In a case where the ratio is set as c1, the ratio c1 is a ratio of the through-holes having a periodic structure, and 1−c1 is a ratio of the through-holes deviated from the periodic structure, and 1−c1 is a numerical value determining the above-described "random". In a case where a plurality of distances, for example, "through-holes having a periodic structure with respect to the distance b1" and "through-holes having a periodic structure with respect to a distance b2" are present, b1 and b2 are separately counted. In a case where the ratio of the periodic structure with respect to the distance b1 is set as c1 and the ratio of the periodic structure with respect to the distance b2 is set as c2 and in a case where both of (1−c1) and (1−c2) satisfy 10% or greater, the structures thereof are determined as "random" structures.

Further, in a case where any of (1−c1) and (1−c2) is less than 10%, the structure has a periodic structure and is not "random". In this manner, in a case where the condition for being "random" is satisfied with respect to any of the ratios c1, c2, . . . , the structure thereof is defined as "random".

Further, a plurality of through-holes may be formed of through-holes having one opening diameter or formed of through-holes having two or more opening diameters. From the viewpoints of the productivity and the durability, it is preferable that the plurality of through-holes are formed of through-holes having two or more opening diameters.

In terms of the productivity, similar to the random arrangement, the productivity is improved in a case where the opening diameter is allowed to vary from the viewpoint of performing a large number of etching treatments. From the viewpoint of the durability, since the size of dust or dirt varies depending on the environment, in a case where the through-holes are formed of through-holes having one opening diameter and the size of main dirt approximately matches the size of each through-hole, all through-holes are affected by the dirt. Therefore, a device which can be used in various environments can be obtained by providing through-holes with a plurality of different opening diameters.

According to the production method of WO2016/060037A or the like, it is possible to form a through-hole in which the hole diameter is increased and which has a maximum diameter therein. Due to this shape, dirt (dust, a toner, non-woven fabric, or a foam which becomes separated) having an approximately same size as that of a through-hole is unlikely to be clogged inside of the through-hole and the durability of the film having the through-hole is improved.

Dirt having a larger diameter than the diameter of the outermost surface of a through-hole cannot enter the inside of the through-hole, and dirt having a smaller diameter than the diameter thereof can pass through the through-hole since the diameter of the inside of the through-hole is increased.

In consideration of the opposite shape in which the inside of a through-hole has a smaller diameter than the diameter of the surface thereof, dirt having passed through the outermost surface of the through-hole is clogged at a portion inside having a smaller diameter, and thus the dirt is likely to remain therein. Compared to this, it was found that the shape in which the inside has a maximum diameter functions advantageously from the viewpoint of suppressing clogging of dirt.

Further, in a case of a so-called tapered shape, any one surface of a film has a maximum diameter and the inner diameter decreases substantially monotonically, in a case where dirt satisfying the relationship of "the maximum diameter>the size of dirt>the diameter of the other surface" enters from a side having a maximum diameter, the shape of the inside functions as a slope, and thus the possibility of the dirt being clogged therein becomes increased.

Figure 12:
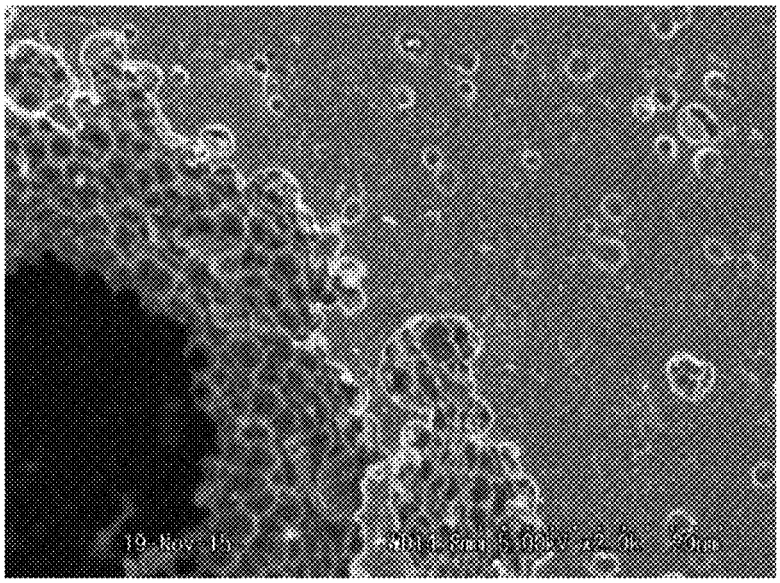
FIG. 12 is an image obtained by imaging an inner wall surface of a through-hole.

From the viewpoint of further increasing the friction at the time of the sound passing through the through-holes, it is preferable that the inner wall surface of a through-hole is roughened (see FIG. 12). Specifically, the surface roughness Ra of the inner wall surface of a through-hole is preferably 0.1 μm or greater, more preferably in a range of 0.1 μm to 10.0 μm, still more preferably in a range of 0.15 μm to 1.0 μm, and particularly preferably in a range of 0.2 μm to 1.0 μm.

Here, the surface roughness Ra can be obtained by measuring the inside of a through-hole using an atomic force microscope (AFM). As the AFM, for example, SPA300 (manufactured by High-Tech Science Corporation) can be used. The measurement can be performed using OMCL-AC200TS as a cantilever in a dynamic force mode (DFM). Since the surface roughness of the inner wall surface of a through-hole is approximately several microns, it is preferable to use an AFM from the viewpoints of the measurement range of several microns and the precision.

Further, FIG. 12 is an SEM photo obtained by imaging the sample of Example 1 described below.

Further, by regarding each projection of a depression in a through-hole from the SEM image showing the inside of a through-hole as a particle, the average particle diameter of projections can be calculated.

Specifically, an SEM image captured at a magnification of 2000 times is taken in Image J, binarized into white and black so that the projections are shown as white to acquire the area of each projection using Analyze Particles. By assuming circles with the same areas as the areas of the projections to acquire the circle equivalent diameter of each projection, an average value of the obtained values is calculated as an average particle diameter. The imaging range of this SEM image is approximately 100 μm×100 μm.

For example, the particle diameters of Example 1 described below are distributed approximately in a range of 1 to 3 μm, and the average is approximately 2 μm. The average particle diameter of projections is preferably in a range of 0.1 μm to 10.0 μm and more preferably in a range of 0.15 μm to 5.0 μm.

In the simulation results described below, the speed inside a through-hole is calculated after calculation through the simulation desired to correspond to Example 1. The speed inside a through-hole is $5\times10^{-2}$ (m/s) in a case where the sound pressure is 1 [Pa] (=94 dB) and the speed therein is $1\times10^{-3}$ (m/s) in a case where the sound pressure is 60 dB.

At the time of absorption of a sound at a frequency of 2500 Hz, the local moving speed of a medium that mediates sound waves is known based on the local speed. Based on this, the movement distance is acquired by assuming that particles of through-holes vibrate in the penetration direction. Since the sound vibrates, the distance amplitude thereof becomes the distance at which the sound can move within half a circle. At a frequency of 2500 Hz, since one cycle is $1/2500$ seconds, half the time can be the same direction. The maximum movement distance (acoustic movement distance) at the sound wave half cycle acquired from the local speed is 10 μm at 94 dB and 0.2 μm at 60 dB. Accordingly, since the friction increases in a case where the inner wall surface has the surface roughness to the extent of this acoustic movement distance, the above-described range of the surface roughness Ra and the above-described range of the average particle diameter of the projections are preferable.

Here, in a case where the average opening diameter of the through-holes is 0.1 μm or greater and less than 100 μm and in a case where the average opening diameter is set as phi (μm) and the thickness of the plate-like member is set as t (μm), it is preferable that the average opening ratio rho of the through-holes falls in a range where a center is $rho_center=(2+0.25\times t)\times phi^{-1.6}$, a lower limit is $rho_center-(0.085\times(phi/20)^{-2})$, and an upper limit is $rho_center+(0.35\times(phi/20)^{-2})$. Further, the average opening ratio rho is more preferably in a range of $(rho_center-0.24\times(phi/10)^{-2})$ to $(rho_center+0.57\times(phi/10)^{-2})$ and still more preferably in a range of $(rho_center-0.185\times(phi/10)^{-2})$ to $(rho_center+0.34\times(phi/10)^{-2})$. This point will be described in detail based on the following simulation.

Further, in a case where the average opening diameter of the through-holes is in a range of 100 μm to 250 μm, the average opening ratio of the through-holes is preferably in a range of 0.5% to 1.0%. This point will be described in detail based on the following examples.

Further, in the formula of the above-described average opening ratio rho, the average opening ratio rho is expressed not by a percentage but by a ratio (opening area/geometric area).

Here, from the viewpoint of the visibility of through-holes, the average opening diameter of a plurality of through-holes forming the plate-like member is preferably 100 μm or less, more preferably 50 μm or less, and still more preferably 20 μm or less.

In a case where the plate-like member having fine through-holes used for the soundproofing structure of the present invention is disposed on a surface of a wall or a place which can be seen, the designability is degraded because the through-holes are seen and the appearance of holes makes people uneasy, and thus it is desirable that through-holes are not seen. It is a problem to see through-holes in various places such as a soundproofing wall inside a room, an articulation wall, a soundproofing panel, an articulation panel, and an exterior portion of a machine.

First, the visibility of one through-hole will be examined.

Hereinafter, a case where the resolving power of the human eye is a visual acuity 1 will be described.

Figure 42:
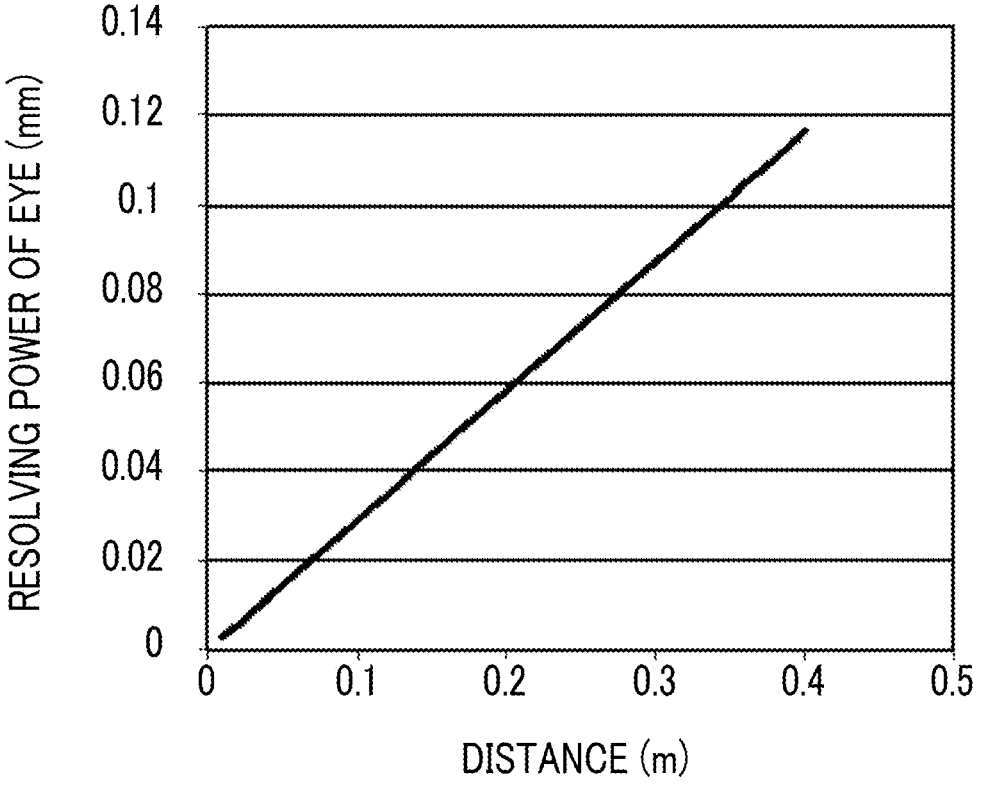
FIG. 42 is a graph showing the relationship between the distance and the resolving power of the eye.

The definition of the visual acuity 1 is that an object is seen by resolving 1 arc minute. This indicates that an opening diameter of 87 μm can be resolved at a distance of 30 cm. The relationship between the distance and the resolving power in a case of the visual acuity 1 is shown in FIG. 42.

Whether the through-holes are seen is strongly related to the above-described visual acuity. As in a case of the visual acuity test performed based on the recognition of a gap portion of the Landolt ring, whether a gap between two points and/or two lines is seen depends on the resolving power. In other words, it is difficult to see a through-hole having an opening diameter less than the resolving power of the eye because the distance between edges of a through-hole cannot be resolved by the eye. Meanwhile, the shape of a through-hole having an opening diameter greater than or equal to the resolving power of the eye can be seen.

In a case of the visual acuity 1, a through-hole having an opening diameter of 100 μm can be resolved from a distance of 35 cm, but a through-hole having an opening diameter of 50 μm and a through-hole having an opening diameter of 20 μm cannot be resolved by the eye unless approaching a distance of 18 cm and a distance of 7 cm respectively. Accordingly, in a case of a through-hole having an opening diameter of 100 μm, the through-hole can be seen and made people feel uneasy. However, by using a through-hole having an opening diameter 20 μm, the through-hole cannot be seen unless approaching a ⅕ distance which is extremely close. Therefore, it is advantageous that the opening diameter becomes smaller from the viewpoint of the concealment of through-holes. The distance between a soundproofing structure and an observer is usually several tens of centimeters in a case where the soundproofing structure is used on a wall or in a car, the boundary of the opening diameter in this case is approximately 100 μm.

Next, light scattering occurring due to through-holes will be described. Since the wavelength of visible light is approximately in a range of 400 nm to 800 nm (0.4 μm to 0.8 μm), the opening diameter of several tens of micrometers described in the present invention is sufficiently larger than the optical wavelength. In this case, the scattering cross-sectional area (the amount indicating that how strongly an object is scattered, the unit is the area) in visible light substantially coincides with the geometric cross-sectional area, that is, the cross-sectional area of a through-hole in this case. In other words, the size of scattering of visible light is proportional to the square of the radius of a through-hole (half of the circle equivalent diameter). Accordingly, as the size of the through-hole becomes larger, the intensity of light scattering is increased by the square of the radius of the through-hole. Since the visibility of a single through-hole is proportional to the amount of light to be scattered, the visibility is increased in a case where each through-hole is large even in a case where the average opening ratio is the same.

Finally, a difference between a periodic arrangement and a random arrangement in which the arrangement of through-holes does not have periodicity will be examined. In the periodic arrangement, a light diffraction phenomenon occurs according to the cycle. In a case where white light to be transmitted, white light to be reflected, or light with a wide spectrum comes into contact with the arrangement, the light is seen to have different colors so that the pattern becomes conspicuous for various reasons, for example, the light is diffracted and is seen to have different colors like a rainbow, the light is strongly reflected at a specific angle, or the like. In the example described below, a plurality of through-holes are periodically formed with respect to nickel, but the spreading of colors due to diffracted light can be seen in a case where this nickel film is seen through using fluorescent light.

Meanwhile, the above-described diffraction phenomenon does not occur in a case where the through-holes are randomly arranged. It was confirmed that color change due to diffracted light is not seen in all aluminum films, prepared in the following example, in which fine through-holes have been formed, even in a case where the films are seen through using fluorescent light. Further, it was confirmed that the appearance has the same metallic gloss as typical aluminum foil even in a case of viewing the film by preparing the through-holes in a reflection arrangement and diffraction reflection does not occur.

In addition, the thickness of the plate-like member may be appropriately set in order to obtain the unique vibration mode of the structure formed of the frame member 16 and the plate-like member 12 at a desired frequency. Further, it is considered that the sound absorption performance is further improved due to an increase in friction energy at the time of the sound passing through the through-holes as the thickness of the plate-like member is larger. Further, in a case where the thickness of the plate-like member is extremely thin, since the plate is difficult to handle, it is preferable that the plate-like member is thick enough to be held. In addition, from the viewpoints of miniaturization, ventilation properties, and the light transmittance, it is preferable that the plate-like member is thin. In a case where etching or the like is used as the method of forming through-holes, since it takes time to prepare the plate-like member as the thickness thereof is increased, it is desirable that the plate-like member is thin from the viewpoint of productivity.

From the viewpoints of the sound absorption performance, the miniaturization, the ventilation properties, and the light transmittance, the thickness of the plate-like member is preferably in a range of 5 μm to 500 μm, more preferably in a range of 10 μm to 300 μm, and particularly preferably in a range of 20 μm to 100 μm.

The material of the plate-like member may be appropriately set to obtain a unit vibration mode of a structure formed of a frame member and a plate-like member at a desired frequency. Specific examples of the material which can be used include various metals such as aluminum, titanium, nickel, permalloy, 42 alloy, kovar, nichrome, copper, beryllium, phosphor bronze, brass, nickel silver, tin, zinc, iron, tantalum, niobium, molybdenum, zirconium, gold, silver, platinum, palladium, steel, tungsten, lead, and iridium; and resin materials such as polyethylene terephthalate (PET), triacetyl cellulose (TAC), polyvinylidene chloride, polyethylene, polyvinyl chloride, polymethylpentene, a cycloolefin polymer (COP), polycarbonate, ZEONOA, polyethylene naphthalate (PEN), polypropylene, and polyimide. Further, other examples thereof include glass materials such as thin film glass; and fiber reinforced plastic materials such as carbon fiber reinforced plastics (CFRP) and glass fiber reinforced plastics (GFRP).

Since the membrane vibration occurs at the first unique vibration frequency in the soundproofing structure of the present invention, it is preferable that the plate-like member is unlikely to be broken due to the vibration. Further, it is preferable that a material which has a high spring constant, does not allow the displacement of vibration to increase, and has a high Young's modulus is used for the plate-like member in order for sound absorption due to the friction in fine through-holes to occur. From these viewpoints, it is preferable to use metallic materials. Among these, from the viewpoints of being lightweight, easily forming fine through-holes through etching or the like, availability, and the cost, it is preferable to use aluminum.

In a case where a metallic material is used, from the viewpoint of suppressing rust, metal plating may be applied to the surface.

Further, by applying metal plating to at least the inner surface of a through-hole, the diameter of the through-hole may be adjusted to be in a range smaller than the average opening diameter.

By using a material, which has a conductivity and is not charged, such as a metallic material as the material of the plate-like member, it is possible to suppress degradation of sound absorption performance due to clogging of dust, dirt, and the like in the through-holes of the plate-like member without attraction of fine dust, dirt, and the like to the plate-like member due to static electricity.

Further, the heat resistance can be increased by using a metallic material as the material of the plate-like member. In addition, ozone resistance can be increased.

By using a metallic material as the material of the plate-like member, the metallic material functions as a heat insulating material that prevents heat transfer due to radiant heat because the metallic material has a large reflectivity with respect to radiant heat due to far infrared rays. At this time, a plurality of through-holes are formed in the plate-like member, but the opening diameter of the through-holes is small. Therefore, the plate-like member functions as a reflective film.

It is known that a structure in which a plurality of fine through-holes are formed in a metal functions as a high pass filter of a frequency. For example, a window with metal mesh of a microwave oven has a property of blocking microwaves used for a microwave oven while passing high-frequency visible light therethrough. In a case where the hole diameter of a through-hole is set as $\Phi$ and the wavelength of an electromagnetic wave is set as $\lambda$, the window functions as a filter that does not allow a long wavelength component satisfying a relationship of "$\Phi<\lambda$" to pass through and allows a short wavelength component satisfying a relationship of "$\Phi>\lambda$" to pass through.

Here, the radiant heat is described. The radiant heat is a heat transfer mechanism in which far infrared rays are emitted from an object according to an object temperature and the emitted rays are transmitted to another object. According to the Wien's radiation law, it is known that the radiant heat in an environment at room temperature is distributed about $\lambda=10$ μm and contributes to effectively transferring heat through radiation up to a wavelength (up to 30 μm) three times the wavelength on the long wavelength side. In consideration of the relationship between the hole diameter $\Phi$ and the wavelength $\lambda$ of the high pass filter, a component satisfying a relationship of "$\lambda>20$ μm" is strongly shielded in a case of $\Phi=20$ μm. Further, in a case of $\Phi=50$ μm, the radiant heat propagates after passing through the through-holes because the relationship of "$\Phi>\lambda$" is satisfied. In other words, it is found that the propagation performance of radiant heat greatly varies depending on a difference in hole diameter $\Phi$ since the hole diameter $\Phi$ is several tens of micrometers, and the structure functions well as a radiant heat cut filter as the hole diameter $\Phi$, that is, the average opening diameter becomes smaller. Accordingly, from the viewpoint of functioning as a heat insulating material that prevents heat transfer due to radiant heat, the average opening diameter of the through-holes to be formed in the plate-like member is preferably 20 μm or less.

In a case where the entire soundproofing structure is required to have transparency, a resin material or a glass material that is capable of making the structure transparent can be used. For example, among resin materials, since a PET film has a relatively high Young's modulus, is available, and has high transparency, a suitable soundproofing structure can be obtained by forming through-holes using this material.

Further, the durability of the plate-like member can be improved by appropriately performing a surface treatment (such as a plating treatment, an oxide film treatment, or surface coating (fluorine or ceramic)) on the plate-like member according to the material thereof. For example, in a case where aluminum is used as the material of the plate-like member, an oxide film can be formed on the surface of the plate-like member by performing an alumite treatment (an anodic oxidation treatment) or a boehmite treatment thereon. The corrosion resistance, the abrasion resistance, and the scratch resistance can be improved by forming an oxide film on the surface thereof. Further, the color resulting from optical interference can be adjusted by adjusting the treatment time to adjust the thickness of the oxide film.

Further, the plate-like member can be colored, decorated, and designed. As methods of performing these, methods may be appropriately selected depending on the material of the plate-like member or the state of the surface treatment. For example, printing or the like according to an ink jet method can be used. Further, in a case where aluminum is used as the material of the plate-like member, coloring with high durability can be performed by carrying out a color alumite treatment. The color alumite treatment is a treatment of performing an alumite treatment on the surface, permeating a dye thereinto, and performing a sealing treatment on the surface. In this manner, a plate-like member with high designability in which the presence of metallic gloss or the color can be designed can be obtained. Further, by performing the alumite treatment after the through-holes are formed, an anodic oxide film is formed only on the aluminum portion, a dye covers the through-holes so that decoration can be performed without degrading the sound absorption characteristics.

The plate-like member can be colored and designed in various manners by matching the alumite treatment.

Further, a configuration in which the frame member and the plate-like member are formed of the same material and integrally formed may be employed.

The configuration in which the frame member and the plate-like member are integrally formed can be prepared by performing a simple step such as compression forming, injection forming, imprinting, scraping processing, or a processing method using a three-dimensional shape forming (3D) printer.

<Aluminum Substrate>

An aluminum substrate used as a plate-like member is not particularly limited, and known aluminum substrates with alloy No. 1085, 1N30, 3003, and the like described in JIS Standard H 4000 can be used. Further, an aluminum substrate is an alloy plate containing aluminum as a main component and containing a trace amount of foreign elements.

The thickness of the aluminum substrate is not particularly limited, but is preferably in a range of 5 μm to 1000 μm, more preferably in a range of 5 μm to 200 μm, and particularly preferably in a range of 10 μm to 100 μm.

[Method of Producing Plate-Like Member Having Plurality of Through-Holes]

Next, an example of using an aluminum substrate will be described as a method of producing the plate-like member having a plurality of through-holes.

The method of producing the plate-like member having a plurality of through-holes using an aluminum substrate includes a film forming step of forming a film containing aluminum hydroxide as a main component on the surface of the aluminum substrate; a through-hole forming step of performing a through-hole forming treatment after the film forming step to form through-holes; and a film removing step of removing the aluminum hydroxide film after the through-hole forming step.

In a case where the method includes the film forming step, the through-hole forming step, and the film removing step, through-holes having an average opening diameter of 0.1 μm or greater and less than 250 μm can be suitably formed.

Next, after description of each step according to the method of producing the plate-like member having a plurality of through-holes with reference to FIGS. 6A to 6E, each step will be described in detail.

FIGS. 6A to 6E are cross-sectional views illustrating an example of a suitable embodiment for the method of producing the plate-like member having a plurality of through-holes using an aluminum substrate.

Figure 6A:
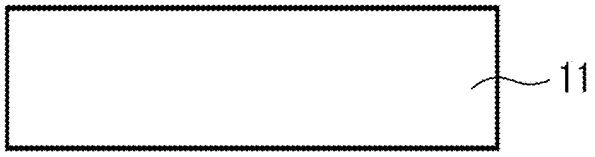
FIG. 6A is a schematic cross-sectional view for describing an example of a suitable method of producing a soundproofing structure having a plurality of through-holes.
Figure 6B:
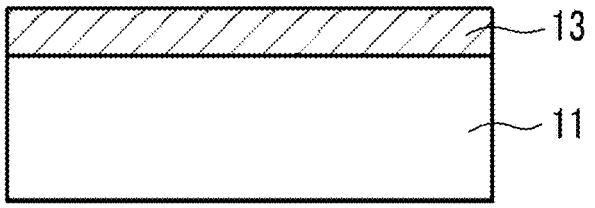
FIG. 6B is a schematic cross-sectional view for describing the example of the suitable method of producing a soundproofing structure having a plurality of through-holes.
Figure 6C:
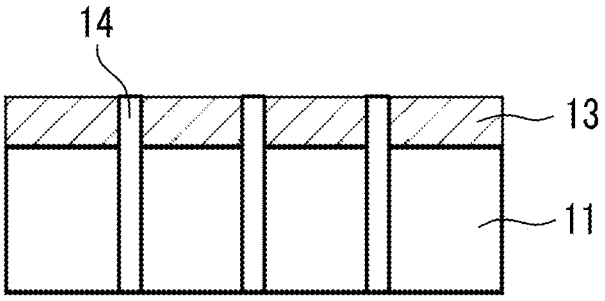
FIG. 6C is a schematic cross-sectional view for describing the example of the suitable method of producing a soundproofing structure having a plurality of through-holes.
Figure 6D:
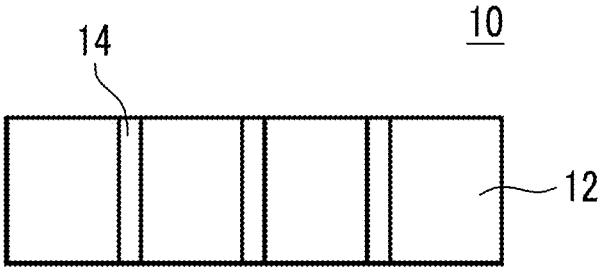
FIG. 6D is a schematic cross-sectional view for describing the example of the suitable method of producing a soundproofing structure having a plurality of through-holes.

As illustrated in FIGS. 6A to 6E, the method of producing the plate-like member having a plurality of through-holes is a production method including a film forming step of performing a film forming treatment on one principal surface of an aluminum substrate 11 to form an aluminum hydroxide film 13 (FIGS. 6A and 6B); a through-hole forming step of performing an electrodissolution treatment after the film forming step to form through-holes 14 and forming through-holes in the aluminum substrate 11 and the aluminum hydroxide film 13 (FIGS. 6B and 6C), and a film removing step of removing an aluminum hydroxide film 13 after the through-hole forming step to prepare the plate-like member 12 having the through-holes 14 (FIGS. 6C and 6D).

Figure 6E:
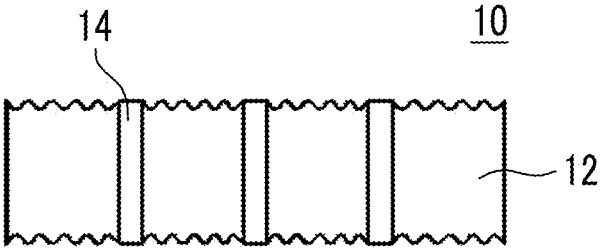
FIG. 6E is a schematic cross-sectional view for describing the example of the suitable method of producing a soundproofing structure having a plurality of through-holes.

In addition, it is preferable that the method of producing the plate-like member having a plurality of through-holes includes a roughening treatment step of performing an electrochemical roughening treatment on the plate-like member 12 having the through-holes 14 after the film removing step so that the surface of the plate-like member 12 is roughened (FIGS. 6D and 6E).

Since small holes are likely to be formed in an aluminum hydroxide film, through-holes having an average opening diameter of 0.1 μm to 250 μm can be formed by performing an electrodissolution treatment in the through-hole forming step to form through-holes after the film forming step of forming an aluminum hydroxide film.

[Film Forming Step]

In the present invention, the film forming step included in the method of producing a plate-like member having a plurality of through-holes is a step of performing a film forming treatment on the surface of the aluminum substrate to form an aluminum hydroxide film.

<Film Forming Treatment>

The film forming treatment is not particularly limited, and the same treatment as a known treatment of forming an aluminum hydroxide film of the related art can be performed.

As the film forming treatment, the conditions or devices described in paragraphs <0013> to <0026> of JP2011-201123A can be appropriately employed.

In the present invention, the conditions for the film forming treatment greatly vary depending on the electrolytic solution to be used and cannot be unconditionally determined. However, as the suitable conditions, typically, the concentration of the electrolytic solution is in a range of 1% to 80% by mass, the liquid temperature is in a range of 5° C. to 70° C., the current density is in a range of 0.5 to 60 A/dm$^2$, the voltage is in range of 1 to 100 V, and the electrolysis time is in a range of 1 second to 20 minutes, and the conditions are adjusted to obtain a desired amount of a film.

In the present invention, it is preferable that an electrochemical treatment is performed using nitric acid, hydrochloric acid, sulfuric acid, phosphoric acid, oxalic acid, or mixed acids of two or more of these acids as an electrolytic solution.

In a case where the electrochemical treatment is performed in an electrolytic solution containing nitric acid and hydrochloric acid, direct current or alternating current may be applied to a space between the aluminum substrate and a counter electrode. In a case where direct current is applied to the aluminum substrate, the current density is preferably in a range of 1 to 60 A/dm$^2$ and more preferably in a range of 5 to 50 A/dm$^2$. In a case where the electrochemical treatment is continuously performed, it is preferable that the treatment is performed according to a liquid supply system that supplies power to the aluminum substrate through an electrolytic solution.

In the present invention, the amount of the aluminum hydroxide film to be formed by the film forming treatment is preferably in a range of 0.05 to 50 g/m$^2$ and more preferably in a range of 0.1 to 10 g/m$^2$.

[Through-Hole Forming Step]

The through-hole forming step is a step of performing an electrodissolution treatment after the film forming step to form through-holes.

<Electrodissolution Treatment>

The electrodissolution treatment is not particularly limited, and an acidic solution is used as an electrolytic solution using direct current or alternating current. Among the above-described acids, it is preferable to perform the electrochemical treatment using at least one of nitric acid or hydrochloric acid and more preferable to perform the electrochemical treatment using mixed acids of at least one of sulfuric acid, phosphoric acid, or oxalic acid in addition to these acids.

In the present invention, as the acidic solution serving as an electrolytic solution, electrolytic solutions described in each specification of U.S. Pat. Nos. 4,671,859, 4,661,219, 4,618,405, 4,600,482, 4,566,960, 4,566,958, 4,566,959, 4,416,972, 4,374,710, 4,336,113, and 4,184,932 can be used in addition to the above-described acid.

The concentration of the acidic solution is preferably in a range of 0.1% to 2.5% by mass and particularly preferably in a range of 0.2% to 2.0% by mass. Further, the liquid temperature of the acidic solution is preferably in a range of 20° C. to 80° C. and more preferably in a range of 30° C. to 60° C.

An aqueous solution mainly containing the acid can be used by adding at least one of a nitric acid compound having a nitrate ion such as aluminum nitrate, sodium nitrate, or ammonium nitrate, a hydrochloric acid compound having a hydrochloride ion such as aluminum chloride, sodium chloride, or ammonium chloride, or a sulfuric acid compound having a sulfate ion such as aluminum sulfate, sodium sulfate, or ammonium sulfate to an aqueous solution containing an acid with a concentration of 1 to 100 g/L until saturation occurs from an amount of 1 g/L.

Further, metals contained in an aluminum alloy such as iron, copper, manganese, nickel, titanium, magnesium, and silica may be dissolved in an aqueous solution mainly containing the acid. It is preferable that a liquid to which aluminum chloride, aluminum nitrate, or aluminum sulfate has been added is used such that the amount of aluminum ions in an aqueous solution having an acid with a concentration of 0.1% to 2% by mass is in a range of 1 to 100 g/L.

In an electrochemical dissolution treatment, the direct current is mainly used. In a case where the alternating current is used, the AC power supply wave thereof is not particularly limited, and a sine wave, a square wave, a trapezoidal wave, or a triangular wave is used. Among these, a square wave or a trapezoidal wave is preferable and a trapezoidal wave is particularly preferable.

(Nitric Acid Electrolysis)

In the present invention, through-holes having an average opening diameter of 0.1 μm to 250 μm can be easily formed by performing an electrochemical dissolution treatment (hereinafter, simply referred to as a "nitric acid dissolution treatment") using an electrolytic solution mainly containing nitric acid.

Here, from the viewpoint of easily controlling the dissolution point for forming through-holes, it is preferable that the nitric acid dissolution treatment is an electrolytic treatment performed under conditions of an average current density of 5 $A/dm^2$ or greater and an electric quantity of 50 $C/dm^2$ or greater using the direct current. Further, the average current density is preferably 100 $A/dm^2$ or less and the electric quantity is preferably 10000 $C/dm^2$ or less.

The concentration and the temperature of the electrolytic solution in the nitric acid electrolysis are not particularly limited. For example, the electrolysis can be performed in a temperature range of 30° C. to 60° C. using a nitric acid electrolytic solution having a nitric acid concentration of 15% to 35% by mass, which is a high concentration, and the electrolysis can be performed at 80° C. or higher, which is a high temperature, using a nitric acid electrolytic solution having a nitric acid concentration of 0.7% to 2% by mass.

Further, the electrolysis can be performed using an electrolytic solution obtained by mixing at least one of sulfuric acid, oxalic acid, or phosphoric acid having a concentration of 0.1% to 50% by mass with the above-described nitric acid electrolytic solution.

(Hydrochloric Acid Electrolysis)

In the present invention, through-holes having an average opening diameter of 1 μm to 250 μm can be easily formed by performing an electrochemical dissolution treatment (hereinafter, simply referred to as a "hydrochloric acid dissolution treatment") using an electrolytic solution mainly containing nitric acid.

Here, from the viewpoint of easily controlling the dissolution point for forming through-holes, it is preferable that the hydrochloric acid dissolution treatment is an electrolytic treatment performed under conditions of an average current density of 5 $A/dm^2$ or greater and an electric quantity of 50 $C/dm^2$ or greater using the direct current. Further, the average current density is preferably 100 $A/dm^2$ or less and the electric quantity is preferably 10000 $C/dm^2$ or less.

The concentration and the temperature of the electrolytic solution in the hydrochloric acid electrolysis are not particularly limited. For example, the electrolysis can be performed in a temperature range of 30° C. to 60° C. using a hydrochloric acid electrolytic solution having a hydrochloric acid concentration of 10% to 35% by mass, which is a high concentration, and the electrolysis can be performed at 80° C. or higher, which is a high temperature, using a hydrochloric acid electrolytic solution having a hydrochloric acid concentration of 0.7% to 2% by mass.

Further, the electrolysis can be performed using an electrolytic solution obtained by mixing at least one of sulfuric acid, oxalic acid, or phosphoric acid having a concentration of 0.1% to 50% by mass with the above-described hydrochloric acid electrolytic solution.

[Film Removing Step]

The film removing step is a step of removing an aluminum hydroxide film by performing a chemical dissolution treatment.

In the film removing step, an aluminum hydroxide film can be removed by performing, for example, an acid etching treatment or an alkali etching treatment described below.

<Acid Etching Treatment>

The dissolution treatment is a treatment of dissolving an aluminum hydroxide film using a solution (hereinafter, referred to as an "aluminum hydroxide dissolving solution") that preferentially dissolves aluminum hydroxide rather than aluminum.

Here, as the aluminum hydroxide dissolving solution, an aqueous solution containing at least one selected from the group consisting of nitric acid, hydrochloric acid, sulfuric acid, phosphoric acid, oxalic acid, a chromium compound, a zirconium compound, a titanium compound, a lithium salt, a cerium salt, a magnesium salt, sodium silicofluoride, zinc fluoride, a manganese compound, a molybdenum compound, a magnesium compound, a barium compound, and a halogen simple substance is preferable.

Specifically, examples of the chromium compound include chromium (III) oxide and chromic anhydride (VI).

Examples of the zirconium compound include zirconium ammonium fluoride, zirconium fluoride, and zirconium chloride.

Examples of the titanium compound include titanium oxide and titanium sulfide.

Examples of the lithium salt include lithium fluoride and lithium chloride.

Examples of the cerium salt include cerium fluoride and cerium chloride.

Examples of magnesium salt include magnesium sulfide.

Examples of the manganese compound include sodium permanganate and calcium permanganate.

Examples of the molybdenum compound include sodium molybdate.

Examples of the magnesium compound include magnesium fluoride-pentahydrate.

Examples of the barium compound include barium oxide, barium acetate, barium carbonate, barium chlorate, barium chloride, barium fluoride, barium iodide, barium lactate, barium oxalate, barium perchlorate, barium selenate, barium selenite, barium stearate, barium sulfite, barium titanate, barium hydroxide, barium nitrate, and hydrates of these.

Among these barium compounds, barium oxide, barium acetate, or barium carbonate is preferable and barium oxide is particularly preferable.

Examples of the halogen single substance include chlorine, fluorine, and bromine.

Among these, it is preferable that the aluminum hydroxide dissolving solution is an aqueous solution containing an acid. Examples of the acid include nitric acid, hydrochloric acid, sulfuric acid, phosphoric acid, and oxalic acid, and a mixture of two or more kinds of acids may be used.

The acid concentration is preferably 0.01 mol/L or greater, more preferably 0.05 mol/L or greater, and still more preferably 0.1 mol/L or greater. The upper limit thereof is not particularly limited, but is preferably 10 mol/L or less and more preferably 5 mol/L or less.

The dissolution treatment is performed by bringing the aluminum substrate on which an aluminum hydroxide film is formed into contact with the above-described dissolving solution. The method of bringing the substrate into contact with the solution is not particularly limited, and examples thereof include an immersion method and a spray method. Among these, an immersion method is preferable.

The immersion method is a treatment of immersing the aluminum substrate on which an aluminum hydroxide film is formed in the above-described dissolving solution. From the viewpoint of performing the treatment without unevenness, it is preferable that the dissolving solution is stirred during this immersion treatment.

The time for the immersion treatment is preferably 10 minutes or longer, more preferably 1 hour or longer, and still more preferably 3 hours or longer or 5 hours or longer.

<Alkali Etching Treatment>

The alkali etching treatment is a treatment of dissolving the surface layer by bringing the aluminum hydroxide film into contact with an alkali solution.

Examples of the alkali used in the alkali solution include a caustic alkali and an alkali metal salt. Specific examples of the caustic alkali include sodium hydroxide (caustic soda) and caustic potash. Further, examples of the alkali metal salt include alkali metal silicate such as sodium metasilicate, sodium silicate, potassium metasilicate, and potassium silicate; alkali metal carbonate such as sodium carbonate and potassium carbonate; alkali metal aluminate such as sodium aluminate and potassium aluminate; alkali metal aldonate such as sodium gluconate and potassium gluconate; and alkali metal hydrogen phosphate such as disodium phosphate, dipotassium phosphate, trisodium phosphate, and tripotassium phosphate. Among these, from the viewpoints of a high etching speed and low cost, a solution containing a caustic alkali or a solution containing both of a caustic alkali and alkali metal aluminate is preferable. Further, an aqueous solution containing sodium hydroxide is preferable.

The concentration of the alkali solution is preferably in a range of 0.1% to 50% by mass and more preferably in a range of 0.2% to 10% by mass. In a case where aluminum ions are dissolved in an alkali solution, the concentration of the aluminum ions is preferably in a range of 0.01% to 10% by mass and more preferably in a range of 0.1% to 3% by mass. The temperature of the alkali solution is preferably in a range of 10° C. to 90° C. The treatment time is preferably in a range of 1 to 120 seconds.

Examples of the method of bringing an aluminum hydroxide film into contact with an alkali solution include a method of allowing an aluminum substrate on which an aluminum hydroxide film is formed to pass through a bath to which an alkali solution has been added, a method of immersing an aluminum substrate on which an aluminum hydroxide film is formed in a bath to which an alkali solution has been added, and a method of spraying an alkali solution to the surface (aluminum hydroxide film) of an aluminum substrate on which an aluminum hydroxide film has been formed.

[Roughening Treatment Step]

In the present invention, an optional roughening treatment step which may be included in the method of producing the plate-like member having a plurality of through-holes is a step of performing an electrochemical roughening treatment (hereinafter, also simply referred to as an "electrolytic roughening treatment") on an aluminum substrate from which an aluminum hydroxide film has been removed to roughen the front surface or the rear surface of the aluminum substrate.

Further, according to the embodiment, the configuration on which the roughening treatment is performed after the through-holes are formed is employed, but the present invention is not limited thereto, and a configuration in which the through-holes are formed after the roughening treatment may be employed.

In the present invention, the surface can be easily roughened by performing an electrochemical roughening treatment (hereinafter, also simply referred to as a "nitric acid electrolysis") using an electrolytic solution mainly containing nitric acid.

Alternatively, the surface can be roughened by performing an electrochemical roughening treatment (hereinafter, also simply referred to as "hydrochloric acid electrolysis") using an electrolytic solution mainly containing hydrochloric acid.

[Metal Coating Step]

In the present invention, from the viewpoint that the average opening diameter of the through-holes formed by the above-described electrodissolution treatment can be adjusted to be in a small range of 0.1 μm to 20 μm, it is preferable that the method of producing the plate-like member having a plurality of through-holes includes a metal coating step of coating a part or the entirety of the surface of the aluminum substrate having at least the inner walls of the through-holes with a metal other than aluminum after the above-described film removing step.

Here, the expression "coating a part or the entirety of the surface of the aluminum substrate having at least the inner walls of the through-holes with a metal other than aluminum" means that at least the inner walls of the through-holes in the entire surface of the aluminum substrate having the inner walls of the through-holes are coated with a metal, and the surface other than the inner walls may not be coated or a part or the entirety of the surface may be coated.

The metal coating step is carried out by performing a substitution treatment and a plating treatment described below on the aluminum substrate having through-holes.

<Substitution Treatment>

The substitution treatment is a treatment of performing substitution plating on a part or the entirety of the surface of the aluminum substrate having at least the inner walls of the through-holes with zinc or a zinc alloy.

As a substitution plating liquid, a mixed solution of 120 g/L of sodium hydroxide, 20 g/L of zinc oxide, 2 g/L of iron (III) chloride, 50 g/L of Rochelle salt, and 1 g/L of sodium nitrate may be exemplified.

Further, commercially available Zn or a Zn alloy plating liquid may be used, and examples thereof include SUBSTR Zn-1, Zn-2, Zn-3, Zn-8, Zn-10, Zn-111, Zn-222, and Zn-291 (all manufactured by OKUNO CHEMICAL INDUSTRIES CO., LTD.) can be used.

The time of immersing such a substitution plating liquid in an aluminum substrate is preferably in a range of 15 seconds to 40 seconds and the immersion temperature is preferably in a range of 20° C. to 50° C.

<Plating Treatment>

In a case where a zinc film is formed by performing the above-described substitution treatment on the surface of the aluminum substrate for substitution plating of zinc or a zinc alloy, for example, it is preferable to perform a plating treatment of substituting the zinc film with nickel through electroless plating described below and allowing various metals to be deposited through electrolytic plating described below.

(Electroless Plating Treatment)

Commercially available products can be widely used as a nickel plating liquid used for the electroless plating treatment, and an aqueous solution containing 30 g/L of nickel sulfate, 20 g/L of sodium hypophosphite, and 50 g/L of ammonium citrate is exemplified. Further, examples of the nickel alloy plating liquid include a Ni—P alloy plating liquid containing a phosphorus compound as a reducing agent and a Ni—B plating liquid containing a boron compound as a reducing agent.

The time of immersion in such a nickel plating liquid or a nickel alloy plating liquid is preferably in a range of 15 seconds to 10 minutes and the immersion temperature is preferably in a range of 30° C. to 90° C.

(Electrolytic Plating Treatment)

In an electrolytic plating treatment, as a plating liquid in a case of electroplating Cu, a plating liquid obtained by adding 60 to 110 g/L of Cu sulfate, 160 to 200 g/L of sulfuric acid, and 0.1 to 0.15 mL/L of hydrochloric acid to pure water and adding 1.5 to 5.0 mL/L of TOP LUCINA SF base WR, 0.5 to 2.0 mL/L of TOP LUCINA SF-B, and 3.0 to 10 mL/L of TOP LUCINA SF LEVELER (manufactured by OKUNO CHEMICAL INDUSTRIES CO., LTD.) as additives is exemplified.

The time of immersion in such a copper plating liquid is not particularly limited since the time depends on the thickness of the Cu film. However, in a case where a Cu film having a thickness of 2 μm is formed, it is preferable that the Cu film is immersed at a current density of 2 $A/dm^2$ for approximately 5 minutes and the immersion temperature is preferably in a range of 20° C. to 30° C.

[Water Washing Treatment]

In the present invention, it is preferable that a water washing treatment is performed after each treatment step described above is completed. For the water washing treatment, pure water, well water, or tap water can be used. A nip device may be used to prevent carry-on of a treatment liquid to the next step.

The plate-like member having through-holes may be produced using a cut sheet-like aluminum substrate or according to a roll-to-roll (hereinafter, also referred to as RtoR) system.

As is well known, RtoR is a production method of drawing a raw material from a roll formed by winding a long raw material, transporting the material in the longitudinal direction, performing various treatments such as a surface treatment, and winding the treated raw material in a roll shape again.

According to the production method of forming through-holes in the aluminum substrate as described above, through-holes having an opening diameter of approximately 20 μm can be easily and efficiently formed using RtoR.

Further, the method of forming through-holes is not limited to the above-described method, and through-holes may be formed according to a known method depending on the material for forming the plate-like member.

For example, in a case where a resin film such as a PET film is used as a plate-like member, through-holes can be formed according to a processing method of absorbing energy such as laser processing; or a machining method using physical contact such as needle processing.

Figure 7:
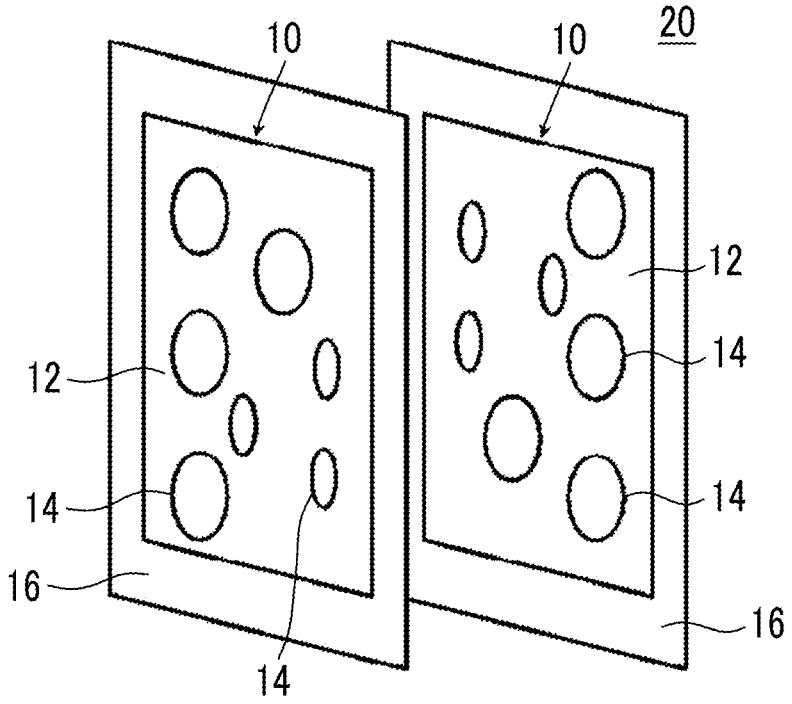
FIG. 7 is a perspective view schematically illustrating another example of a soundproofing structure of the present invention.

In the example illustrated in FIG. 1, one configuration formed by fixing the plate-like member 12 in which a plurality of through-holes 14 have been formed to the frame member 16 is used as the soundproofing structure 10, but the present invention is not limited thereto, and a configuration in which two or more configurations, each of which is formed of the plate-like member 12 and the frame member 16, are arranged in the thickness direction of the plate-like member may be employed as in a case of a soundproofing structure 20 illustrated in FIG. 7. In other words, a soundproofing structure may be formed by arranging two or more of the soundproofing structures 10 of the present invention in the thickness direction.

In a case where two or more soundproofing structures are arranged in the thickness direction, the frame members may be integrated with each other. For example, in a case where two plate-like members 12 are arranged in the thickness direction, a configuration in which one plate-like member 12 is fixed to one end surface of one frame member 16 and another plate-like member 12 is fixed to the other end surface of the frame member 16 may be employed.

Here, as described above, the mechanism for sound absorption of the present invention is the conversion of sound energy into thermal energy using the friction at the time of the sound passing through the through-holes. Accordingly, as the local speed of the air at the time of passing through the through-holes becomes higher, the sound absorption performance is increased. Therefore, in a case of the configuration formed by arranging two or more plate-like members 12, it is preferable that the plate-like members 12 are disposed by being separated from each other. By arranging the plate-like members 12 being separated from each other, a decrease in local speed at the time of the sound passing through the through-holes 14 of the plate-like member 12 to be disposed at the rear stage can be suppressed due to the influence of the plate-like member 12 to be disposed at the front stage in the passing direction of the sound, and thus the sound can be more suitably absorbed.

Here, in a case where the distance between the plate-like members is increased, the size of the structure is increased and the distance between the plate-like members becomes about the wavelength. Due to this, sound interference occurs and thus the flat sound absorption characteristics are not exhibited any more. Accordingly, it is desirable that the distance is shorter than a length of 100 mm which is a wavelength of a sound at a frequency of 3400 Hz as a typical wavelength and more desirable that the distance is shorter than a length of 34 mm which is a wavelength of a sound at a frequency of 10000 Hz.

Meanwhile, in a case where the distance between the plate-like members is decreased, the sound absorption of the plate-like members at the rear stage is affected by the local speed lowered by the friction at the through-holes of the plate-like member at the front stage. Therefore, the efficiency is improved in a case where the plate-like members are appropriately separated from each other.

From the viewpoint of suitably suppressing a decrease in local speed at the time of the sound passing through the through-holes 14 of the plate-like member 12 at the rear stage, the distance between the plate-like members 12 is preferably in a range of 5 mm to 100 mm and more preferably in a range of 10 mm to 34 mm.

In a case where the soundproofing structure of the present invention is installed for soundproofing of the object to be soundproofed, a plurality of unit soundproofing structures may be arranged in the plane direction of the plate-like member according to the object to be soundproofed. In other words, a soundproofing structure having a plurality of unit soundproofing structures may be obtained by using a soundproofing structure formed of a plate-like member and a frame member having one opening portion as illustrated in FIG. 1 as a unit soundproofing structure.

Figure 8:
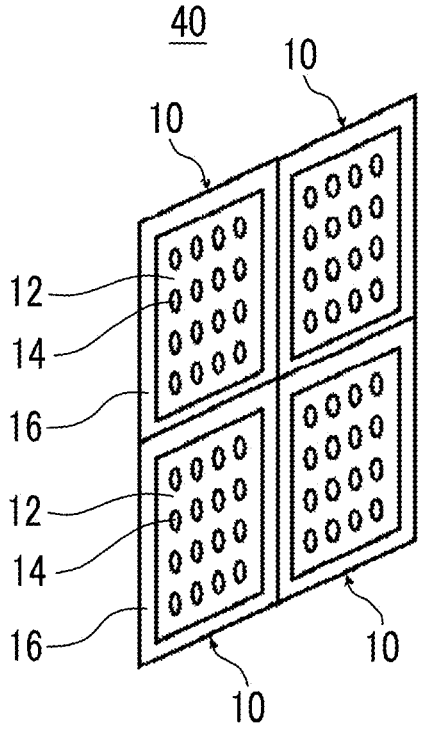
FIG. 8 is a perspective view schematically illustrating still another example of a soundproofing structure of the present invention.

As an example, a soundproofing structure 40 illustrated in FIG. 8 has a configuration in which four unit soundproofing structures 10 are arranged in the plane direction by using the soundproofing structure 10 which includes the plate-like member 12 having a plurality of through-holes 14 and the frame member 14 having an opening portion and fixing the plate-like member 12 to the peripheral edge of the opening portion as a unit soundproofing structure 10.

At this time, frame members having a plurality of unit soundproofing structures may be integrally formed.

Figure 9A:
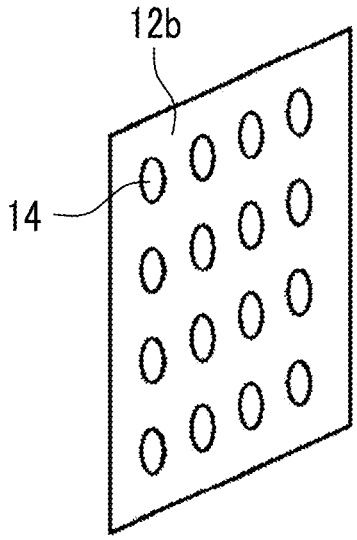
FIG. 9A is a schematic perspective view for describing a configuration of another example of a soundproofing structure.
Figure 9B:
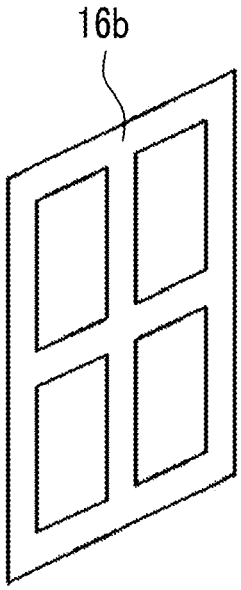
FIG. 9B is a schematic perspective view for describing a configuration of another example of a soundproofing structure.
Figure 9C:
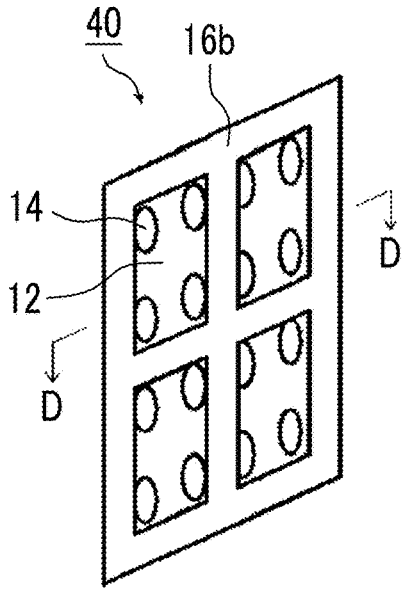
FIG. 9C is a schematic perspective view for describing a configuration of another example of a soundproofing structure.
Figure 9D:
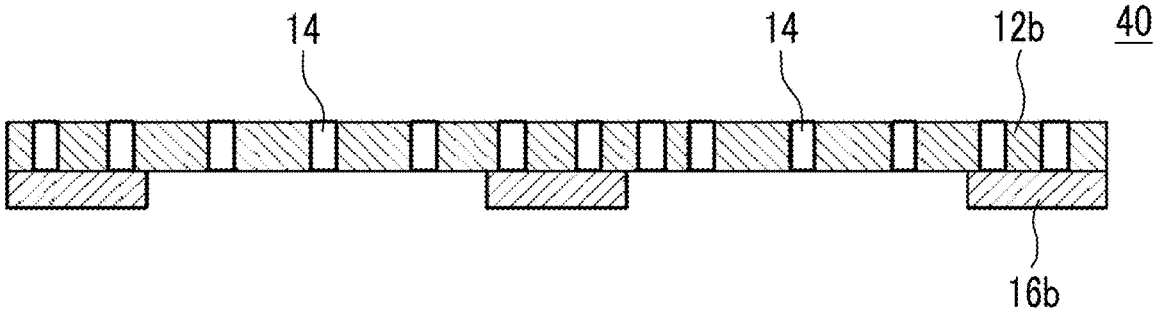
FIG. 9D is a cross-sectional view taken along line D-D of FIG. 9C.

For example, as illustrated in FIGS. 9A to 9D, one plate-like member 12*b* as illustrated in FIG. 9A may be fixed to a frame member 14*b* having four opening portions as illustrated in FIG. 9B so as to cover four opening portions to obtain the soundproofing structure 40 having four unit soundproofing structures as illustrated in FIGS. 9C and 9D. In other words, a plurality of plate-like members may be formed of one sheet-like plate-like member that covers a plurality of frame members.

Figure 10A:
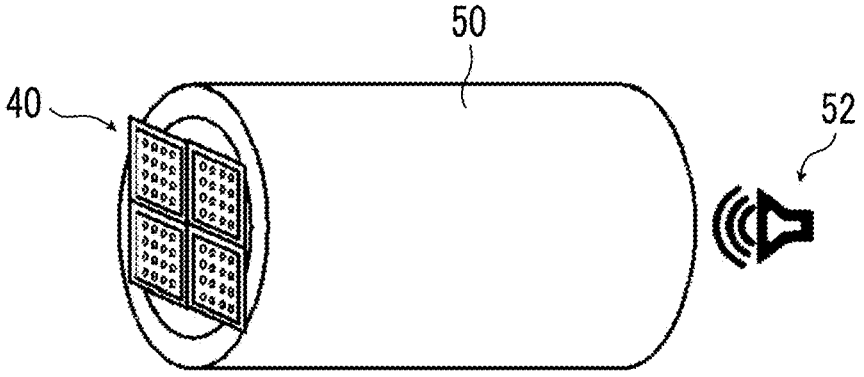
FIG. 10A is a perspective view schematically illustrating another example of a form of utilizing the soundproofing structure of the present invention.
Figure 10B:
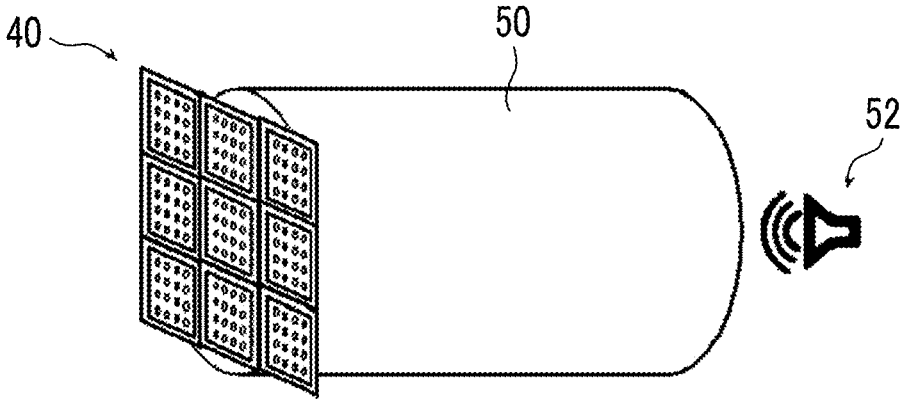
FIG. 10B is a perspective view schematically illustrating still another example of a form of utilizing the soundproofing structure of the present invention.

In a case where the soundproofing structure 40 has a plurality of unit soundproofing structures, as illustrated in FIGS. 10A and 10B, the soundproofing structure is disposed at an open end of a pipe 50 communicating with a noise source 52 and absorbs a sound generated from the noise source 52, similar to the case of a single soundproofing structure 10.

At this time, the open end of the pipe 50 may be completely covered by the soundproofing structure 40 as illustrated in FIG. 10A or the open end of the pipe 50 may not be completely covered by the soundproofing structure 40 as illustrated in FIG. 10B.

The number of unit soundproofing structures is not particularly limited in the soundproofing structure having a plurality of unit soundproofing structures. For example, in a case where the noise is shielded (reflection and/or absorption) in equipment, the number of the unit soundproofing structures is preferably in a range of 1 to 10000, more preferably in a range of 2 to 5000, and most preferably in a range of 4 to 1000.

Since the size of general equipment is determined, it is necessary that noise is frequently shielded by a frame body obtained by combining a plurality of soundproofing structures in order to set to size of one soundproofing structure to a size suitable for the sound volume and the frequency of the noise. This is because the weight of the entire soundproofing structure and the total weight of the device are increased due to an extreme increase in the number of soundproofing structures. Meanwhile, in a structure such as a partition whose size is not restricted, the number of soundproofing structures can be freely selected according to the size of the entire body to be required.

Hereinafter, the physical properties or characteristics of a structural member which can combine with a soundproofing member having the soundproofing structure of the present invention will be described.

[Flame Retardancy]

In a case where a soundproofing member having the soundproofing structure of the present invention is used as a building material or a soundproofing material in equipment, flame retardancy is required.

Accordingly, it is preferable that the plate-like member is flame retardant. In a case where a resin is used as the plate-like member, for example, LUMIRROR (registered trademark) non-halogen flame retardant type ZV series (manufactured by Toray Industries, Inc.) which is a flame retardant PET film, TEIJIN TETORON (registered trademark) UF (manufactured by Teijin Limited), and/or DIALAMY (registered trademark) (manufactured by Mitsubishi Plastics, Inc.) which is a flame retardant polyester film may be used.

Further, the flame retardancy can be imparted by using a metallic material such as aluminum.

Further, it is preferable that the frame member is formed of a flame retardant material, and examples of the material include metals such as aluminum, inorganic materials such as ceramics, glass materials, and flame retardant plastics such as flame retardant polycarbonate (PCMUPY610 (manufactured by Takiron Co., Ltd.)) and/or flame retardant acryl (for example, ACRYLITE (registered trademark) FR1 (manufactured by MITSUBISHI RAYON CO., LTD.)).

Further, preferred examples of the method of fixing the plate-like member to the frame member include a method of using a flame retardant adhesive (Three Bond 1537 Series (manufactured by ThreeBond Holdings Co., Ltd.)), a bonding method of performing soldering, and a mechanical fixing method of interposing a plate-like member between two frame members so as to be fixed therebetween.

[Heat Resistance]

Since there is a concern that the soundproofing characteristics resulting from expansion and contraction of the structural member of the soundproofing structure of the present invention may change due to the environmental temperature change, it is preferable that the material constituting the structural member is heat-resistant and low heat shrinkable.

It is preferable that a TEIJIN TETORON (registered trademark) film SLA (manufactured by Teijin Limited), a TEONEX (registered trademark) (manufactured by Teijin DuPont Films Co., Ltd.) PEN film, and/or a LUMIRROR (registered trademark) off annealing low contraction type (manufactured by Toray Industries, Inc.) film is used as the plate-like member. Further, it is also preferable to use a metal film such as an aluminum film typically having a smaller thermal expansion coefficient than that of a plastic material.

Further, it is preferable to use heat-resistant plastics such as a polyimide resin (TECASINT 4111 (manufactured by Ensinger Japan Co., Ltd.)), and/or a glass fiber reinforced resin (TECAPEEK GF30 (manufactured by Ensinger Japan Co., Ltd.), and/or metals such as aluminum, inorganic materials such as a ceramic, or glass materials as the frame member.

Further, it is preferable to use a heat-resistant adhesive (TB3732 (manufactured by ThreeBond Holdings Co., Ltd.)), superheat resistant one-component shrinkable RTV silicone adhesive sealant (manufactured by Momentive Performance Materials Inc.), and/or heat-resistant inorganic adhesive Aron Ceramic (registered trademark) (manufactured by TOAGOSEI CO., LTD.) as the adhesive. In a case where the plate-like member or the frame member is coated with any of these adhesives, it is preferable that the amount of expansion and contraction can be reduced by adjusting the thickness thereof to 1 μm or less.

[Weather Resistance and Light Resistance]

In a case where a soundproofing member having the soundproofing structure of the present invention is disposed in outdoors or in a place where light comes in, the weather resistance of the structural member becomes problematic.

Accordingly, it is preferable to use a weather resistant film such as a special polyolefin film (ART PLY (registered trademark) (manufactured by Mitsubishi Plastics, Inc.), an acrylic resin film (ACRYPRENE (manufactured by MITSUBISHI RAYON CO., LTD.)), and/or a Scotchcal (registered trademark) film (manufactured by 3M Company) as the plate-material member.

Further, it is preferable to use plastics having high weather resistance such as polyvinyl chloride or polymethyl (meth) acrylate, metals such as aluminum, inorganic materials such as ceramics, and/or glass materials as the frame member.

Further, it is preferable to use an adhesive having high weather resistance such as an epoxy resin-based adhesive and/or DRY FLEX (manufactured by Repair Care International) as the adhesive.

In regard to the moisture resistance, it is preferable to select a plate-like member, a frame member, and an adhesive having a high moisture resistance, as appropriate. Further, related to water-absorbing properties and chemical resistance, it is preferable to select a plate-like member, a frame member, and an adhesive as appropriate.

[Dirt]

In the use for a long period of time, there is a possibility that dirt adheres to the surface of the plate-like member and affects the soundproofing characteristics of the soundproofing structure of the present invention. Therefore, it is preferable to prevent adhesion of dirt or remove adhered dirt.

As a method of preventing dirt, it is preferable to use a plate-like member formed of a material to which dirt is unlikely to adhere. For example, by using a conductive film (FLECLEAR (registered trademark) (manufactured by TDK Corporation) and/or NCF (manufactured by NAGAOKA SANGYOU CO., LTD.)), the plate-like member is not charged, and thus adhesion of dirt due to the plate-like member being charged can be prevented. In addition, adhesion of dirt can be suppressed even by using a fluorine resin film (DINOC film (registered trademark) (manufactured by 3M Company)) and/or a hydrophilic film (Miraclean (manufactured by Lifeguard)), RIVEX (manufactured by RIKEN TECHNOS CORPORATION), and/or SH2CLHF (manufactured by 3M Company). Further, contamination of the plate-like member can be prevented by using a photocatalyst film (Laclean (manufactured by KIMOTO CO., LTD.)). The same effects can be obtained by applying a spray having conductivity, hydrophilicity, and/or photocatalystic properties and/or a spray having a fluorine compound to the plate-like member.

In addition to the use of the above-described special plate-like members 12, stain can be prevented by proving a cover on the plate-like member 12. As the cover, a thin film material (Saran Wrap (registered trademark)), a mesh having a network with a size that does not allow dirt to pass through, non-woven fabric, urethane, aerogel, or a porous film can be used.

Figure 27:
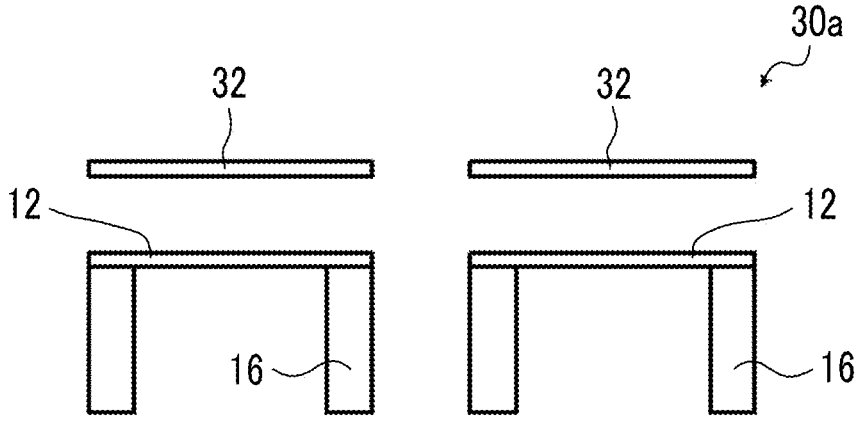
FIG. 27 is a schematic cross-sectional view illustrating an example of a soundproofing member having the soundproofing structure of the present invention.
Figure 28:
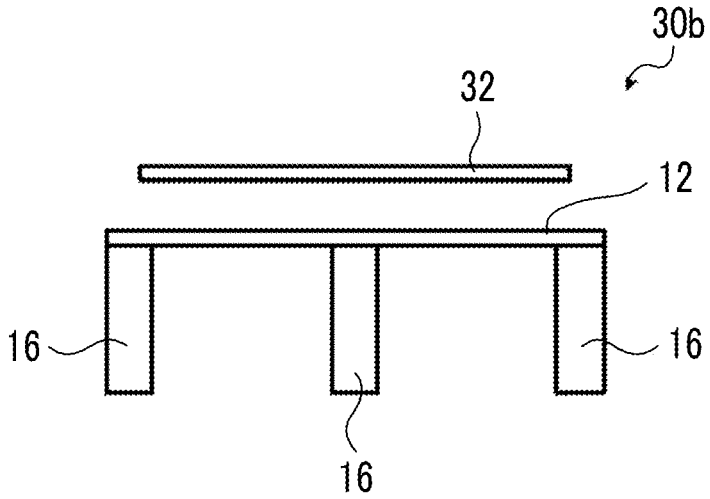
FIG. 28 is a schematic cross-sectional view illustrating another example of a soundproofing member having the soundproofing structure of the present invention.

For example, it is possible to prevent wind or dirt from being directly applied to the plate-like member 12 by disposing a cover 32 on the plate-like member 12 so as to cover the plate-like material in a state in which the plate-like member 12 and the cover 32 are separated by a predetermined distance as in soundproofing members 30*a* and 30*b* illustrated in FIGS. 27 and 28. Further, it is preferable that at least a part of the cover is fixed to the frame. Further, a cover having a gap such as a mesh with a large network may be disposed by being directly attached to the plate-like member using spray glue or the like.

As a method of removing adhered dirt, dirt can be removed by emitting a sound of a resonance frequency to the plate-like member 12 and strongly vibrating the plate-like member 12. Further, the same effect can be obtained in a case of using a blower or wiping.

[Wind Pressure]

In a case where strong wind is applied to the plate-like member, since the plate-like member is in a state of being pressured, the resonance frequency may be changed. Therefore, the influence of wind can be suppressed by covering the plate-like member with non-woven fabric, urethane, and/or a film. Further, similar to the case of dirt, it is preferable that the cover 32 is provided on the plate-like member 12 so that wind is not directly applied to the plate-like member 12 as in the soundproofing members 30*a* and 30*b* respectively illustrated in FIGS. 27 and 28.

[Combination of Unit Cells]

As described above, in a case where a configuration having a plurality of unit soundproofing structures (unit cells) is employed, a configuration in which a plurality of frame members are formed by a continuous one frame body or a configuration having a plurality of unit soundproofing structures, each of which includes one frame member and one plate-like member attached to one frame member may be employed. In other words, the soundproofing member having the soundproofing structure of the present invention is not necessarily formed of one continuous frame body, a soundproofing cell having a frame structure and a plate-like member attached to the frame structure may be used as a unit cell, and such a unit cell may be independently used or a plurality of unit cells may be used by being connected to one another.

A method of connecting a plurality of unit cells will be described below, but a plurality of unit cells may be combined by attaching Velcro tape (registered trademark), a magnet, a button, a sucker, and/or an uneven portion to a frame body portion or a plurality of unit cells may be connected using tape or the like.

[Disposition]

Figure 29:
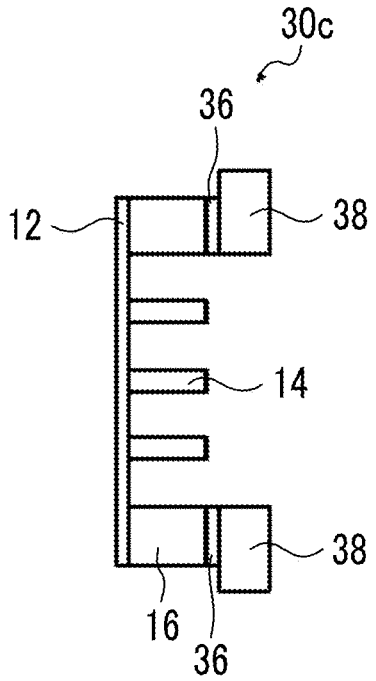
FIG. 29 is a schematic cross-sectional view illustrating an example of a state in which the soundproofing member having the soundproofing structure of the present invention is attached to a wall.
Figure 30:
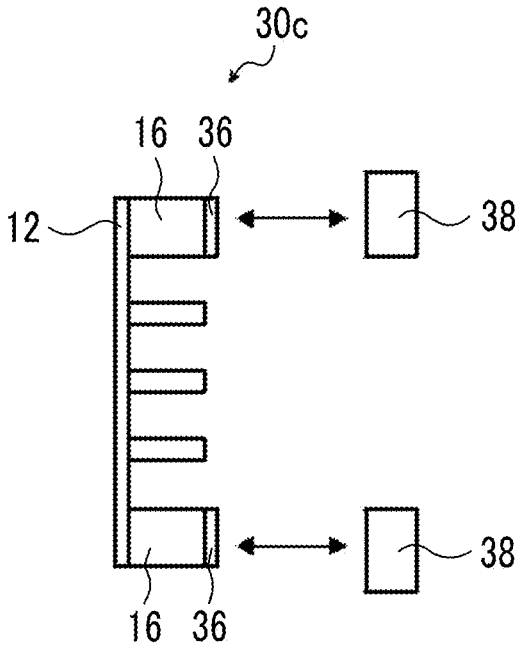
FIG. 30 is a schematic cross-sectional view illustrating an example of a state in which the soundproofing member illustrated in FIG. 29 is detached from the wall.

It is preferable that a desorption mechanism formed of a magnetic material, Velcro tape (registered trademark), a button, or a sucker is attached to the soundproofing member such that the soundproofing member having the soundproofing structure of the present invention is easily attached to a wall or the like and can be detached therefrom. For example, as illustrated in FIG. 29, a desorption mechanism 36 may be attached to the bottom surface of the frame member 16 outside a frame body of a soundproofing member 30*c*, the desorption mechanism 36 attached to the soundproofing member 30*c* is attached to a wall 38, and the soundproofing member 30*c* may be attached to the wall 38. Further, as illustrated in FIG. 30, the desorption mechanism 36 attached to the soundproofing member 30*c* may be detached from the wall 38 so that the soundproofing member 30*c* is separated from the wall 38.

Figure 31:
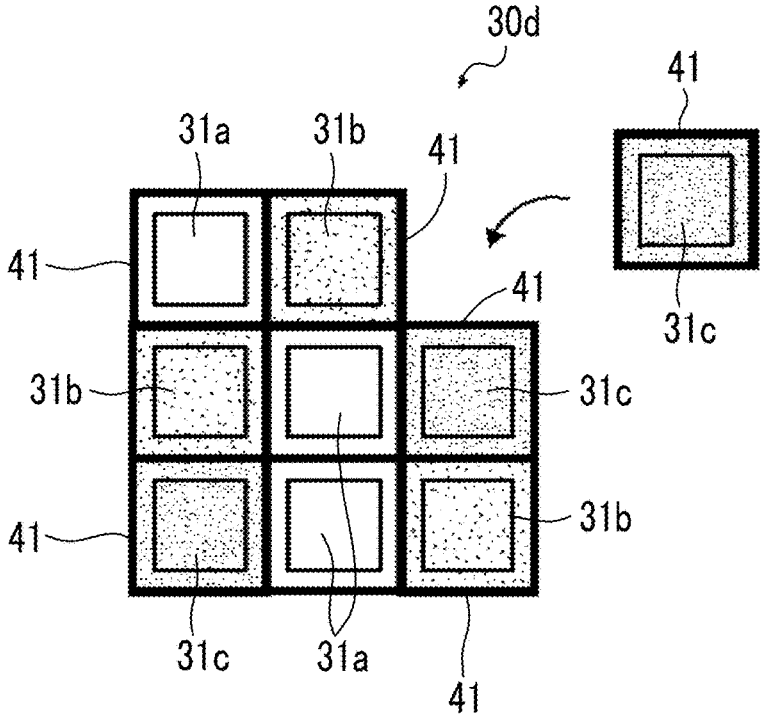
FIG. 31 is a plan view illustrating attachment and detachment of a unit cell according to another example of a soundproofing member having the soundproofing structure of the present invention.

Further, in a case where soundproofing cells with different resonance frequencies, for example, soundproofing cells 31*a*, 31*b*, and 31*c* are combined as illustrated in FIG. 31 to adjust the soundproofing characteristics of a soundproofing member 30*d*, it is preferable that the desorption mechanism 41 such as a magnetic material, Velcro tape (registered trademark), a button, or a sucker is attached to each of the soundproofing cells 31*a*, 31*b*, and 31*c* so as to easily combine the soundproofing cells 31*a*, 31*b*, and 31*c*.

Figure 32:
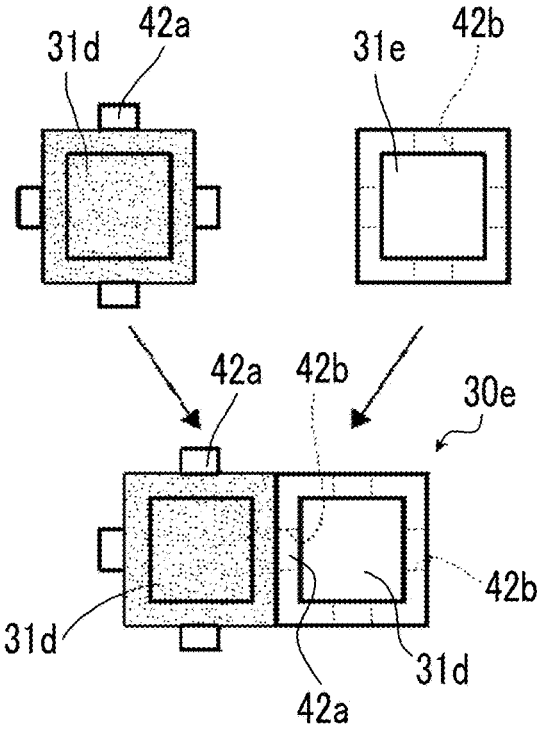
FIG. 32 is a plan view illustrating attachment and detachment of a unit cell according to still another example of a soundproofing member having the soundproofing structure of the present invention.

Further, an uneven portion is provided for a soundproofing cell. For example, as illustrated in FIG. 32, a projection 42*a* is provided on the soundproofing cell 31*d*, a depression 42*b* is provided in the soundproofing cell 31*e*, and the projection 42*a* and the depression 42*b* are engaged with each other to perform desorption between the soundproofing cell 31*d* and the soundproofing cell 31*e*. In a case where a plurality of soundproofing cells can be combined, both of a projection and a depression may be provided for one soundproofing cell.

In addition, attachment and detachment of soundproofing cells may be performed by combining the desorption mechanism 41 illustrated in FIG. 31 and the uneven portion, the projection 42*a*, and the depression 42*b* illustrated in FIG. 32.

[Mechanical Strength of Frame Member]

As the size of the soundproofing member having the soundproofing structure of the present invention is increased, the frame member easily vibrates and the function of the frame member as a fixed end with respect to the vibration of the plate-like member is degraded. Accordingly, it is preferable to increase the height of the frame member to increase the frame rigidity. However, the mass of the soundproofing member is increased in a case where the height of the frame member is increased, and thus the advantage of the present soundproofing member which is lightweight is decreased.

Figure 33:
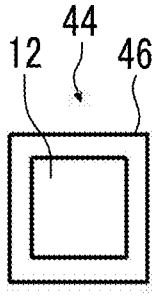
FIG. 33 is a plan view illustrating an example of a soundproofing cell in the soundproofing structure of the present invention.
Figure 34:
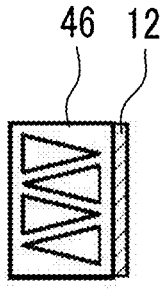
FIG. 34 is a side view of the soundproofing cell illustrated in FIG. 33.
Figure 35:
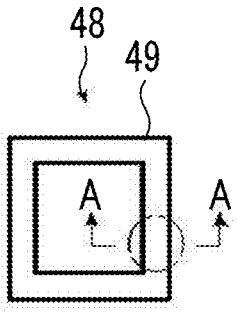
FIG. 35 is a plan view illustrating a soundproofing cell in the soundproofing structure of the present invention.
Figure 36:
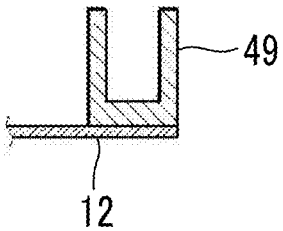
FIG. 36 is a schematic cross-sectional view taken along the arrow A-A of the soundproofing cell illustrated in FIG. 35.

For this reason, it is preferable to form holes or grooves in the frame member so that an increase in mass is suppressed while high rigidity thereof remains. For example, both of high rigidity and lightness can be achieved by using a truss structure illustrated in the side view of FIG. 34 for the frame member 46 of the soundproofing cell 44 illustrated in FIG. 33 or by using a frame structure illustrated in an arrow view taken along line A-A in FIG. 36 for the frame member 49 of the soundproofing cell 48 illustrated in FIG. 35.

Figure 37:
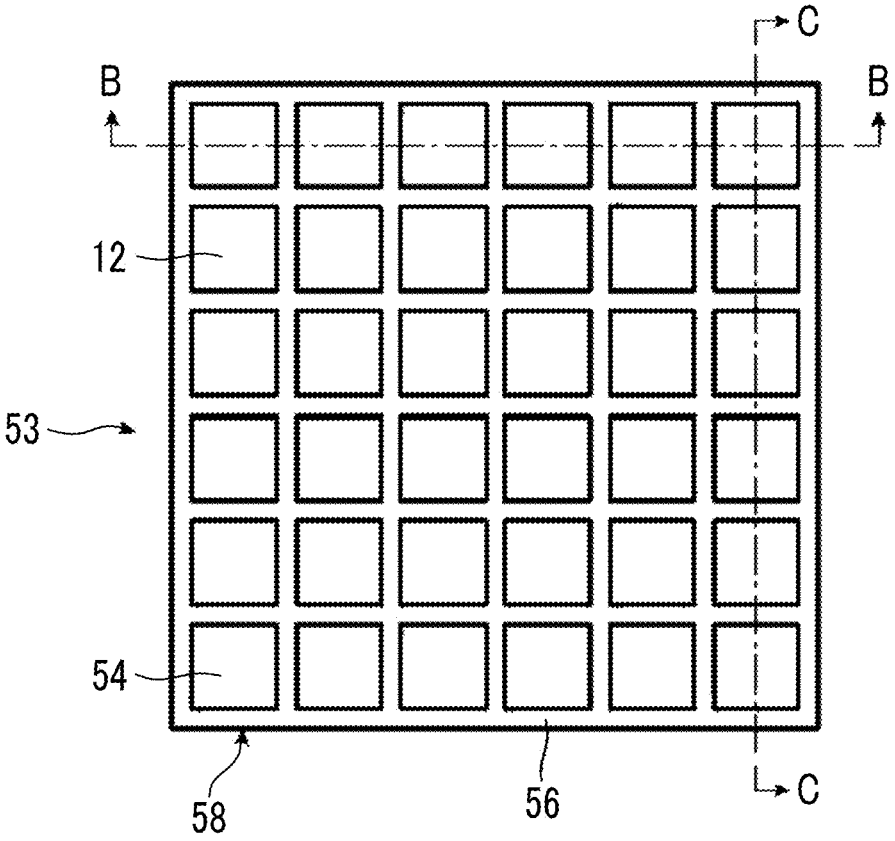
FIG. 37 is a plan view illustrating another example of a soundproofing member having the soundproofing structure of the present invention.
Figure 38:
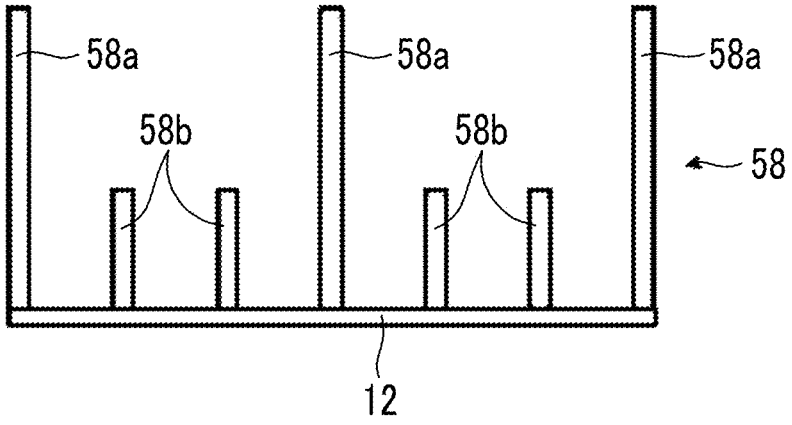
FIG. 38 is a schematic cross-sectional view taken along the arrow B-B of the soundproofing member illustrated in FIG. 37.
Figure 39:
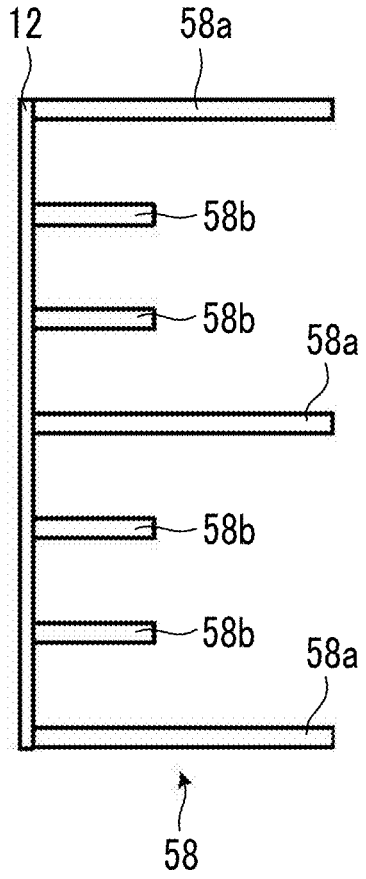
FIG. 39 is a schematic cross-sectional view taken along the arrow C-C of the soundproofing member illustrated in FIG. 37.

Moreover, as illustrated in FIGS. 37 to 39, the height of the frame member is changed by the position in the plane direction or the members are combined as illustrated in FIGS. 37 to 39 so that high rigidity can be ensured and the weight can be reduced. As in a case of the soundproofing member 53 having the soundproofing structure of the present invention illustrated in FIG. 37, the thickness of a frame material 58*a* on both outer sides and the central side of a frame body 58 formed of a plurality of frame members 56 of thirty six soundproofing cells 54 is adjusted to be larger than the thickness of the frame material 58*b* in other portions as illustrated in FIG. 38 which is a schematic cross-sectional view in which the soundproofing member 53 illustrated in FIG. 37 is taken along line B-B. In the example illustrated in FIG. 38, the thickness thereof is increased at least twice the thickness of the frame material 58*b* in other portions. As illustrated in FIG. 39 which is a schematic cross-sectional view taken along line C-C orthogonal to the B-B line, similarly, the thickness of the frame material 58*a* on both outer sides and the central side of the frame body 58 is adjusted to be larger than the thickness of the frame material 58*b* in other portions. In the example illustrated in FIG. 39, the thickness thereof is increased at least twice the thickness of the frame material 58*b* in other portions.

In this manner, both of the high rigidity and the lightness can be achieved.

Further, in FIGS. 27 to 39, through-holes formed in each plate-like member 12 is not illustrated.

The soundproofing structure of the present invention is not limited to those used in various equipment such as the above-described industrial equipment, transportation equipment, and general household equipment, and the soundproofing structure can be used as a fixed wall such as a fixed partition structure (partition) that is disposed in a building room and partitions the inside the room or a movable wall such as a movable partition structure (partition) that is disposed in a building room and partitions the inside of the room.

As described above, by using the soundproofing structure of the present invention, the sound can be suitably shielded between partitioned spaces. Further, particularly in a case of a movable partition, the thin and lightweight structure of the present invention is highly advantageous from the viewpoint that this structure is easy to carry.

Further, the soundproofing structure of the present invention can be suitably used as a window member because the soundproofing structure has a light transmittance and ventilation properties.

Alternatively, the soundproofing structure can be used as a cage that surrounds equipment serving as a noise source, for example, an outdoor air conditioner or a water heater, for the purpose of preventing the noise. By surrounding the noise source with the present member, the sound can be absorbed while ensuring heat dissipation or ventilation properties so that the noise can be prevented.

Further, the soundproofing structure may be used for a cage for pet raising. A pet cage which is lightweight and has an acoustic absorption effect can be obtained by applying the member of the present invention to a part or the entirety of the cage for pet raising and, for example, replacing one surface of the pet cage with the present member. By using this cage, it is possible to protect a pet in the cage from the outside noise and to prevent leakage of crying sound of the pet in the cage to the outside.

The soundproofing structure of the present invention can be used as the following soundproofing members in addition to those described above.

Examples of the soundproofing members having the soundproofing structure of the present invention are as follows.

a soundproofing member for a building material: a soundproofing member used as a building material;

a soundproofing member for air conditioning equipment: a soundproofing member which is installed in a ventilation opening or a duct for air conditioning and prevents noise from the outside;

a soundproofing member for an external opening portion: a soundproofing member which is installed on a window in a room and prevents noise from the inside or outside the room;

a soundproofing member for a ceiling: a soundproofing member which is installed on a ceiling in a room and controls the acoustic sound in the room;

a soundproofing member for a floor: a soundproofing member which is installed on a floor and controls the acoustic sound in the room;

a soundproofing member for an internal opening portion: a soundproofing member which is installed on a door or bran in a room and prevents noise from each room;

a soundproofing member for a toilet: a soundproofing member which is installed in a toilet or on a door (inside and outside the room) and prevents noise from the toilet;

a soundproofing member for a balcony: a soundproofing member which is installed in a balcony and prevents noise from the balcony or other balconies adjacent thereto;

an indoor articulating member: a soundproofing member for controlling the acoustic sound in a room;

a simple soundproofing chamber member: a soundproofing member which can be easily assembled and is easy to carry;

a soundproofing chamber member for pets: a soundproofing member which surrounds a pet's room and prevents noise;

amusement facilities: a soundproofing member which is installed in a game center, a sports center, a concert hall, or a movie theater;

a soundproofing member for surrounding a construction site: a soundproofing member which covers a construction site and prevents leakage of the noise around the site; and a soundproofing member for a tunnel: a soundproofing member which is installed in a tunnel and prevents leakage of the noise to the inside or outside the tunnel.

EXAMPLES

The present invention will be described in more detail based on the following examples. The materials, the amounts of use, the proportions, the treatment contents, and the treatment procedures described in the following examples can appropriately be changed within the range not departing from the gist of the present invention. Accordingly, the scope of the present invention should not be limitatively interpreted by the following examples.

Example 1

<Preparation of Plate-Like Member Having Plurality of Through-Holes>

The treatments described below were performed on a surface of an aluminum substrate (JIS H-4160, alloy No.: 1N30-H, aluminum purity: 99.30%) having an average thickness of 20 μm and a size of 210 mm×297 mm (A4 size), thereby preparing a plate-like member having a plurality of through-holes.

(a1) Aluminum Hydroxide Film Forming Treatment (Film Forming Step)

The aluminum substrate was used as a cathode, and an electrolytic treatment was performed thereon for 20 seconds under a condition of a total electric quantity of 1000 C/dm$^2$ using an electrolytic solution (nitric acid concentration of 10 g/L, sulfuric acid concentration of 6 g/L, aluminum concentration of 4.5 g/L, flow rate of 0.3 m/s) whose temperature was kept to 50° C. to form an aluminum hydroxide film on the aluminum substrate. Further, the electrolytic treatment was performed using a DC power supply. The current density was 50 A/dm$^2$.

After formation of the aluminum hydroxide film, the film was washed with water using a spray.

(b1) Electrodissolution Treatment (Through-Hole Forming Step)

Next, the aluminum substrate was used as an anode, and an electrolytic treatment was performed thereon for 24 seconds under a condition of a total electric quantity of 600 C/dm$^2$ using an electrolytic solution (nitric acid concentration of 10 g/L, sulfuric acid concentration of 6 g/L, aluminum concentration of 4.5 g/L, flow rate of 0.3 m/s) whose temperature was kept to 50° C. to form through-holes in the aluminum substrate and the aluminum hydroxide film. Further, the electrolytic treatment was performed using a DC power supply. The current density was 25 A/dm$^2$.

After formation of the through-holes, the film was washed with water using a spray.

(c1) Aluminum Hydroxide Film Removing Treatment (Film Removing Step)

Next, the aluminum hydroxide film was dissolved and removed by immersing the aluminum substrate on which the electrodissolution treatment had been performed in an aqueous solution (liquid temperature of 35° C.) with a sodium hydroxide concentration of 50 g/L and an aluminum ion concentration of 3 g/L for 32 seconds and then immersing the aluminum substrate in an aqueous solution (liquid temperature of 50° C.) with a nitric acid concentration of 10 g/L and an aluminum ion concentration of 4.5 g/L for 40 seconds.

Thereafter, the resultant was washed with water using a spray and dried, thereby preparing a plate-like member having through-holes.

The average opening diameter and the average opening ratio of the through-holes of the plate-like member in the prepared soundproofing structure were measured, and the average opening diameter was 24 μm and the average opening ratio was 5.3%.

Further, the surface shape of the inner wall surface of each through-hole in the prepared plate-like member was measured using an AFM (SPA300, manufactured by High-Tech Science Corporation). The measurement was carried out using OMCL-AC200TS as a cantilever in a dynamic force mode (DFM).

Figure 11:
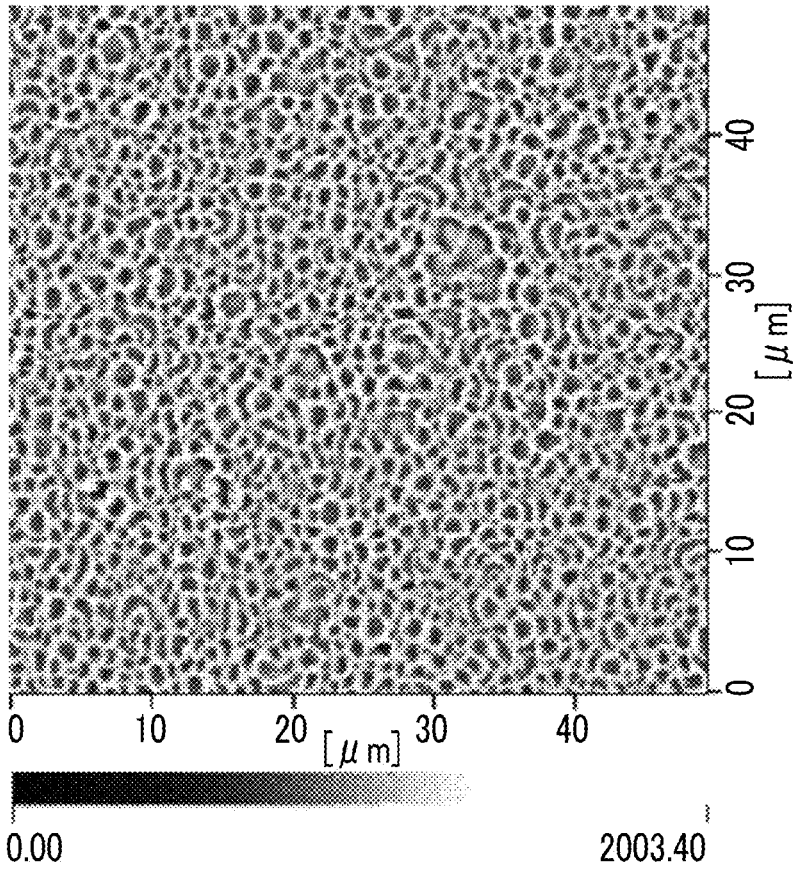
FIG. 11 is an image showing the results of AFM measurement performed on an inner wall surface of a through-hole.

The results are shown in FIG. 11.

Further, an SEM photo obtained by imaging the inner wall surface of each through-hole is shown in FIG. 12.

Based on FIGS. 11 and 12, it was found that the inner wall surface of the through-hole was roughened. Further, Ra was 0.18 (μm). The specific surface area in this case was 49.6%.

<Preparation of Soundproofing Structure>

An acrylic frame member having an opening with a size of 25 mm×25 mm, an outer shape of 60 mm×60 mm, and a height of 3 mm was prepared.

The prepared plate-like member having through-holes was cut into a size of 60 mm×60 mm, one end surface of the opening was covered by the plate-like member, and an end of the plate-like member was fixed to the frame member using double-sided tape (manufactured by Nitto Denko Corporation), thereby preparing a soundproofing structure.

[Evaluation]

<Acoustic Characteristics>

The acoustic characteristics of the prepared soundproofing structure were measured according to a transfer function method using four microphones with a self-making acrylic acoustic tube. This technique is based on "ASTM E2611-09: Standard Test Method For Measurement of Normal Incidence Sound Transmission of Acoustical Material Based on the Transfer Matrix Method". This measurement method has the same measurement principles as those of the four microphone measurement method using WinZac provided by (Nihon Onkyo Engineering Co., Ltd.). According to this method, the acoustic transmission loss can be measured in a wide spectral band. Particularly, the absorbance of a sample was accurately measured by measuring the transmittance and the reflectivity at the same time and acquiring the absorbance using "1−(transmittance+reflectivity)". The acoustic transmission loss was measured in a frequency range of 100 Hz to 4000 Hz. The inner diameter of the acoustic tube was 40 mm so that the measurement was able to be performed up to a frequency of 4000 Hz or greater.

The frame member portion of the soundproofing structure was inserted into the acoustic tube such that the opening portion covered by the plate-like member was disposed in the acoustic tube, and the vertical acoustic transmittance, the reflectivity, and the absorbance of the soundproofing structure were measured.

Figure 13:
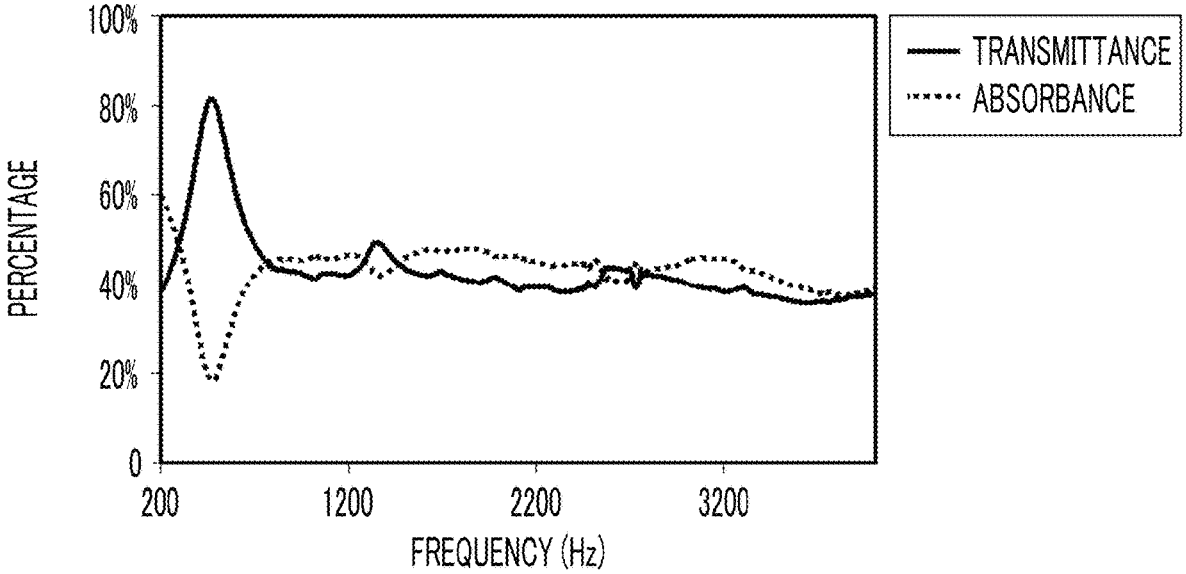
FIG. 13 is a graph showing the relationship between the frequency and the acoustic characteristics.

The results obtained by measuring the transmittance and the absorbance are shown in FIG. 13. Further, the average opening diameter, the average opening ratio, the size of the opening portion (noted as the "opening size" in Table 2), the first unique vibration frequency, the absorbance at the first unique vibration frequency, and the absorbance at 200 Hz and the average absorbance at the first unique vibration frequency or less as representative values of low frequencies are listed in Table 3. Further, the average absorbance at the first unique vibration frequency or less is an average value of the absorbances from 200 Hz to the first unique vibration frequency. Further, the results of Examples 2 to 9 and Comparative Examples 1 and 2 are also listed in Table 2.

As shown in FIG. 13 and Table 2, it was found that the first unique vibration frequency at which the transmittance is maximized is 450 Hz and the absorbance at the first unique vibration frequency is minimized. On a lower frequency side than the first unique vibration frequency, the absorbance is increased as in the absorbance on the low frequency side and reaches 59.5% at a frequency of 200 Hz.

Further, it was found that the absorbance is 40% or greater, which is in a state of being continuously high, even on a higher frequency side than the first unique vibration frequency. Further, it was clarified that the sound is not almost reflected at the first unique vibration frequency or less and almost the whole acoustic energy is divided into absorption and transmission.

Figure 14:
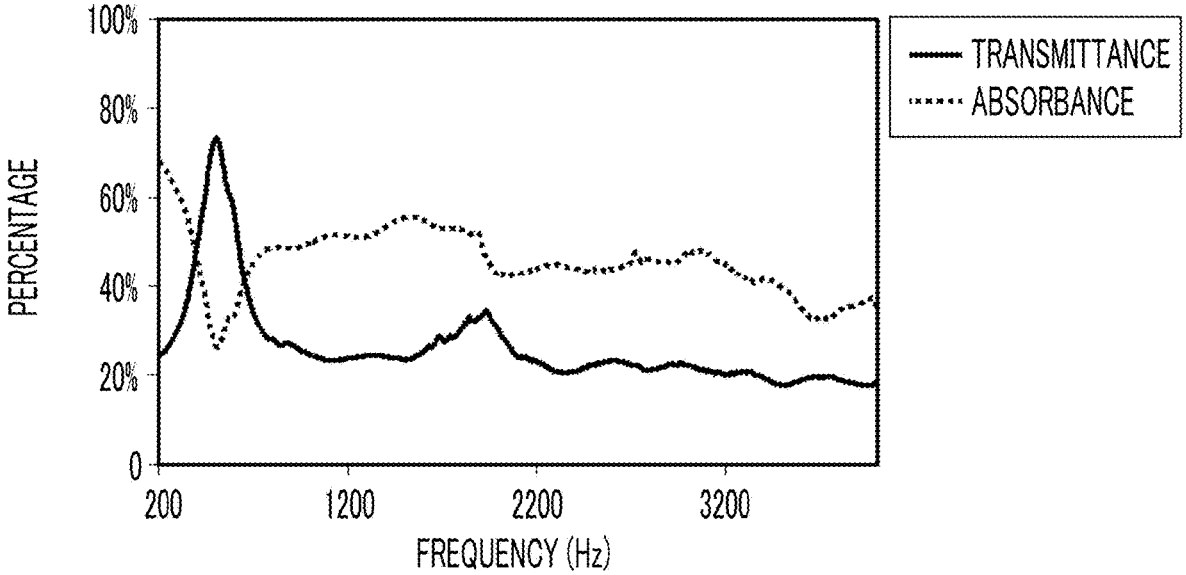
FIG. 14 is a graph showing the relationship between the frequency and the acoustic characteristics.
Figure 15:
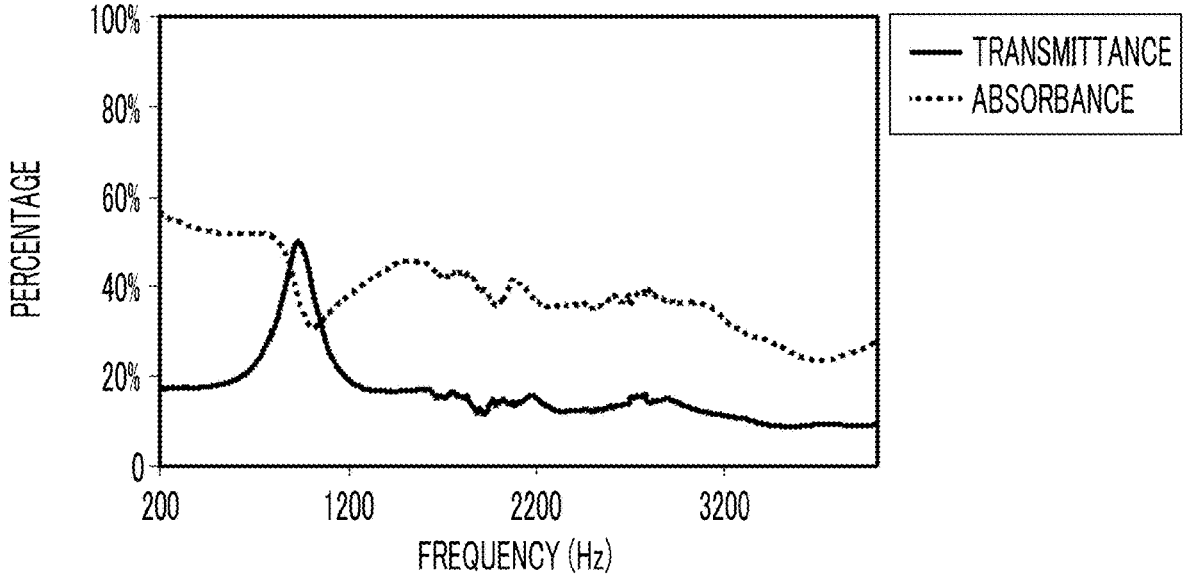
FIG. 15 is a graph showing the relationship between the frequency and the acoustic characteristics.

As shown in FIG. 14, FIG. 15, and Table 2, it was found that the first unique vibration frequency at which the transmittance is maximized is present and the absorbance at the first unique vibration frequency is minimized in Example 2 and Example 3. Further, it was found that, on a lower frequency side than the first unique vibration frequency, the absorbance is increased as in the absorbance on the low frequency side.

Further, based on the comparison between Examples 1 to 3, it was found that the first unique vibration frequency is shown on a high-frequency side as the size of the opening portion of the frame member is decreased.

Examples 4 to 6

With reference to WO2016/060037A and WO2016/017380A, soundproofing structures were prepared respectively in the same manners of Examples 1 to 3 except that plate-like members having through-holes with an average opening diameter of 51 μm and an average opening ratio of 18.7% prepared by changing the conditions were used.

The acoustic characteristics of the respective prepared soundproofing structures were measured in the same manner as in Example 1. The results obtained by measuring the absorbance were shown in FIG. 16. Further, the average opening diameters, the average opening ratios, the sizes of the opening portions, the first unique vibration frequencies, the absorbances at the first unique vibration frequencies, and the absorbances at 200 Hz and the average absorbances at the first unique vibration frequencies or less as representative values of low frequencies are listed in Table 2.

TABLE 2

| | Average opening diameter μm | Average opening ratio % | Opening size mm | First unique vibration frequency Hz | Absorbance at first unique vibration frequency (%) | Absorbance at 200 Hz (%) | Average absorbance at first unique vibration frequency or less (%) |
|---|---|---|---|---|---|---|---|
| Example 1 | 24 | 5.3 | 25 | 450 | 17.6 | 59.5 | 42.2 |
| Example 2 | 24 | 5.3 | 20 | 515 | 26.1 | 68.0 | 51.5 |
| Example 3 | 24 | 5.3 | 15 | 1000 | 30.3 | 56.7 | 50.2 |
| Example 4 | 51 | 18.6 | 25 | 500 | 19.1 | 33.1 | 27.1 |
| Example 5 | 51 | 18.6 | 20 | 560 | 23.4 | 38.2 | 33.1 |
| Example 6 | 51 | 18.6 | 15 | 1380 | 28.6 | 40.5 | 35.7 |
| Example 7 | 28 | 11.9 | 25 | 425 | 18.9 | 42.7 | 32.4 |
| Example 8 | 28 | 11.9 | 20 | 550 | 26.0 | 55.7 | 45.9 |
| Example 9 | 28 | 11.9 | 15 | 955 | 30.9 | 56.0 | 49.1 |
| Comparative Example 1 | — | — | 15 | 1055 | 29.7 | 6.6 | 9.8 |
| Comparative Example 2 | 4000 | 5.6 | 15 | 1225 | 28.6 | 12.6 | 16.1 |

Examples 2 and 3

Each soundproofing structure was prepared in the same manner as in Example 1 except that the opening sizes of the frame members were respectively changed to 20 mm and 15 mm.

The acoustic characteristics of the respective prepared soundproofing structures were measured in the same manner as in Example 1. The measurement results in Example 2 are shown in FIG. 14 and the measurement results of Example 3 are shown in FIG. 15. Further, the average opening diameters, the average opening ratios, the sizes of the opening portions, the first unique vibration frequencies, the absorbances at the first unique vibration frequencies, and the absorbances at 200 Hz and the average absorbances at the first unique vibration frequencies or less as representative values of low frequencies are listed in Table 2.

Figure 16:
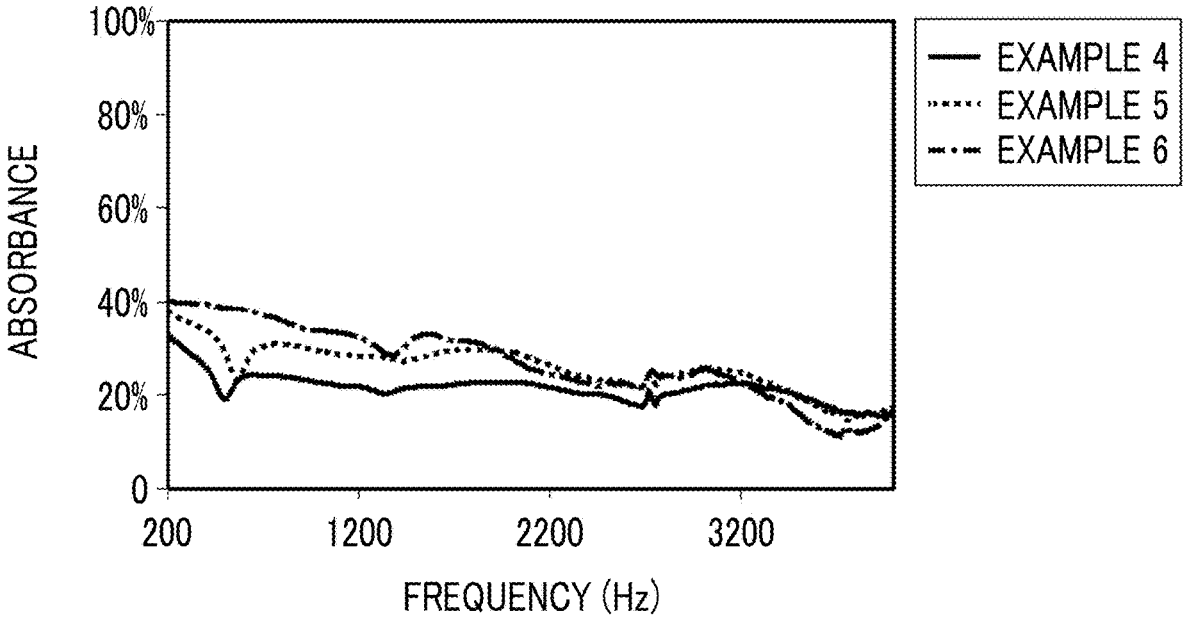
FIG. 16 is a graph showing the relationship between the frequency and the acoustic characteristics.

As shown in FIG. 16 and Table 2, it was found that, on a lower frequency side than the first unique vibration frequency, the absorbance is increased as in the absorbance on the low frequency side. Further, based on the comparison between Examples 4 to 6, it was found that the first unique vibration frequency is shown on a high-frequency side as the size of the opening portion of the frame member is decreased.

Further, based on the comparison between Examples 1 to 3 and Examples 4 to 6, it was found that the absorbance is increased as the average opening diameter and the average opening ratio are decreased.

Since the principle of the absorption of the present invention is considered to be sound absorption due to frictional heat in through-holes, it is important to increase the acoustic local speed in the through-holes. In a case where the average opening ratio is large, since the sound is directed toward a plurality of through-holes, it is advantageous that the average opening ratio is small from the viewpoint of increasing the local speed. Further, since the ratio of the length of an edge of a through-hole to the area of the through-hole is increased, it is advantageous that the average opening diameter is small from the viewpoint of converting the local speed into the frictional heat at the edge.

Examples 7 to 9

With reference to WO2016/060037A and WO2016/017380A, soundproofing structures were prepared respectively in the same manners of Examples 1 to 3 except that plate-like members having through-holes with an average opening diameter of 28 μm and an average opening ratio of 11.9% prepared by changing the conditions were used.

The acoustic characteristics of the respective prepared soundproofing structures were measured in the same manner as in Example 1. The results obtained by measuring the absorbance were shown in FIG. 17. Further, the average opening diameters, the average opening ratios, the sizes of the opening portions, the first unique vibration frequencies, the absorbances at the first unique vibration frequencies, and the absorbances at 200 Hz and the average absorbances at the first unique vibration frequencies or less as representative values of low frequencies are listed in Table 2.

Figure 17:
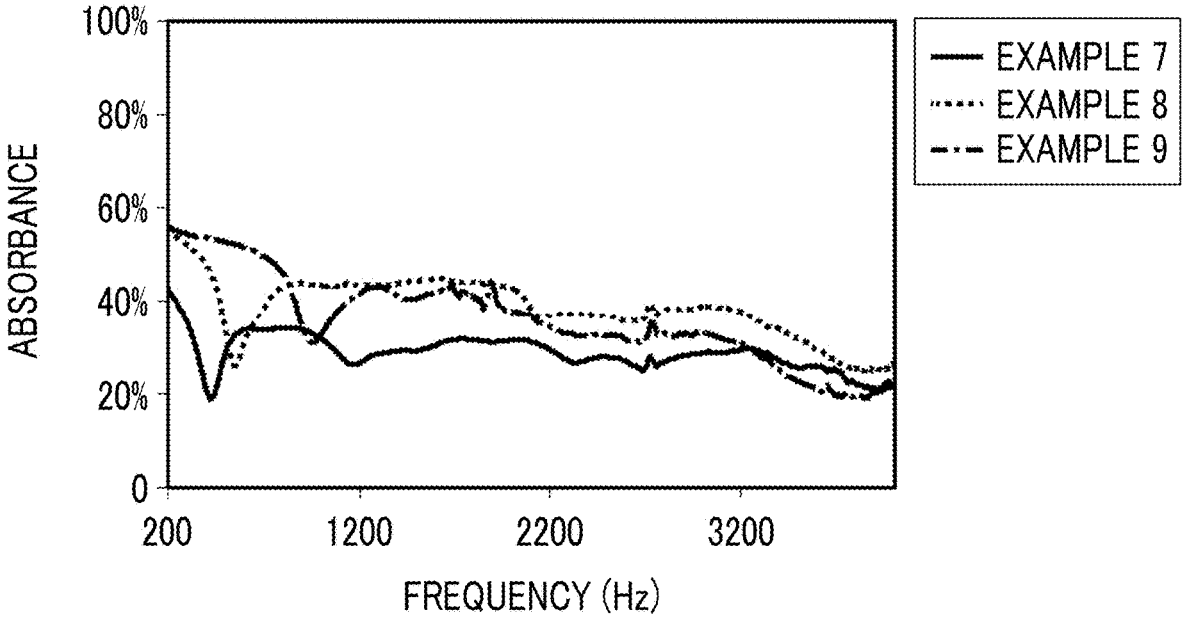
FIG. 17 is a graph showing the relationship between the frequency and the acoustic characteristics.

As shown in FIG. 17 and Table 2, it was found that, on a lower frequency side than the first unique vibration frequency, the absorbance is increased as in the absorbance on the low frequency side. Further, based on the comparison between Examples 7 to 9, it was found that the first unique vibration frequency is shown on a high-frequency side as the size of the opening portion of the frame member is decreased.

Example 10

Two soundproofing structures of Example 1 were arranged in the thickness direction such that the distance between plate-like members was set to 10 mm to prepare soundproofing structures.

The acoustic characteristics of each of the prepared soundproofing structures were measured in the same manner as in Example 1. The results obtained by measuring the absorbance are shown in FIG. 18.

Figure 18:
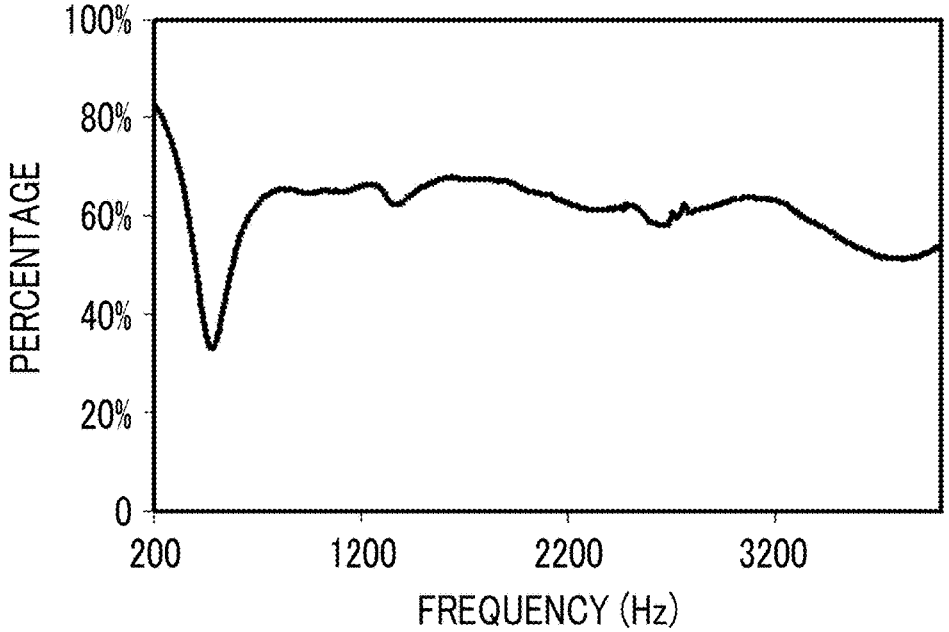
FIG. 18 is a graph showing the relationship between the frequency and the absorbance.

As shown in FIG. 18, it was found that the absorbance is further improved than the absorbance of one soundproofing structure.

Comparative Example 1

A soundproofing structure was prepared in the same manner as in Example 3 except that an aluminum substrate having a thickness of 20 μm, in which through-holes had not been formed, was used as a plate-like member.

The acoustic characteristics of the respective prepared soundproofing structures were measured in the same manner as in Example 1. The results obtained by measuring the absorbance and the transmittance were shown in FIG. 19. Further, the sizes of the opening portions, the first unique vibration frequencies, the absorbances at the first unique vibration frequencies, and the absorbances at 200 Hz and the average absorbances at the first unique vibration frequencies or less as representative values of low frequencies are listed in Table 2.

Figure 19:
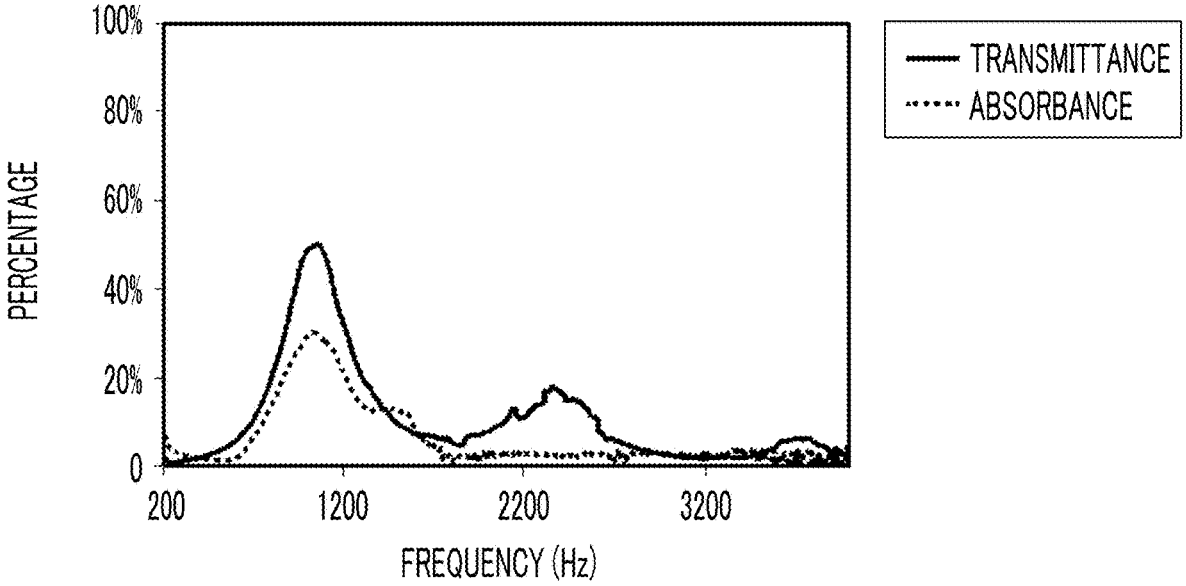
FIG. 19 is a graph showing the relationship between the frequency and the acoustic characteristics.

In a case where through-holes are not formed, the sound is mainly absorbed by membrane vibration of the plate-like member. At the first unique vibration frequency at which the transmittance is maximized, the plate-like member causes resonance and efficiently vibrates. Therefore, as shown in FIG. 19, the absorbance is maximized at the first unique vibration frequency in Comparative Example 1. At other frequencies, the absorbance is decreased compared to the absorbance at the first unique vibration frequency. Accordingly, as listed in Table 2, the absorbance at a frequency of 200 Hz and the average absorbance at the first unique vibration frequency or less become smaller than the absorbance at the first unique vibration frequency.

In Comparative Example 1, it was found that the absorbance at the first unique vibration frequency is small and there is a difference in absorbance on a low-frequency side when compared to Example 3. It was found that there is also a difference in absorbance on a high-frequency side, and thus the sound is absorbed in a broadband in Example 3 in which fine through-holes are provided.

Further, based on the comparison between Comparative Example 1 and Example 3, it was found that there is no significant difference at the first unique vibration frequency even through through-holes having an average opening ratio of 5.3% are present in Example 3. As the designing, simple designing can be performed such that the first unique vibration frequency is determined according to the desired performance, the material and the thickness of a single plate-like member and the size of the frame member (the size of the opening portion) are examined according to the first unique vibration frequency, and the plate-like member having through-holes is used in an actual experiment.

Comparative Example 2

Soundproofing structures were prepared in the same manner as in Example 3 except that an aluminum substrate having a thickness of 20 μm, in which through-holes having a diameter of 4 mm had been formed in the center thereof using a punch, was used as a plate-like member. The ratio (opening ratio) of the area of the through-holes to the area of the opening of the frame member was 5.6%, and this opening ratio was extremely close to the opening ratio of Example 3.

The acoustic characteristics of the respective prepared soundproofing structures were measured in the same manner as in Example 1. The results obtained by measuring the absorbance and the transmittance were shown in FIG. 20. Further, the average opening diameters, the average opening ratios, the sizes of the opening portions, the first unique vibration frequencies, the absorbances at the first unique vibration frequencies, and the absorbances at 200 Hz and the average absorbances at the first unique vibration frequencies or less as representative values of low frequencies are listed in Table 2.

Figure 20:
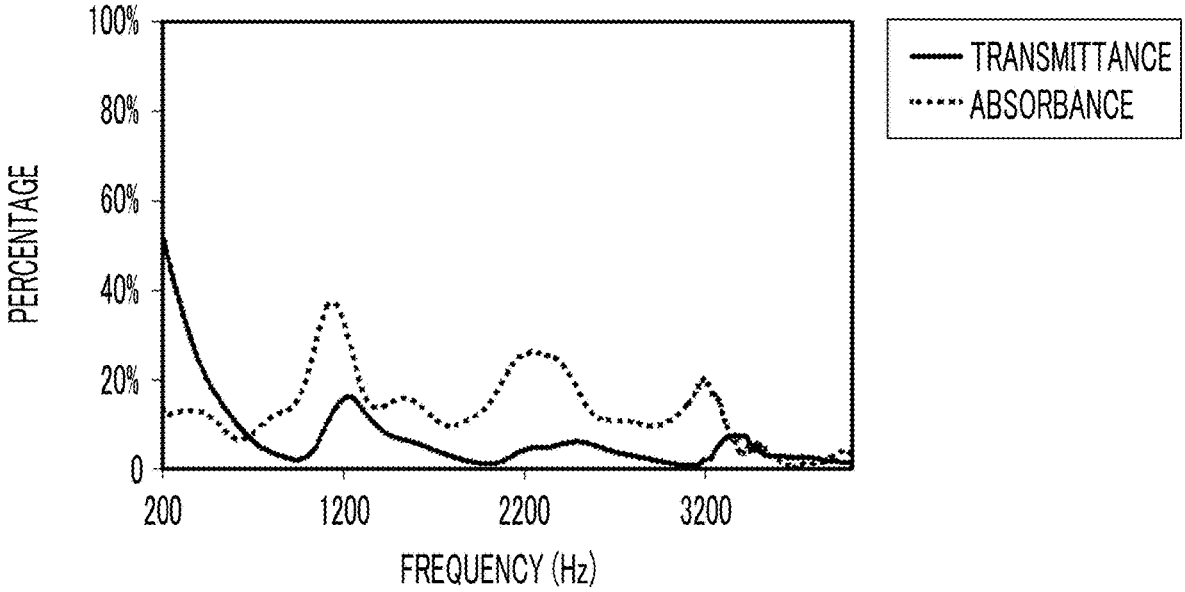
FIG. 20 is a graph showing the relationship between the frequency and the acoustic characteristics.

As illustrated in FIG. 20, the absorbance is maximized near the first unique vibration frequency at which the transmittance is maximized and the absorbance is decreased on a lower frequency side than the first unique vibration frequency. Therefore, as listed in Table 2, the average absorbance on a low frequency side is smaller than the absorbance at the first unique vibration frequency.

Based on these results, it was found that the absorbance in a broadband is unlikely to be obtained using large through-holes and this structure has different characteristics as those of the soundproofing structure of the present invention provided with a plurality of fine through-holes.

In the above-described example, an aluminum substrate was used as the material of the plate-like member, but it was clarified that the same effects were obtained even in a case where a material other than aluminum was used as the material of the plate-like member due to the mechanism for sound absorption of the soundproofing structure of the present invention. For example, it was confirmed that the same effects were obtained in a case where a PET film was used as another material of the plate-like member, the soundproofing structure was prepared using the film obtained by forming through-holes in the PET film using a laser to prepare a soundproofing structure, and then the absorbance was measured in the same manner as described above.

Example 11, Example 12, and Comparative Example 3

In Example 11, a soundproofing structure was prepared in the same manner as in Example 1 except that the conditions for preparing the plate-like member were changed to obtain a plate-like member having through-holes with an average opening diameter of 46.5 μm and an average opening ratio of 7.3%, and the size of the opening portion of the frame member was set to 50 mm×50 mm and the height thereof was set to 5 mm.

In Example 12, as illustrated in FIG. 41, a soundproofing structure was prepared in the same manner as in Example 11 except that a configuration in which a sound absorbing material was disposed in the opening portion was employed.

As the sound absorbing material, soft urethane foam U0016 (manufactured by Fuji Gomu Co., Ltd.) was used. Further, the size of the sound absorbing material was set to 50 mm×50 mm×20 mm according to the size of the opening portion and the sound absorbing material was disposed so as to be separated from the plate-like member by a distance of 2 mm. The sound absorbing material was disposed so as to protrude from the frame member.

Further, in Comparative Example 3, soundproofing structures were prepared in the same manner as in Example 12 except that a plate-like member was not provided.

In the respective prepared soundproofing structures, the absorbance was measured in the same manner as in Example 1 except that the inner diameter of the acoustic tube was set to 80 mm. The measurement results are shown in FIG. 43.

Figure 43:
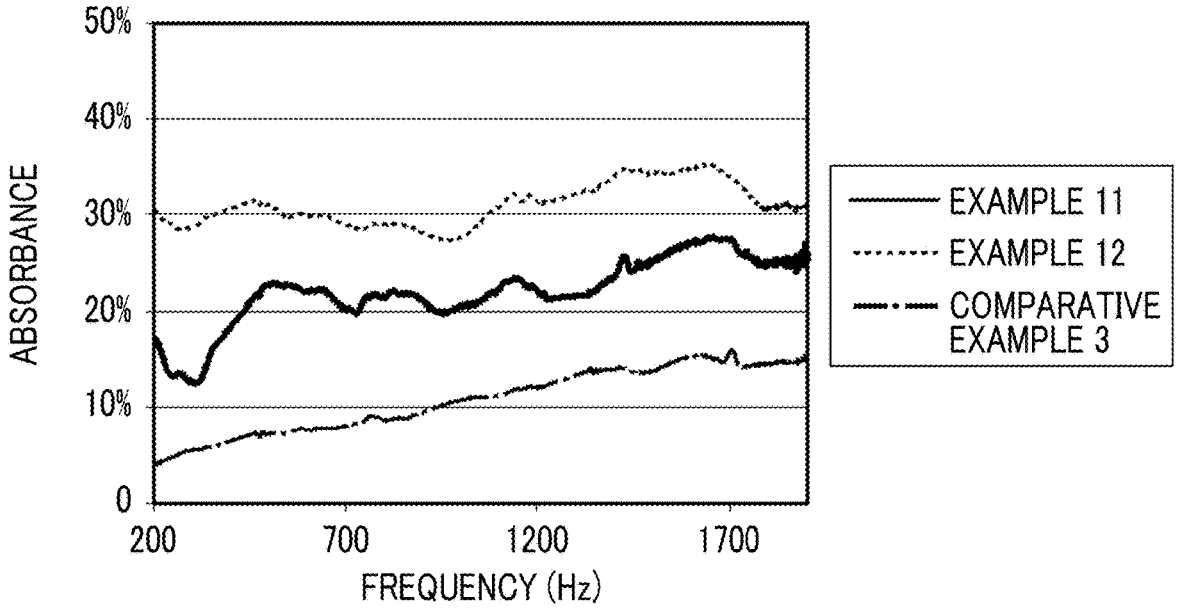
FIG. 43 is a graph showing the relationship between the frequency and the absorbance.

Based on the results of Example 11 illustrated in FIG. 43, the first unique vibration frequency at which the absorbance is minimized is 284 Hz. It was found that the absorbance on a lower frequency side than the first unique vibration frequency is increased even in a case where the size of the opening portion is increased to lower the first unique vibration frequency of the membrane vibration. Meanwhile, it was found that the absorbance is decreased as the frequency becomes lower in a case of Comparative Example 3 of the single sound absorbing material which does not have a plate-like member.

Further, based on the comparison between Example 11 and Example 12, it was found that the absorbance is increased in a broad frequency band by disposing the sound absorbing material in an opening portion.

Example 13, Example 14, and Comparative Example 4

In Example 13, a soundproofing structure was prepared in the same manner as in Example 11 except that the size of the opening portion of the frame member was set to 25 mm×25 mm.

In Example 14, as illustrated in FIG. 41, a soundproofing structure was prepared in the same manner as in Example 13 except that a configuration in which a sound absorbing material was disposed in the opening portion was employed.

As the sound absorbing material, soft urethane foam U0016 (manufactured by Fuji Gomu Co., Ltd.) was used. Further, the size of the sound absorbing material was set to 25 mm×25 mm×20 mm according to the size of the opening portion and the sound absorbing material was disposed so as to be separated from the plate-like member by a distance of 1 mm.

Further, in Comparative Example 4, soundproofing structures were prepared in the same manner as in Example 14 except that a plate-like member was not provided.

In the respective prepared soundproofing structures, the absorbance was measured in the same manner as in Example 1. The measurement results are shown in FIG. 44.

Figure 44:
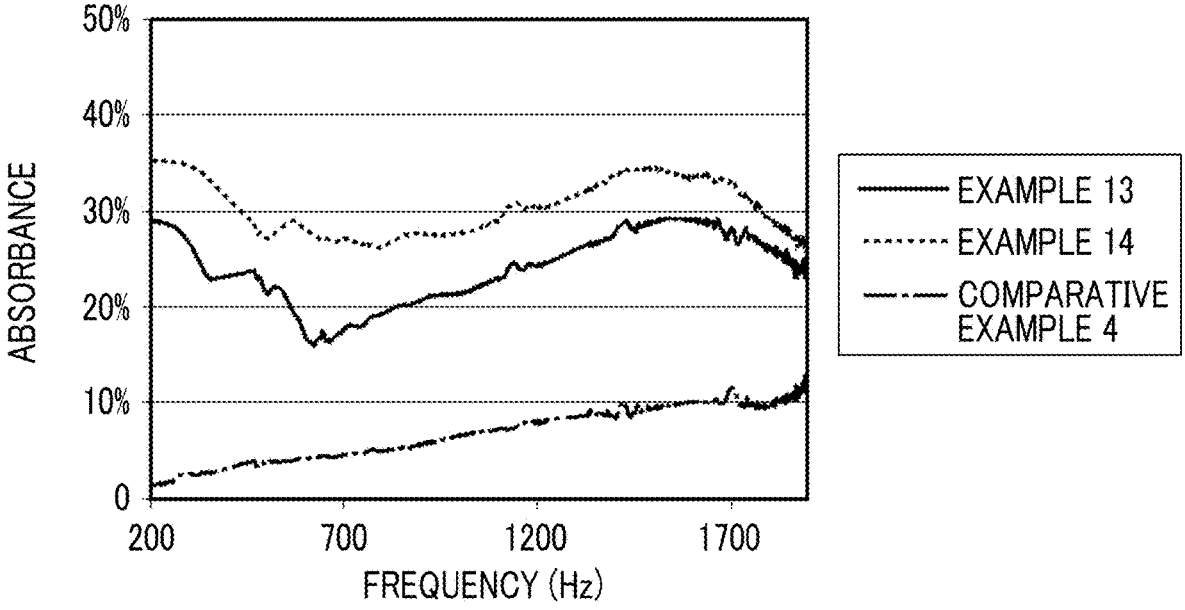
FIG. 44 is a graph showing the relationship between the frequency and the absorbance.

Based on the results of Example 13 illustrated in FIG. 44, the first unique vibration frequency at which the absorbance is minimized is 624 Hz. It was found that the absorbance even on a lower frequency side than the first unique vibration frequency is increased as shown in FIG. 44. Meanwhile, it was found that the absorbance is decreased as the frequency becomes lower in a case of Comparative Example 4 of the single sound absorbing material which does not have a plate-like member.

Further, based on the comparison between Example 13 and Example 14, it was found that the absorbance is increased in a broad frequency band by disposing the sound absorbing material in an opening portion.

Example 15, Example 16, and Comparative Example 5

In Example 15, a soundproofing structure was prepared in the same manner as in Example 13 except that the conditions for preparing the plate-like member were changed to obtain a plate-like member having through-holes with an average opening diameter of 16.4 μm and an average opening ratio of 2.8%

In Example 16, as illustrated in FIG. 41, a soundproofing structure was prepared in the same manner as in Example 15 except that a configuration in which a sound absorbing material was disposed in the opening portion was employed.

As the sound absorbing material, the same sound absorbing material as in Example 14 was used.

Further, in Comparative Example 5, soundproofing structures were prepared in the same manner as in Example 16 except that a plate-like member was not provided.

In the respective prepared soundproofing structures, the absorbance was measured in the same manner as in Example 1. The measurement results are shown in FIG. 45.

Figure 45:
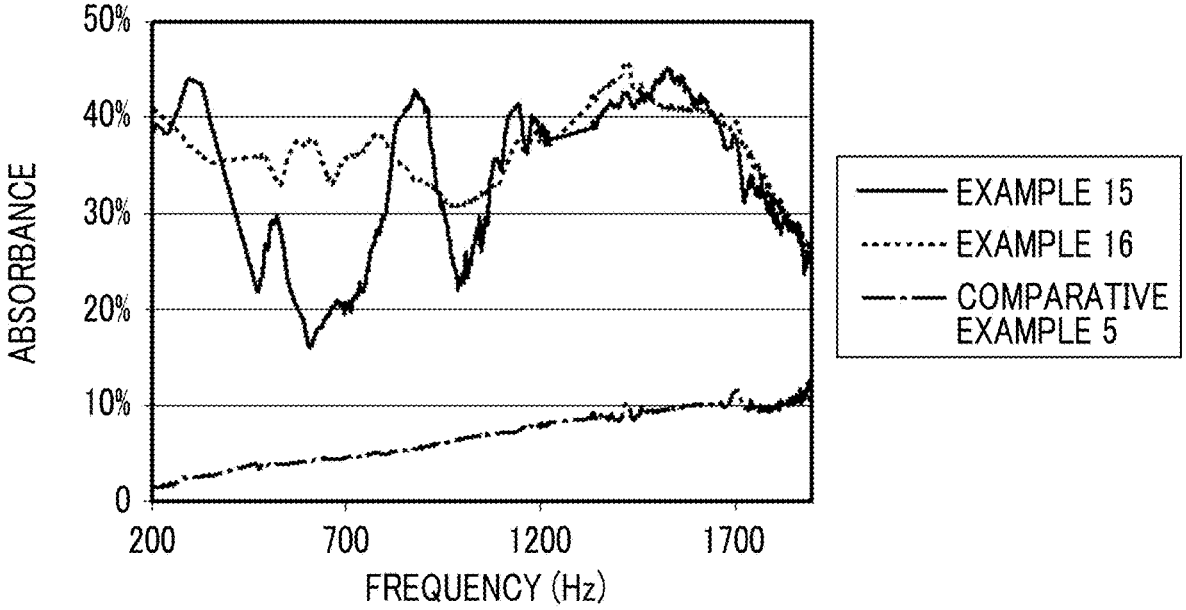
FIG. 45 is a graph showing the relationship between the frequency and the absorbance.

Based on the results of Example 15 illustrated in FIG. 45, the first unique vibration frequency at which the absorbance is minimized is 600 Hz. It was found that the absorbance even on a lower frequency side than the first unique vibration frequency is increased even in a case where the size of the opening portion is increased to lower the first unique vibration frequency of the membrane vibration. Meanwhile, it was found that the absorbance is decreased as the frequency becomes lower in a case of Comparative Example 5 of the single sound absorbing material which does not have a plate-like member.

Based on the results obtained from the comparison between Example 15 and Example 13, the absorbance fluctuates (difference in absorbance for each frequency)

drastically in Example 15. Since the average opening ratio is small in Example 15, the influence of the membrane vibration is relatively large.

Further, based on the results obtained from the comparison between Example 15 and Example 16, it was found that the absorbance is increased in a broad frequency band by disposing the sound absorbing material in the opening portion. Further, it was found that the fluctuation of the absorbance can be reduced.

Example 17

In Example 17, a soundproofing structure was prepared in the same manner as in Example 11 except that the material of the plate-like member was changed to nickel and a plate-like member having through-holes with an average opening diameter of 19.5 μm and an average opening ratio of 6.2% was used.

Further, a method of forming fine through-holes in a case where nickel was used as the material of the plate-like member is as follows.

First, a plurality of projections respectively having a columnar shape with a diameter of 19.5 μm were formed on the surface of a silicon substrate in a predetermined arrangement pattern according to an etching method using photolithography. The distance between the centers of projections adjacent to each other was set to 70 μm, and the arrangement pattern was set as a square grid arrangement. At this time, the area ratio of the projections was approximately 6%.

Next, nickel was allowed to be electrodeposited on the silicon substrate using this silicon substrate on which projections had been formed as a prototype according to a nickel electroforming method to form a nickel film having a thickness of 20 μm. Next, the nickel film was peeled off from the silicon substrate and the surface was polished. In this manner, a plate-like member made of nickel, in which a plurality of through-holes had been formed in a square grid arrangement, was prepared.

The prepared plate-like member was evaluated using an SEM, and the average opening diameter was 19.5 μm, the average opening ratio was 6.2 μm, and the thickness was 20 μm. Further, complete penetration of through-holes through the plate-like member in the thickness direction was also confirmed.

The absorbance of the prepared soundproofing structure was measured in the same manner as in Example 1. The measurement results are shown in FIG. 46.

Figure 46:
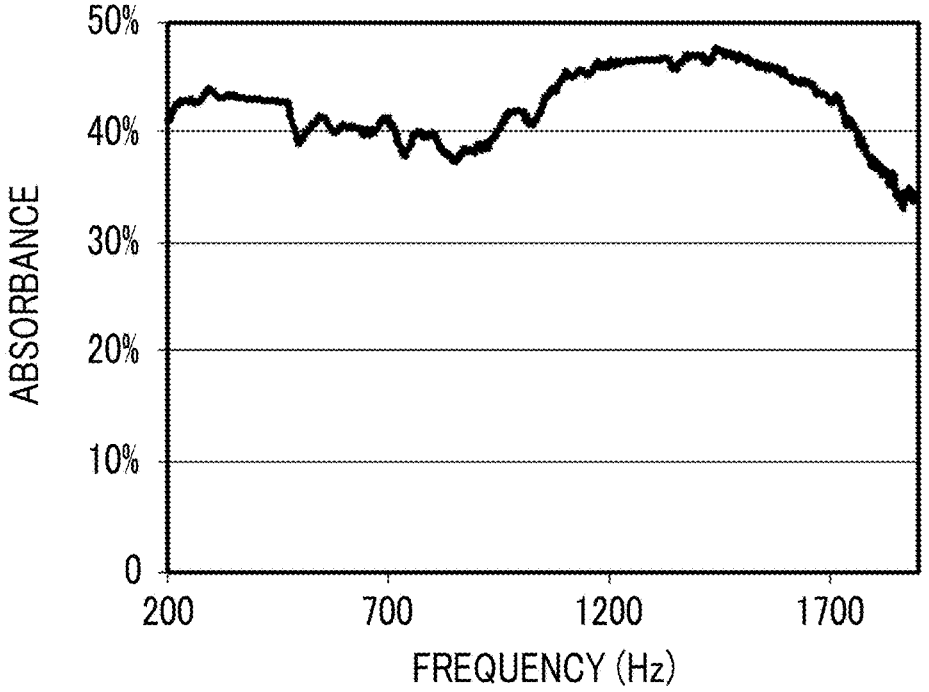
FIG. 46 is a graph showing the relationship between the frequency and the absorbance.

As shown in FIG. 46, it was found that the sound absorption performance can be exhibited even in a case where nickel was used as the material for the plate-like member. The effect can be exhibited regardless of the material for the plate-like member because the soundproofing structure of the present invention functions by forming a plurality of fine through-holes in the plate-like member.

Based on the description above, the effects of the present invention are evident.

[Evaluation 2]

<Visibility>

Next, the visibility of through-holes formed in the aluminum film prepared in Example 1 and the visibility of through-holes formed in the nickel film prepared in Example 17 were evaluated.

Figure 47:
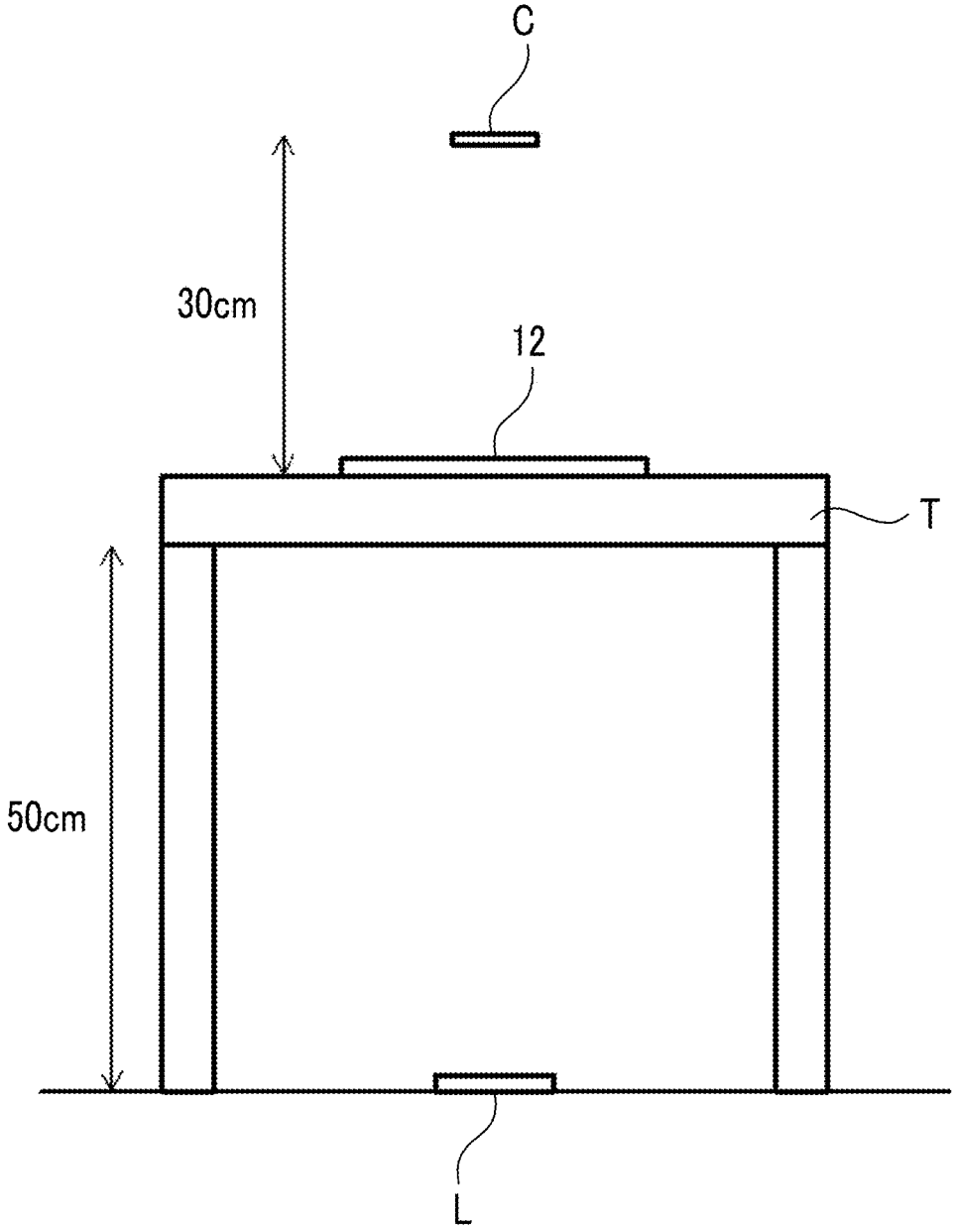
FIG. 47 is a schematic view for describing a method of measuring the visibility.

Specifically, as shown in FIG. 47, the plate-like member 12 was placed on an acrylic plate T having a thickness of 5 mm, and a point light source L (white light of Nexus 5 (manufactured by LG Electronics Incorporated)) was disposed at a position vertically separated from the principal surface of the acrylic plate T by a distance of 50 cm in a direction opposite to the plate-like member 12. Further, a camera C (iPhone 5s (manufactured by Apple Inc.)) was disposed at a position vertically separated from the principal surface of the plate-like member 12 by a distance of 30 cm.

The point light source was turned on and the light transmitted through the through-holes of the plate-like member 12 was visually evaluated from the position of the camera.

Next, transmitted light was imaged with a camera. It was confirmed that the imaged results are the same as those in a case of visual observation.

Figure 48:
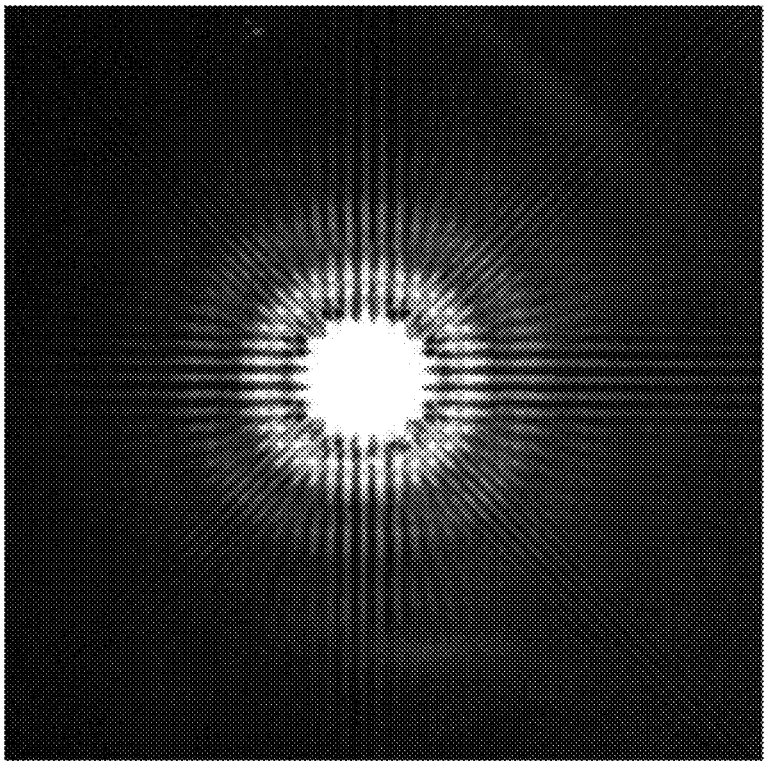
FIG. 48 is an image obtained by imaging the result of measuring the visibility.
Figure 49:
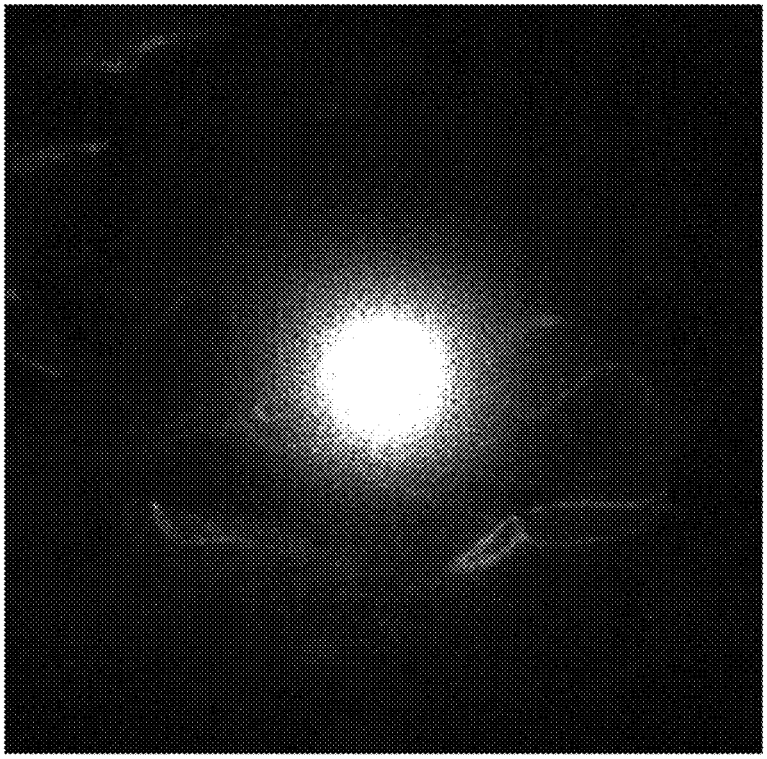
FIG. 49 is an image obtained by imaging the result of measuring the visibility.

FIG. 48 shows the results obtained by imaging a nickel film and FIG. 49 shows results obtained by imaging an aluminum film.

As described above, the nickel film prepared in Example 17 has through-holes which are regularly arranged. Accordingly, as shown in FIG. 48, the light is diffracted to spread out and is seen as a rainbow. Further, in the aluminum film prepared in Example 1, the through-holes are randomly arranged. Therefore, as shown in FIG. 49, a white light source is seen as it is without diffraction of light.

[Simulation]

As described above, the present inventors speculated that the principle of sound absorption of the soundproofing structure of the present invention is based on the friction generated from a sound passing through fine through-holes.

Accordingly, it is important to optimally design the average opening diameter and the average opening ratio of the fine through-holes of the plate-like member such that the friction is increased in order to increase the absorbance. For this reason, it is considered that the influence from the attachment of the plate-like member to the frame member is not high and the sound is absorbed using the sound absorption characteristics of the through-holes and the plate-like member because membrane vibration is reduced in a particularly high-frequency region.

Accordingly, the simulation for the frictional heat using fine through-holes was performed.

Specifically, designing was performed using an acoustic module of COMSOL ver. 5.1 (manufactured by COMSOL Inc.) serving as analysis software of a finite element method. By using a thermoacoustic model in the acoustic module, sound absorption can be calculated based on the friction between the wall and sound waves passing through a fluid (including the air).

First, the absorbance as the plate-like member was measured by loosely fixing the plate-like member having through-holes which was used in Example 1 for comparison with the experiment to the acoustic tube used in Example 1. In other words, the plate-like member was evaluated by reducing the influence of the fixed end as much as possible without attaching the plate-like member to the frame member. The results obtained by measuring the absorbance were shown in FIG. 21 as the reference example.

In the simulation, the inside of through-holes was calculated with a thermoacoustic module using the values of the library of COMSOL as the physical property values of aluminum, and sound absorption due to the membrane vibration and the friction inside through-holes was calculated. In the simulation, the system of the plate-like member was reproduced by fixing an end portion of the plate-like member to a roller so that the plate-like member was able to freely move in a direction perpendicular to the plane of the plate-like member. The results are shown as the simulation in FIG. 21.

Figure 21:
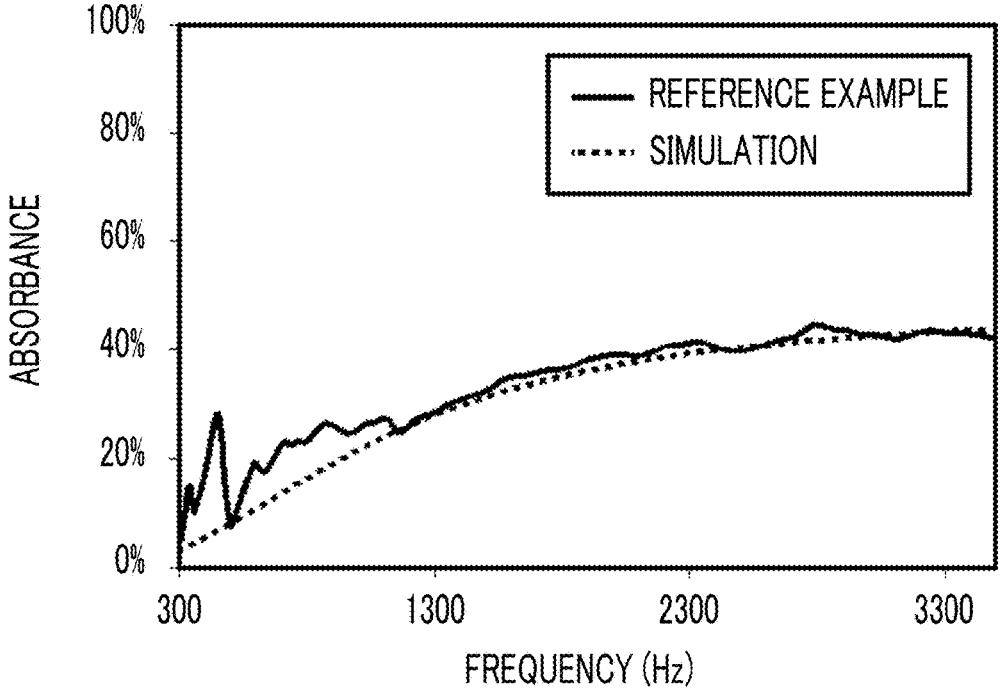
FIG. 21 is a graph showing the relationship between the frequency and the absorbance.

As shown in FIG. 21, it was found that the simulation precisely reproduces the experiment in a case where the absorbance of the experiment is compared to the absorbance of the simulation. A spike-like change on a low-frequency side in the experiment indicates that the effect of membrane vibration due to the fixed end is slightly exerted even in a case where an end portion of the plate-like member is loosely fixed. Since the influence of the membrane vibration is reduced as the frequency is higher, the results of the experiment matched to the results of the simulation carried out for evaluating the performance of a single plate-like member.

Based on these results, it is possible to ensure that the simulation reproduces the results of the experiment.

Next, in order to optimize the friction characteristics of the through-holes, the behavior of absorption was investigated by performing the simulation for fixing and restricting the plate-like member portion and allowing a sound passing through the through-holes was performed, and changing the thickness of the plate-like member, the average opening diameter and the average opening ratio of the through-holes. The frequency for the following calculation was 3000 Hz.

Figure 22:
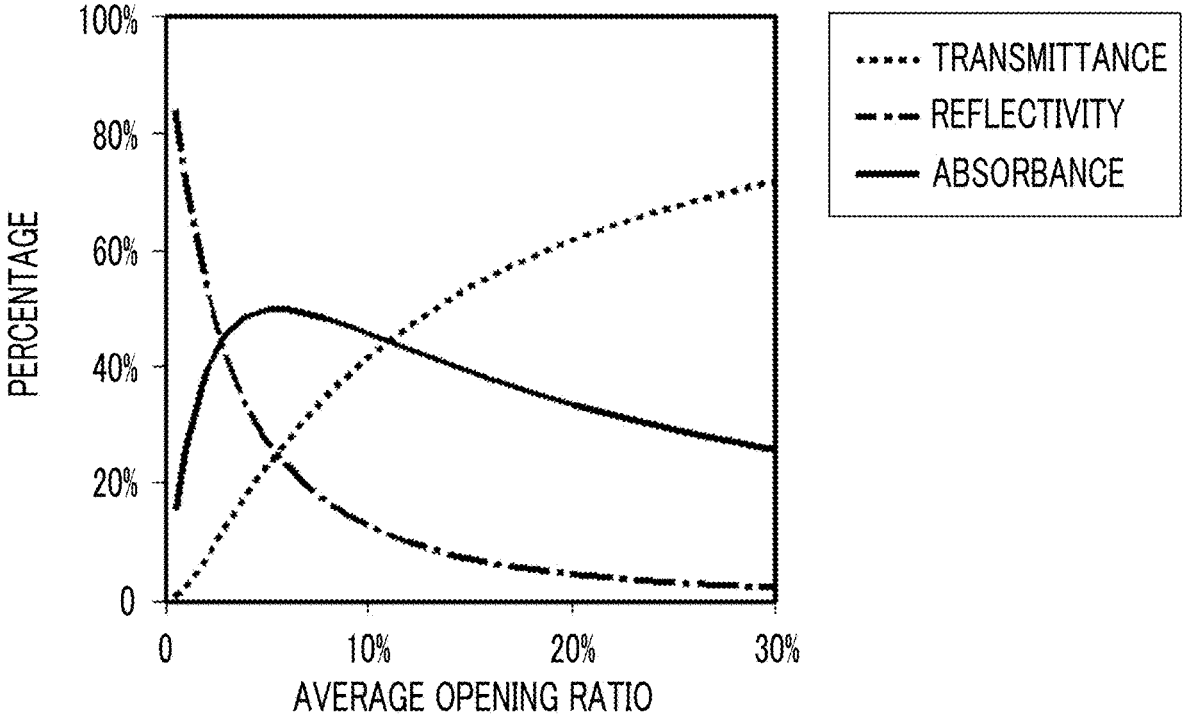
FIG. 22 is a graph showing the relationship between the average opening ratio and the acoustic characteristics.

For example, in a case where the thickness of the plate-like member was 20 μm and the average opening diameter of through-holes was 20 μm, the results obtained by calculating a change in a transmittance T, a reflectivity R, and a absorbance A at the time of changing the average opening ratio are shown in FIG. 22. Focusing on the absorbance, it was found that the absorbance changes by changing the average opening ratio. Accordingly, it was found that a maximum value at which the absorbance is maximized is present. In this case, it was found that the absorption is maximized at an opening ratio of 6%. At this time, the transmittance becomes approximately the same as the reflectivity. This does not means that the average opening ratio is preferably small in a case where the average opening diameter is small. It is necessary to adjust the value to the optimum value.

Further, it was found that a range of the average opening ratio where the absorbance increases gradually spreads about the optimum average opening ratio.

Figure 23:
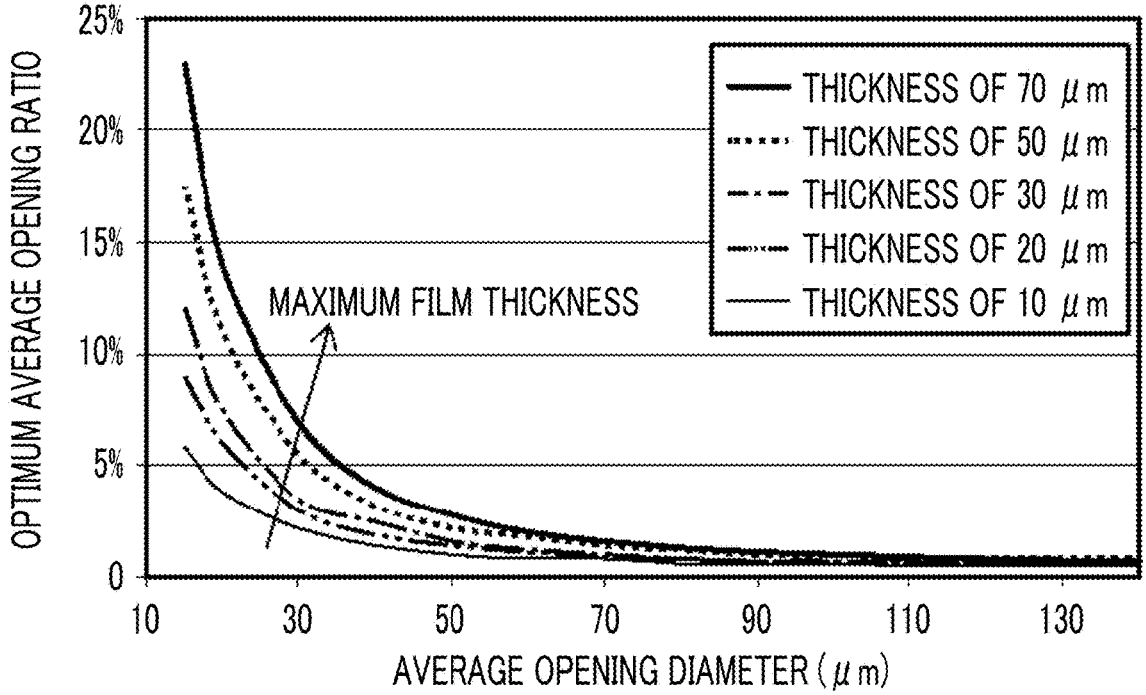
FIG. 23 is a graph showing the relationship between the average opening diameter and the optimum average opening ratio.

In order to determine the optimum average opening ratio, the average opening ratio in which the absorbance is maximized and the absorbance at this time are calculated under respective conditions by changing the average opening diameter of through-holes within a range of 20 μm to 140 μm in each of the thicknesses of the plate-like member of 10 μm, 20 μm, 30 μm, 50 μm, and 70 μm. The results are shown in FIG. 23.

The optimum average opening ratio varies depending on the thickness of the plate-like member in a case where the average opening diameter of through-holes is small. However, the optimum average opening ratio is in a range of 0.5% to 1.0%, which is extremely small, in a case where the average opening diameter of through-holes is approximately 100 μm or greater.

Figure 24:
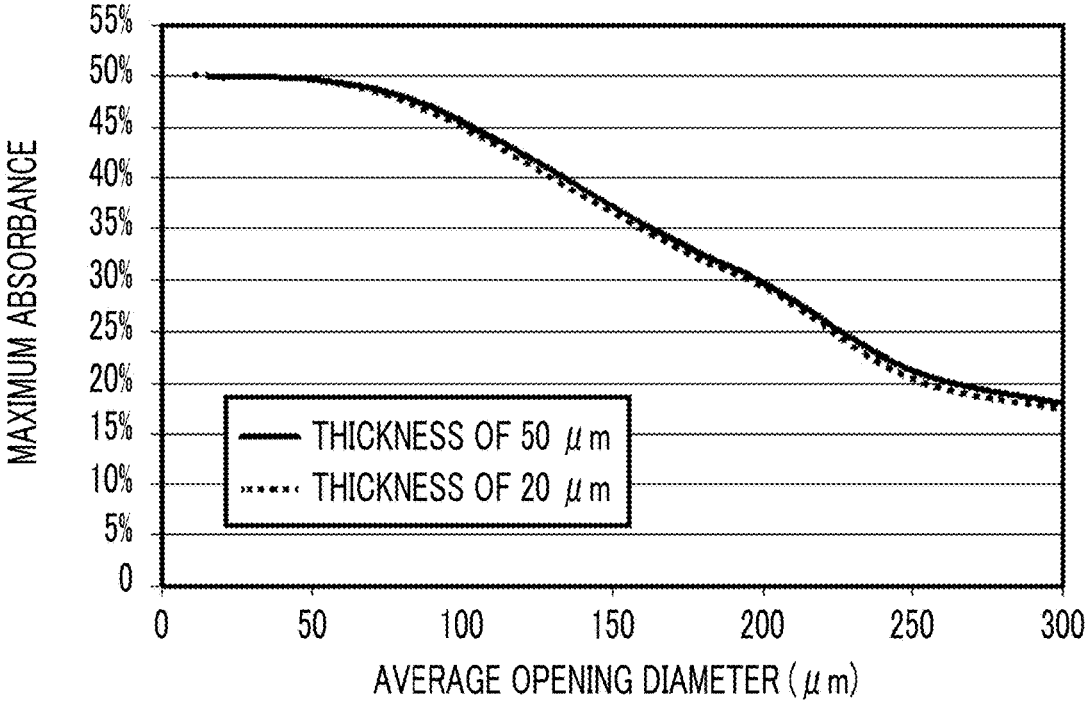
FIG. 24 is a graph showing the relationship between the average opening diameter and the maximum absorbance.

The maximum absorbance at which the average opening ratio is optimized with respect to the average opening diameter of each through-hole is shown in FIG. 24. FIG. 24 shows two cases, which are a case where the thickness of the plate-like member is 20 μm and a case where the thickness of the plate-like member is 50 μm. It was found that the maximum absorbance is determined by the average opening diameter of through-holes regardless of the thickness of the plate-like member. Further, it was found that the maximum absorbance is 50% in a case where the average opening diameter is 50 μm or less and the absorbance is decreased in a case where the average opening diameter is greater than 50 μm. The absorbance is decreased such that the absorbance is 45% in a case where the average opening diameter is 100 μm, the absorbance is 30% in a case where the average opening diameter is 200 μm, and the absorbance is 20% in a case where the average opening diameter is 250 μm. Accordingly, it was clarified that the average opening diameter is desirably small.

In the present invention, since it is desirable that the absorbance is large, an average opening diameter of 250 μm or less is required in a case where the upper limit of the absorbance is 20%, an average opening diameter of 100 μm or less is desirable in a case where the upper limit of the absorbance is 45%, and an average opening diameter of 50 μm or less is most desirable in a case where the upper limit of the absorbance is 50%.

Figure 25:
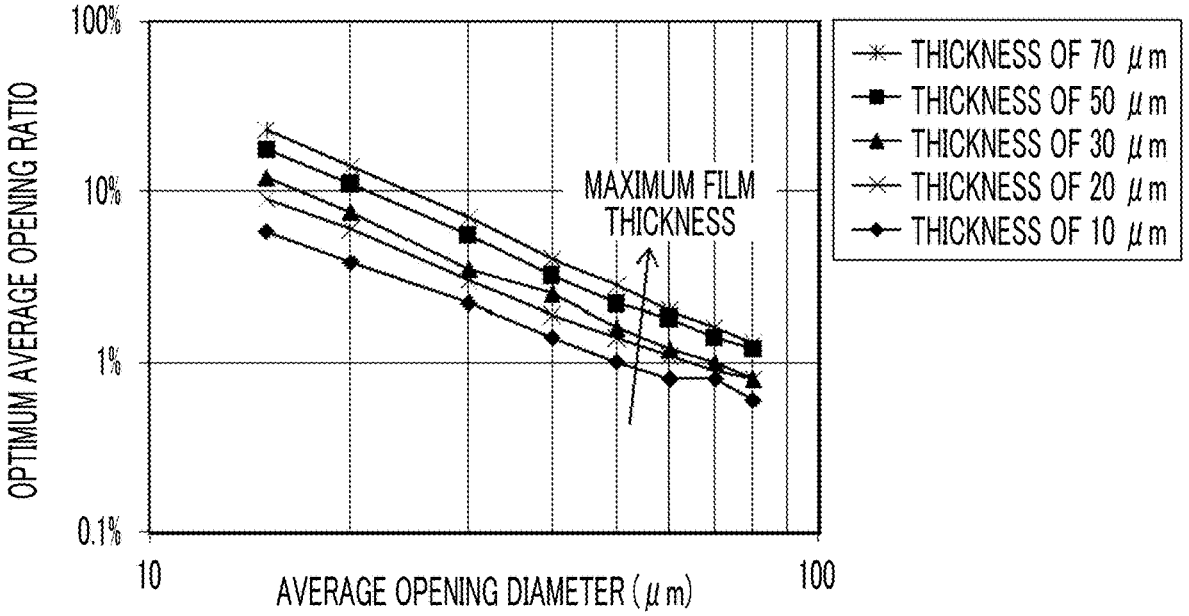
FIG. 25 is a graph showing the relationship between the average opening diameter and the optimum average opening ratio.

Hereinbefore, the optimum average opening ratio with respect to the average opening diameter of through-holes was calculated in a case where the average opening diameter was 100 μm or less. In each of the thicknesses of the plate-like member of 10 μm, 20 μm, 30 μm, 50 μm, and 70 μm, the results showing the optimum average opening ratio for each average opening diameter of through-holes are shown in FIG. 25 by a double-logarithmic graph. Based on the graph of FIG. 25, it was found that the optimum average opening ratio is changed by a power of −1.6 with respect to the average opening diameter of through-holes.

More specifically, in a case where the optimum average opening ratio is set as rho_center, the average opening diameter of through-holes is set as phi (μm), and the thickness of the plate-like member is set as t (μm), it was clarified that the optimum average opening ratio rho_center is determined as $rho_center = a \times phi^{-1.6}$ ($a = 2 + 0.25 \times t$).

In this manner, it was clarified that the optimum average opening ratio is determined by the thickness of the plate-like member and the average opening diameter of the through-holes particularly in a case where the average opening diameter of through-holes is small.

Figure 26:
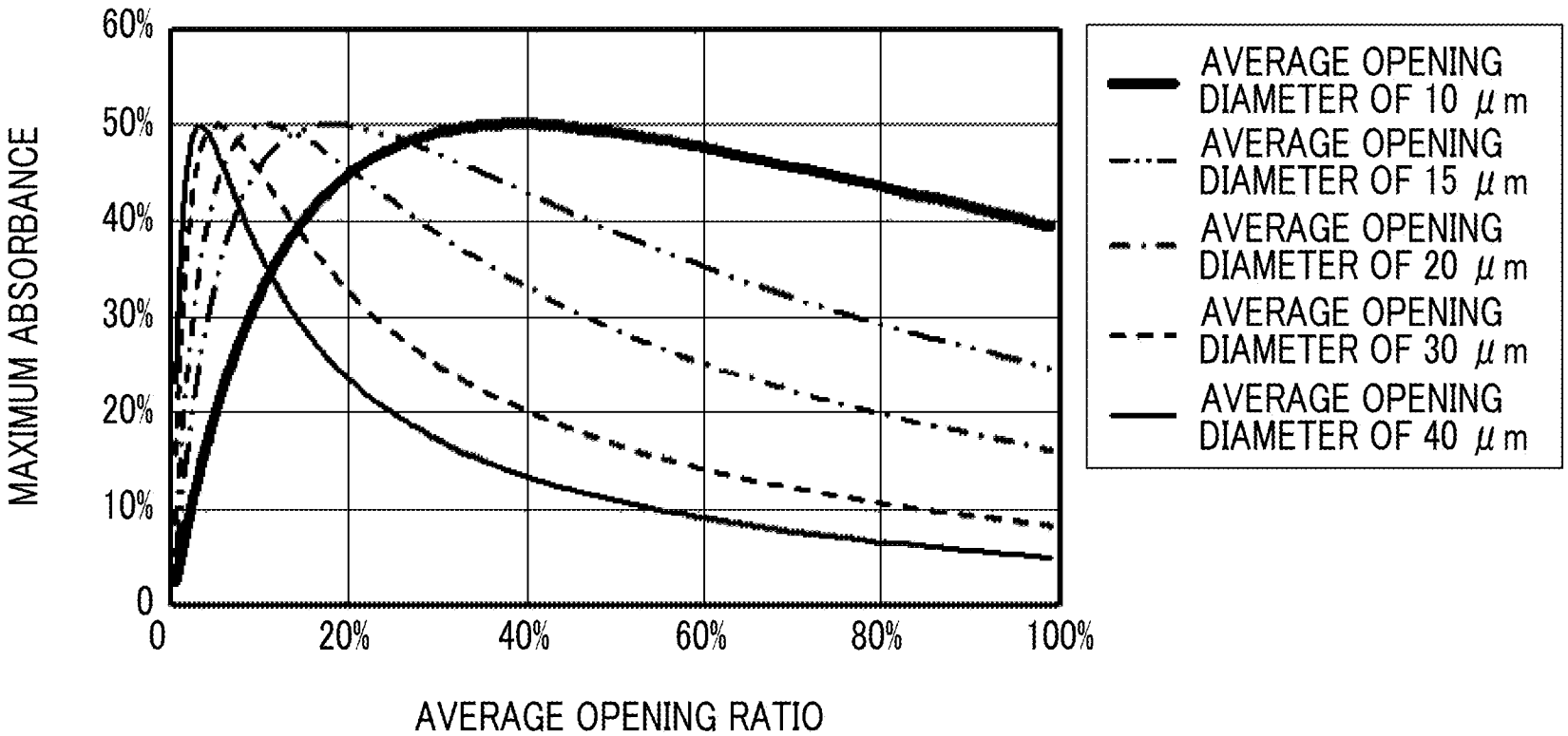
FIG. 26 is a graph showing the relationship between the average opening ratio and the maximum absorbance.

As described above, a region where the absorbance is large gradually spreads about the optimum average opening ratio. For detailed analysis, the results obtained by changing the average opening ratio in the simulation of the plate-like member having a thickness of 50 are shown in FIG. 26. The average opening ratio was changed from 0.5% to 99% by setting each of the average opening diameters of through-holes to 10 μm, 15 μm, 20 μm, 30 μm, and 40 μm.

In all average opening diameters, the range of the average opening ratio where the absorbance is increased spreads around the optimum average opening ratio. Characteristically, in a case where the average opening diameter of through-holes is small, the range of the average opening ratio where the absorbance is increased expands. Further, the range where the absorbance is increased becomes larger in a case where the average opening ratio is higher than the optimum average opening ratio.

Since the maximum value of the absorbance is approximately 50% in any average opening diameter, the lower limits of the average opening ratio and the upper limits of the average opening ratio in which the absorbance is 30%, 40%, and 45% are listed in Table 3. Further, the range of each absorbance from the optimum average opening ratio is listed in Table 4.

For example, the optimum average opening ratio is 11% in a case where the average opening diameter of through-holes is 20 μM, and the lower limit of the average opening ratio in which the absorbance is 40% or greater is 4.5% and the upper limit thereof is 28%. At this time, since the range of the average opening ratio in which the absorbance is 40% with respect to the optimum average opening ratio is "(4.5%−11.0%)=−6.5% to (28.0%−11.0%)=17.0%", the range of −6.5% to 17.0% is listed in Table 4.

TABLE 3

| Average opening diameter | Optimum average opening ratio | Lower limit in range of 30% | Lower limit in range of 40% | Lower limit in range of 45% | Upper limit in range of 45% | Upper limit in range of 40% | Upper limit in range of 30% |
|---|---|---|---|---|---|---|---|
| 10 μm | 39.0% | 9.0% | 15.0% | 20.5% | 73.0% | 96.0% | Greater than 99% |
| 15 μm | 17.5% | 4.5% | 7.0% | 9.5% | 34.0% | 47.0% | 77.0% |
| 20 μm | 11.0% | 2.5% | 4.5% | 6.0% | 20.5% | 28.0% | 46.0% |
| 30 μm | 5.5% | 1.5% | 2.5% | 3.0% | 10.0% | 13.5% | 23.0% |
| 40 μm | 3.0% | 1.0% | 1.5% | 2.0% | 6.0% | 8.0% | 14.0% |

TABLE 4

| Average opening diameter | Range from optimum average opening ratio | | |
|---|---|---|---|
| | Within range of 45% | Within range of 40% | Within range of 30% |
| 10 μm | −18.5% to 34% | −24.0% to 57.0% | −30.0% to |
| 15 μm | −8.0% to 16.5% | −10.5% to 29.5% | −13.0% to 59.5% |
| 20 μm | −5.0 to 9.5% | −6.5% to 17.0% | −8.5% to 35.0% |
| 30 μm | −2.5% to 4.5% | −3.0% to 8.0% | −4.0% to 17.5% |
| 40 μm | −1.0% to 3.0% | −1.5% to 5.0% | −2.0% to 11.0% |

As listed in Table 4, the widths of the absorbances for each average opening diameter of through-holes are compared. As the result, in a case where the average opening diameter of through-holes is set as phi (μm), the width of the absorbance is changed by a ratio of approximately $100\times phi^{-2}$. Accordingly, an appropriate range for each average opening diameter of each through-hole with respect to each of the absorbances of 30%, 40%, and 45% can be determined.

In other words, the range of the absorbance of 30% is determined using the above-described optimum average opening ratio rho_center and the range in a case where the average opening diameter of the through-holes is 20 μm as a reference. Accordingly, it is necessary that the absorbance falls in a range where $rho_center-0.085\times(phi/20)^{-2}$ is the lower limit of the average opening ratio and $rho_center+0.35\times(phi/20)^{-2}$ is the upper limit of the average opening ratio. In this case, the range of the average opening ratio is limited to be greater than 0 and less than 1 (100%).

The range of the absorbance of 40% is desirable. It is desirable that the absorbance falls in a range where $rho_center-0.24\times(phi/10)^{-2}$ is the lower limit of the average opening ratio and $rho_center+0.57\times(phi/10)^{-2}$ is the upper limit of the average opening ratio. Here, in order to minimize the error as much as possible, the reference of the average opening diameter of each through-hole is set as 10 μm.

The range of the absorbance of 45% is more desirable. It is more desirable that the absorbance falls in a range where $rho_center-0.185\times(phi/10)^{-2}$ is the lower limit of the average opening ratio and $rho_center+0.34\times(phi/10)^{-2}$ is the upper limit of the average opening ratio.

As described above, the characteristics of the sound absorbing phenomenon due to friction in the through-holes were clarified by simulation.

EXPLANATION OF REFERENCES

10, 20, 40: soundproofing structure
11: aluminum substrate
12, 12*b*: plate-like member
13: aluminum hydroxide film
14, 14*b*: through-hole
16, 46, 49, and 56: frame member
24: sound absorbing material
30*a* to 30*e*, 53: soundproofing member
31*a* to 31*e*, 44, 48, 54: soundproofing cell
32: cover
36, 41: desorption mechanism
38: wall
42*a*: projection
42*b*: depression
50: pipe
52: noise source
58: frame body
58*a*: frame material on both outer sides and central side
58*b*: frame material in other portions

What is claimed is:

1. A soundproofing structure comprising:
a plate-like member which has a plurality of through-holes passing therethrough in a thickness direction; and
a frame member which includes an opening portion passing therethrough and neither end portions of the opening portion of the frame member are closed,
wherein membrane vibration of the plate-like member is enabled by fixing the plate-like member to a peripheral edge of the opening portion of the frame member,
an average opening diameter of the through-holes is in a range of 0.1 μm to 250 μm, and
a first unique vibration frequency of the membrane vibration of the plate-like member is present in a range of 10 Hz to 100000 Hz.

2. The soundproofing structure according to claim 1,
wherein the average opening diameter of the through-holes is 0.1 μm or greater and less than 100 μm, and
in a case where the average opening diameter is set as phi (μm) and a thickness of the plate-like member is set as t (μm), an average opening ratio rho of the through-holes falls in a range where a center is $rho_center=(2+0.25\times t)\times phi^{-1.6}$, a lower limit is $rho_center-(0.085\times(phi/20)^{-2})$, and an upper limit is $rho_center+(0.35\times(phi/20)^{-2})$.

3. The soundproofing structure according to claim 1,
wherein the average opening diameter of the through-holes is in a range of 100 μm to 250 μm, and
an average opening ratio of the through-holes is in a range of 0.5% to 1.0%.

4. The soundproofing structure according to claim 1,
wherein an absorbance at a frequency of the first unique vibration frequency ±100 Hz is minimized in the membrane vibration of the plate-like member.

5. The soundproofing structure according to claim 2,
wherein an absorbance at a frequency of the first unique vibration frequency ±100 Hz is minimized in the membrane vibration of the plate-like member.

6. The soundproofing structure according to claim 3, wherein an absorbance at a frequency of the first unique vibration frequency ±100 Hz is minimized in the membrane vibration of the plate-like member.

7. The soundproofing structure according to claim 1, wherein a size of the opening portion of the frame member is smaller than a wavelength of a sound which has the maximum wavelength among sounds to be soundproofed.

8. The soundproofing structure according to claim 1, wherein a plurality of the plate-like members are arranged in the thickness direction.

9. The soundproofing structure according to claim 1, wherein a surface roughness Ra of an inner wall surface of the through-hole is in a range of 0.1 μm to 10.0 μm.

10. The soundproofing structure according to claim 1, wherein an inner wall surface of the through-hole is formed in a shape of a plurality of particles, and an average particle diameter of projections formed on the inner wall surface is in a range of 0.1 μm to 10.0 μm.

11. The soundproofing structure according to claim 1, wherein a material forming the plate-like member is a metal.

12. The soundproofing structure according to claim 1, wherein a material forming the plate-like member is aluminum.

13. The soundproofing structure according to claim 1, wherein the plurality of through-holes are randomly arranged.

14. The soundproofing structure according to claim 1, wherein the plurality of through-holes are formed of through-holes with two or more different opening diameters.

15. A soundproofing structure comprising:
a plurality of unit soundproofing structures,
wherein the soundproofing structure according to claim 1 is used as the unit soundproofing structure.

16. The soundproofing structure according to claim 1, wherein the average opening diameter of the through-holes is in a range of 0.1 μm to 50 μm.

17. The soundproofing structure according to claim 1, wherein at least some of the through-holes have a shape having a maximum diameter inside the through-holes.

18. A partition structure comprising:
the soundproofing structure according to claim 1.

19. A window member comprising:
the soundproofing structure according to claim 1.

20. A cage comprising:
the soundproofing structure according to claim 1.

* * * * *